US010900265B2

(12) United States Patent
Migliorini

(10) Patent No.: US 10,900,265 B2
(45) Date of Patent: Jan. 26, 2021

(54) STRUCTURALLY IMPROVED INVISIBLE HIDDEN DOOR HINGE WITH POSITION ADJUSTMENT

(71) Applicant: KUANTICA S.R.L., Faetano (SM)

(72) Inventor: Elia Migliorini, Dogana (SM)

(73) Assignee: KUANTICA S.R.L., Dogana (SM)

( * ) Notice: Subject to any disclaimer, the term of this patent is extended or adjusted under 35 U.S.C. 154(b) by 286 days.

(21) Appl. No.: 15/767,242

(22) PCT Filed: Sep. 29, 2016

(86) PCT No.: PCT/SM2016/000014
§ 371 (c)(1),
(2) Date: Apr. 10, 2018

(87) PCT Pub. No.: WO2017/065697
PCT Pub. Date: Apr. 20, 2017

(65) Prior Publication Data

US 2019/0071906 A1 Mar. 7, 2019

(30) Foreign Application Priority Data

Oct. 12, 2015 (IT) ..... 102015000060613
Oct. 12, 2015 (SM) ..... P-201500248

(51) Int. Cl.
*E05D 3/06* (2006.01)
*E05D 3/16* (2006.01)
(Continued)

(52) U.S. Cl.
CPC ..... *E05D 3/16* (2013.01); *E05D 3/186* (2013.01); *E05D 7/0415* (2013.01);
(Continued)

(58) Field of Classification Search
CPC .... E05D 3/06; E05D 3/12; E05D 3/14; E05D 3/142; E05D 3/16; E05D 3/125;
(Continued)

(56) References Cited

U.S. PATENT DOCUMENTS 1,058,740 A 4/1913 Fisher
1,083,622 A 1/1914 Kusterer
(Continued)

FOREIGN PATENT DOCUMENTS

CN 2406022 Y 11/2000
CN 2557653 Y 6/2003
(Continued)

OTHER PUBLICATIONS

International Search Report and Written Opinion of the International Searching Authority issued in PCT/SM2016/000014, dated Apr. 3, 2017; ISA/EPO.
(Continued)

*Primary Examiner* — Chuck Y Mah
(74) *Attorney, Agent, or Firm* — Knobbe, Martens, Olson & Bear, LLP

(57) ABSTRACT

In a invisible hidden door hinge (1), a first connecting body (2*a*) and a second connecting body (2*b*) are connected together by an articulation device (3) which allows the relative movement between a condition of opening and a closed condition in which the first (2*a*) and the second (2*b*) connecting body define a seat in which the articulation device (3) is enclosed. At least one of the connection bodies (2*a*, 2*b*) comprises a support structure (4*a*, 4*b*) in which, for a position adjustment, at least one movable body (5*a*, 5*b*) is housed which is shaped from a respective single metal sheet in a single concave piece having concavity defined by a bottom (52*a*, 52*b*) and by side walls (53*a*, 53*b*) that realize a continuous peripheral edge of the bottom (52*a*, 52*b*),
(Continued)

joined to the bottom (52*a*, 52*b*) without interruption of the material of which said respective single metal sheet consists of and surrounding the bottom (52*a*, 52*b*) on at least three consecutive sides.

37 Claims, 22 Drawing Sheets

(51) Int. Cl.
*E05D 3/18* (2006.01)
*E05D 7/04* (2006.01)
*E05D 9/00* (2006.01)

(52) U.S. Cl.
CPC ..... *E05D 7/0423* (2013.01); *E05D 9/00* (2013.01); *E05D 2007/0492* (2013.01); *E05Y 2600/41* (2013.01); *E05Y 2800/45* (2013.01); *E05Y 2800/674* (2013.01)

(58) Field of Classification Search
CPC ..... E05D 3/127; E05D 3/185; E05D 3/186; E05D 7/04; E05D 7/0423; E05D 7/0415; E05D 7/043; E05D 7/0027; E05D 7/0045; E05D 5/02; E05D 2007/0438; E05D 7/0446; E05D 7/0453; E05D 7/0461; E05D 7/0469; E05D 7/0476; E05D 7/0484; E05D 7/0492; E05D 9/00; E05Y 2600/41; E05Y 2600/634; E05Y 2600/412; E05Y 2600/45; E05Y 2600/452; E05Y 2600/46; E05Y 2900/132; E05Y 2900/20; E05Y 2900/50; E05Y 2900/531; E05Y 2900/546; E05Y 2201/638; E05Y 2800/46; E05Y 2800/674
See application file for complete search history.

(56) References Cited

U.S. PATENT DOCUMENTS

| | | | | | |
|---|---|---|---|---|---|
| 1,114,026 | A * | 10/1914 | Parsons | E05D 3/02 | 16/270 |
| 1,363,370 | A | 12/1920 | Soss | | |
| 1,688,996 | A | 10/1928 | Soss | | |
| 1,735,696 | A | 11/1929 | Ridley | | |
| 2,215,088 | A | 9/1940 | Soss | | |
| 2,217,937 | A * | 10/1940 | Anderson | E05D 3/02 | 16/379 |
| 3,805,323 | A * | 4/1974 | Fukui | E05D 3/186 | 16/390 |
| 4,177,540 | A * | 12/1979 | Gorton | E05D 11/1014 | 16/237 |
| 4,270,240 | A | 6/1981 | Zernig et al. | | |
| 4,368,559 | A | 1/1983 | Oepping et al. | | |
| 4,615,074 | A | 10/1986 | Lautenschlager, Jr. et al. | | |
| 4,771,508 | A | 9/1988 | Lautenschlager, Jr. | | |
| 4,797,972 | A | 1/1989 | Lautenschlager, Jr. | | |
| 5,075,928 | A * | 12/1991 | Bobrowski | E05D 5/06 | 16/273 |
| 5,632,067 | A | 5/1997 | Lautenschlager | | |
| 5,694,665 | A * | 12/1997 | Strickland | E05D 7/0423 | 16/237 |
| 6,430,779 | B1 * | 8/2002 | Goldsmith | E05D 3/186 | 16/357 |
| 6,829,808 | B2 | 12/2004 | Neukotter | | |
| 8,434,197 | B2 * | 5/2013 | Oshima | E05D 7/0423 | 16/357 |
| 8,549,706 | B2 * | 10/2013 | Bultschnieder | E05D 7/0423 | 16/238 |
| 2003/0088943 | A1 * | 5/2003 | Neukotter | E05D 7/0423 | 16/366 |
| 2010/0122431 | A1 * | 5/2010 | Neukoetter | E05D 3/186 | 16/238 |
| 2011/0041290 | A1 * | 2/2011 | Herglotz | E05D 3/18 | 16/375 |
| 2011/0296652 | A1 * | 12/2011 | Zhang | E05D 11/04 | 16/239 |
| 2012/0180396 | A1 * | 7/2012 | Liermann | E05D 3/186 | 49/398 |
| 2012/0291222 | A1 | 11/2012 | Liermann | | |
| 2012/0291225 | A1 * | 11/2012 | Liermann | E05D 3/186 | 16/364 |
| 2016/0047151 | A1 * | 2/2016 | Pelekanos | E05D 7/04 | 16/238 |
| 2016/0060937 | A1 * | 3/2016 | Bacchetti | E05D 11/06 | 16/322 |
| 2017/0130497 | A1 * | 5/2017 | Yamaguchi | E05D 3/186 | |
| 2019/0071904 | A1 | 3/2019 | Migliorini | | |
| 2019/0071905 | A1 | 3/2019 | Migliorini | | |

FOREIGN PATENT DOCUMENTS

| | | | | | |
|---|---|---|---|---|---|
| CN | 2851453 | Y | | 12/2006 | |
| CN | 202945901 | U | | 5/2013 | |
| CN | 204754526 | U | | 11/2015 | |
| DE | 2816635 | A1 | | 10/1979 | |
| DE | 3835391 | A1 | | 4/1990 | |
| DE | 4221393 | A1 | | 1/1994 | |
| DE | 19516084 | A1 | | 11/1996 | |
| DE | 19721153 | A1 | | 11/1998 | |
| DE | 102005039509 | B3 | | 6/2006 | |
| DE | 202010010645 | U1 | | 10/2010 | |
| DE | 102011050414 | B3 | | 4/2012 | |
| EP | 1308592 | B1 | | 12/2009 | |
| EP | 2184428 | A1 | | 5/2010 | |
| EP | 2450512 | A1 | * | 5/2012 | E05D 3/183 |
| EP | 2460964 | A1 | | 6/2012 | |
| EP | 2476833 | A1 | | 7/2012 | |
| EP | 2540941 | A2 | | 1/2013 | |
| EP | 2570575 | A1 | | 3/2013 | |
| EP | 2031166 | B1 | | 12/2013 | |
| EP | 2342408 | B1 | * | 1/2014 | E05D 7/0423 |
| FR | 2948716 | A3 | | 2/2011 | |
| JP | 06288139 | A | * | 10/1994 | E05D 7/04 |
| JP | 2002-121955 | A | | 4/2002 | |
| JP | 2007177427 | A | | 7/2007 | |
| JP | 2007211577 | A | * | 8/2007 | E05D 3/186 |
| JP | 2008008015 | A | | 1/2008 | |
| WO | WO-2010143405 | A1 | | 12/2010 | |
| WO | WO-2013179326 | A1 | * | 12/2013 | E05D 3/186 |
| WO | WO-2014006587 | A1 | * | 1/2014 | E05D 5/06 |

OTHER PUBLICATIONS

Italian Search Report (in Italian) and Written Opinion (in English and Italian) of the Minister of Economic Development issued in Italian Patent Application No. 102015000060613, dated May 11, 2016.

International Preliminary Report on Patentability (Chapter II) for PCT/SM2016/000014, IPEA/EPO, dated Sep. 1, 2017.

International Search Report and Written Opinion of the International Searching Authority issued in PCT/SM2016/000016, dated Jan. 30, 2017; ISA/EPO.

International Search Report and Written Opinion of the International Searching Authority issued in PCT/SM2016/000015, dated Jan. 30, 2017; ISA/EPO.

International Preliminary Report on Patentability (Chapter 11) for PCT/SM2016/000016, IPEA/EPO, dated Sep. 1, 2017.

Notice of Opposition issued in European Patent Application No. 16809208.8, dated Feb. 4, 2020, in 3 pages.

Italian Search Report (in Italian) and Written Opinion (in English and Italian) of the Minister of Economic Development issued in Italian Patent Application No. 10201500006061, dated May 13, 2016.

Italian Search Report (in Italian) and Written Opinion (in English and Italian) of the Minister of Economic Development issued in Italian Patent Application No. 102015000060624, dated May 20, 2016.

(56) References Cited

OTHER PUBLICATIONS

Simonswerk GmbH, "Handbuch 2012/2013" Simonswerk GmbH, 2012.
Simonswerk GmbH, "125 Jahre in Bewegung—die Unternehmensgeschichte 1889-2014" Simonswerk GmbH, 2014.

* cited by examiner (b)

(a)

(a)
(b)
(c)
(d)
(e)
(f)
Z1
Y1
X1
I
II
III
IV
5a
31a
51a
52a
53a
500a
501a
502a
503a
504a
505
510a
530a
533
720
721
722
723
72

(a)
(b)
(c)
(d)
(e)
(f)
5b
500b
52b
53b
55
522
523
532
533'
51b
501b
50b
I
II
III
IV
X2
Y2
Z2

(a)
(b)
1
2a
2b
3
4a
4b
5b
6b
22a
22b
40a
41a
41b
200
201
202
203
204
205
206
291
X1
Y1
Z1
X2
Y2
Z2
522
52b
55,65
56
66
532
533
624
62b
630b
632
633
216
C

STRUCTURALLY IMPROVED INVISIBLE HIDDEN DOOR HINGE WITH POSITION ADJUSTMENT

CROSS-REFERENCE TO RELATED APPLICATIONS

This application is a 371 U.S. National Stage of International Application No. PCT/SM2016/000014, filed on Sep. 29, 2016 and published in English as WO 2017/065697 A1 on Apr. 20, 2017. This application claims the benefit of Italian Patent Application No. IT 10 2015 000060613, and San Marino Patent Application No. SM-P-201500248, both filed on Oct. 12, 2015. The disclosure of each of the above-identified applications is incorporated by reference as if set forth in their entirety herein.

BACKGROUND OF THE INVENTION

The present invention concerns a structurally perfected invisible hidden door hinge.

The type of so-called "invisible hidden" hinges is used for a hidden positioning between a door and a relevant jamb. Generally the hinges of this type comprise two connecting bodies, one on the jamb side and one on the door side, respectively insertable in the jamb or in the leaf of the door. The two connecting bodies are connected to each other by an articulation device, generally composed of hinge arms structured in such a way to ensure the relative movement of the two connecting bodies (and, therefore, of the door with respect to the jamb). With the door closed, the hinge arms are received in a housing compartment formed in combination by the two connection bodies which face one another, thus making the hinge invisible from both sides of the door. A support structure of the connecting bodies is the intermediate means between the articulation device and the door or the jamb, in particular interacting with and/or supporting, in correspondence of two of its end portions, fixing means for fixing the hinge to the jamb or the door. Said fixing means can be engaged directly to the support structure or acting between it and the jamb or the door by means of one or more intermediate elements.

In some cases, the hinge provides a limited number of components: the connecting body is reduced substantially to the relevant support structure (apart from the fixing means and possible intermediate elements) and the hinge, therefore, it substantially reduces to the two support structures connected to one another via the articulation device. Usually, however, the hinge has a greater number of components, especially when it is realized in one or more adjustments of position along one or more respective directions in space. In this case one or both of the connecting bodies comprise, in addition to the support structure, one or more movable bodies and/or one or more movable inserts associated in various ways to the support structure (and by this directly or indirectly supported), each being movable with respect to the other and/or to the support structure for a respective adjustment position. In the connecting body a generally nested structure is then realized, in which the articulation device is engaged to each connecting body directly on the movable body or movable inserts which are most distal from the support structure. In the prior art, the structure of support and movable bodies therein nested generally have a central cavity and, on opposite sides of the latter, flat flange portions for the engagement of fixing and/or adjusting means. The movements of various movable bodies and/or movable inserts with respect to each other, and/or with respect to the support structure, are realized by means of respective adjusting means. Even the articulation device can be more or less complex, depending on the elements that compose it and on their shapes.

In general, in order to ensure the movements and/or the necessary adjustments, each of the main components of the hinge (the support structures, the movable parts and/or movable inserts, the arms or arm elements that compose the articulation device) must have geometrically complex shapes and characterized by numerous details, each of which must be made with precision to ensure the correct operation of the hinge. In particular, in a hinge provided with movable bodies and/or movable inserts, a detail useful for a position adjustment presents a certain complexity. Specifically, it deals with realizing, in a flat flange of a movable body and/or a movable insert, a seat for inserting the head of an adjusting actuator, which allows the rotation of the adjustment actuator about an axis and, at the same time, prevents its translation along the same axis. This is generally a housing groove locally complementary to the shape of the actuator itself.

The complexity of the structure of the main components of the hinge and the high precision required in their construction, are accompanied by the need to realize these main components of the hinge with a material having adequate mechanical strength to enable the hinge to support the doors which have even considerable weight.

To obtain the required effect, commonly one resorts to the use of structures of metal material, obtained by casting and injection molding with the necessary shape. In general, an alloy of zinc and aluminum is used, which guarantees the obtention, in suitable molds, of the wished shapes having the necessary accuracy. Such a material, however, has a limit of mechanical resistance which forces the creation of structures that, in their parts, have different and significant thicknesses, with the consequence of consumption of a large amount of material and increase of costs. In some applications, the components are manufactured with the same technology, but using the steel as a material, which is more performing. However, the injection molding using the molten steel is a complex technology, which requires numerous processing steps and, since it does not ensure the accuracy of the various parts, it requires an injection molding by subsequent stages and/or mechanical machining performed on the workpiece subsequently to its formation by injection molding. Once again, the use of non-negligible material thicknesses occurs, with the consequent use (and loss) of considerable amounts of material. To try to overcome this problem without sacrificing the mechanical characteristics of the steel, in some cases one renounces to the complexity of the structure of some of the hinge components and realizes the support structure and the movable bodies as simple narrow and elongated metal sheets, whose central part is folded in as a "U". One or more metal sheets can be placed over one another to realize the support structure and the relevant movable bodies (in particular by nesting the "U" portions of the metal sheets one inside the other and leaning the remaining portions of the metal sheets that are located on opposite sides of said "U"-shape on one another). To obtain the necessary mechanical rigidity to support the doors having non-negligible weight by means of the thus obtained hinges, the used metal sheets must have a very high thickness, thus making necessary the use of a large amount of material and making very difficult (because of the stiffness of the material to be machined) the production of the thus constructed hinge components. The obtained hinges, then, have an open structure which, in addition to being aesthetically unpleasant, can cause installation problems in the jamb or in the door leaf. Once the hinge has been installed in the corresponding notches in the door jamb or in the door leaf, indeed, often foaming with foam materials (in particular polyurethane) of part of the notch and/or the jamb or the leaf is required: the fact that the hinge presents an open structure does not guarantee that the movement components of the hinge itself (arms, adjustment means, etc.) are safeguarded from being invaded by the foaming material, with consequent degradation of their functionality. To eliminate the latter drawback, hinges are known wherein a plastic casing (generally obtained by molding) is added to the supporting structure, realized in the above manner, to the purpose of protection and aesthetic improvement. While partially solving the inconvenience, this solution requires the use of a further processing and a specially made component of a different material.

In general, then, the arms that make up the articulation device have complex three-dimensional shapes that are also made by a metallic material injection molding, with all the problems described above. Where one partially abandons the complexity of the shape of the arms, and realizes the same as packs of stacked metal flat sheets, one is left however with the disadvantage of having to use a large amount of material in an aesthetically poorly appreciable configuration.

Examples of known solutions are described in the following patent documents: JP 2008008015 A, DE 10 2011050414 B3, EP 246964 A1, DE 19721153 A1, JP 2007177427 A and WO 2010/143405 A1.

One object of the present invention is to obviate the above drawbacks, by providing an invisible hidden hinge for doors, which is structurally perfected and wherein at least one of the main components presents a structure that is simply obtained from a material having high mechanical performance and obtaining a considerable saving of the same material.

SUMMARY OF THE INVENTION

One object of the present invention is to obviate the above drawbacks, by providing an invisible hidden hinge for doors, which is structurally perfected and wherein at least the support structure is configured so as to be simply obtained from a material having high mechanical performance and obtaining a considerable saving of the same material.

One object of the present invention is to obviate the above drawbacks, by providing an invisible hidden hinge for doors, which is structurally perfected and wherein at least a movable body and/or a movable insert is configured to be simply obtained from a material having high mechanical performance and obtaining a considerable saving of the same material.

One object of the present invention is to obviate the above drawbacks, by providing an invisible hidden hinge for doors, which is structurally perfected and wherein at least the structure of a movable insert and/or of a movable body is configured in such a way as to make possible to simply realize therein a seat for the insertion of a head of an adjusting actuator, the movable insert and/or the movable body and said seat being obtained from a material having high mechanical performance, at the same time realizing a considerable saving of same material.

One object of the present invention is to obviate the above drawbacks, by providing an invisible hidden hinge for doors, which is structurally perfected and wherein at least a part of the articulation device is configured so as to be simply obtained from a material having high mechanical performance and obtaining a considerable saving of the same material.

One object of the present invention is to obviate the above drawbacks, by providing an invisible hidden hinge for doors, which is structurally perfected and wherein all major components of the hinge are configured so as to be simply obtained from a material having high mechanical performance and obtaining a considerable saving of the same material.

These aims and others besides, which will better emerge in the description that follows, are achieved, in accordance with the present invention, by a hidden hinge for doors, which is structurally perfected and has structural and functional characteristics in accordance with the attached independent claims, further embodiments being identified in the appended and corresponding dependent claims.

BRIEF DESCRIPTION OF THE DRAWINGS

The invention is described more in detail hereinafter with the aid of the drawings, which represent an embodiment provided purely by way of non-limiting example.

In FIG. 3, an exploded view of a first connecting body variation of a hinge according to the invention is also indicated by "(a)", said variation being the one which differentiates the variation of the hinge of FIG. 2 from hinge variation of FIGS. 1(*a*) and 1(*b*).

Figures from 23 to 28 describe assembling steps of the hinge according to the invention in the variation of FIG. 1(*a*), in particular: in FIGS. 27(*a*) and (*b*) the assembling of the eccentrics devoted to the adjustment of the position of the first movable body of the second connecting body with respect to the relevant support structure; always in FIGS. 27(*a*) and (*b*) the assembling of the fixing screw to fix first movable body of the first connecting body in the relevant support structure.

in FIG. 29(*a*) two assembling steps are shown of the assembly, on the support structure of the first connecting body, of one variation of the actuator of the adjustment of the position of the first movable body with respect to the relevant support structure.

DETAILED DESCRIPTION OF THE PREFERRED EMBODIMENTS

Figure 1:
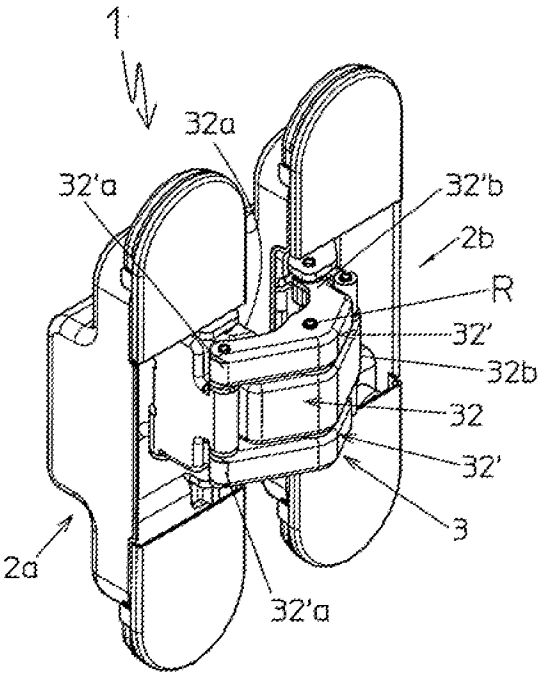
FIG. 1 shows: in (a) a perspective view of a hinge according to the invention in a first variation, and in (b) the same with the cover plates applied on the end portions for aesthetic purposes. The hinge is shown in a condition of complete opening.

In the attached figures, the reference number 1 generally indicates a hinge according to the invention. The hinge 1 generally comprises: a first connecting body 2*a* intended to be inserted inside a respective housing cavity formed in the jamb or in the leaf of the door; a second connecting body 2*b* intended to be inserted inside a respective housing cavity made in the door or into the door jamb; an articulation device 3 that connects the first 2*a* and the second 2*b* connecting body to each other, allowing the relative movement between a closed condition, corresponding to closure of the door, and a condition of complete opening, corresponding to the complete opening of the door. The first connecting body 2*a* develops: in depth along a first direction X1 in the space, coinciding with the direction of insertion in the respective housing cavity in the door jamb or in the door leaf; in width along a second direction Y1 in space perpendicular to the first direction X1; in length along a third direction Z1 in the space perpendicular to both the first X1 and the second direction Y1. The second connecting body 2*b* develops: in depth along a fourth direction X2 in space coincident with the direction of insertion in the respective housing cavity in the door jamb or leaf; in width along a fifth Y2 direction in space perpendicular to the fourth direction X2; in length along a sixth Z2 direction in space perpendicular to both the fourth X2 and the fifth Y2 direction. The first direction X1 is then the direction of the depth X1 of the first connecting body 2*a*, while the fourth direction X2 is the direction of the depth in the second connecting body 2*b*; the second direction Y1 is the direction of the width of the first connecting body 2*a*, while the fifth Y2 direction is the direction of the width of the second connecting body 2*b*; the third direction Z1 is the length direction of the first connecting body 2*a*, while the sixth direction Z2 is the length direction of the second connecting body 2*b*. The two cartesian terns (X1, Y1, Z1) and (X2, Y2, Z2) so defined are shown for illustrative purposes in FIGS. 1(*a*), 3, 4(*c*), 4(*d*), 5(*c*), 5(*d*), 6(*c*), 6(*d*), 7(*d*), 7(*e*), 8(*d*), 8(*e*), 9(*d*), 9(*e*), 10(*d*), 10(*e*), 12, 13(*b*), 14(*b*), 14(*c*).

In the condition of closing, the first 2*a* and the second 2*b* connecting body define, in mutual combination, a seat in which the articulation device 3 is enclosed. The first 2*a* and the second 2*b* connecting body have two sides 21*a*, 22*a*; 21*b*, 22*b* opposed to each other with respect to a plane defined by the direction of the depth X1, X2 and by the direction of the length Z1, Z2. Between said two sides 21*a*, 22*a*; 21*b*, 22*b*, the inner one 21*a*, 21*b* is the side that, in the movement of opening-closing of the hinge 1, travels a shorter path, the outer one being the other 22*a*, 22*b*.

The first 2*a* or the second 2*b* connecting body comprises a supporting structure 4*a*, 4*b*. Preferably, as illustrated in the figures, both the first 2*a* and the second 2*b* connecting body comprise a respective supporting structure 4*a*, 4*b*.

The support structure 4*a*, 4*b*, in turn, comprises a central part 40*a*, 40*b* and two end parts 41*a*, 41*b*, placed on opposite sides of the central part 40*a*, 40*b* along the direction of length Z1, Z2 of the respective second connecting body 2*a*, 2*b*. The central part 40*a*, 40*b* is intended to house part of the articulation device 3. This can be done directly or, as will also be seen in the following (and as, in particular and preferably, illustrated in the attached figures), by means of the intermediate bodies. The two end parts 41*a*, 41*b* are intended to interact with and/or to house fixing means for fixing the connecting body 2*a*, 2*b* to the jamb or leaf.

Figure 4:
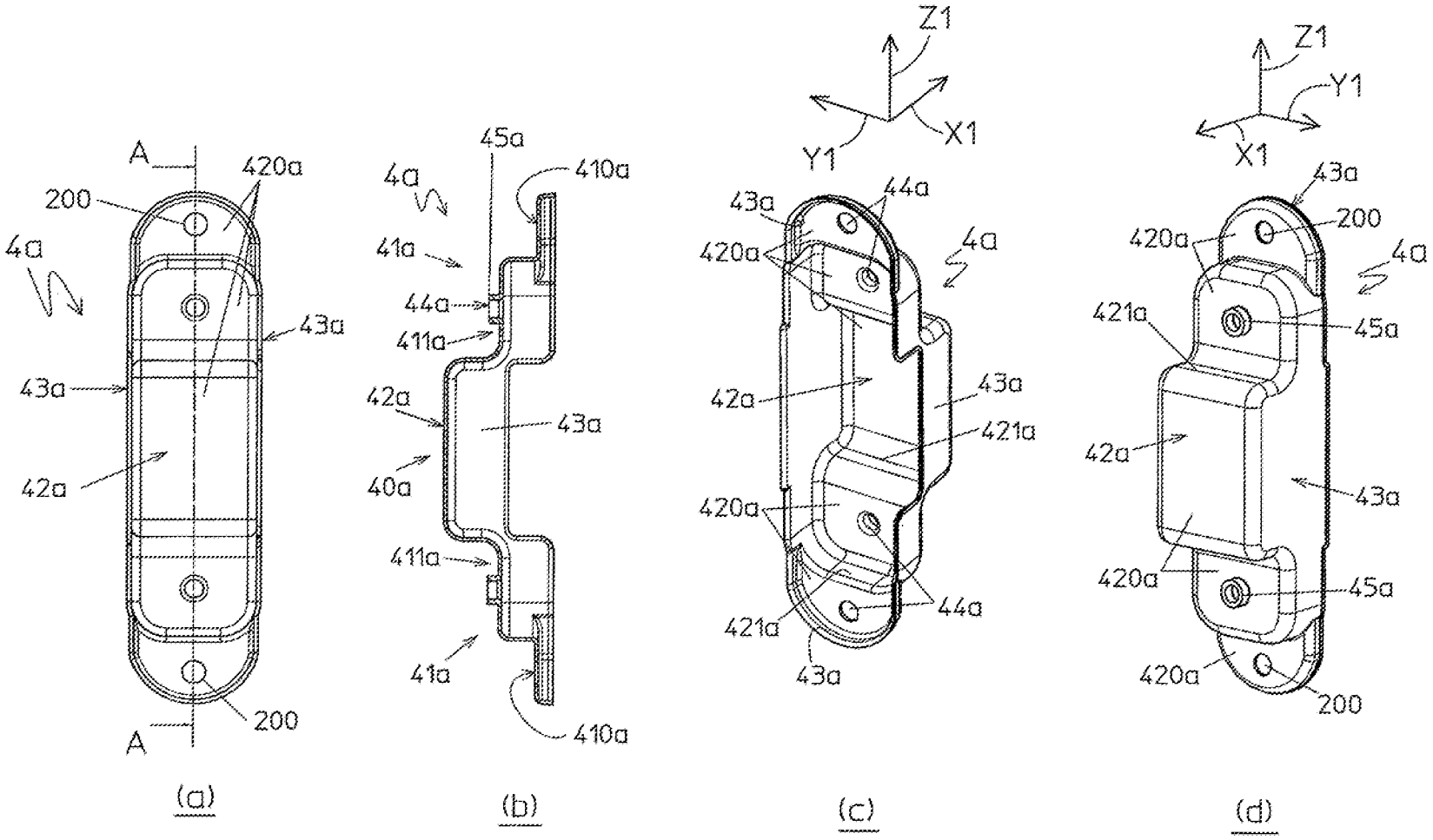
FIG. 4 shows a first variation of a support structure for the first connecting body of the hinge according to the invention, in particular for the hinge of FIG. 1(*a*): in forefront view (detail (a)), in longitudinal section in the plane A-A of FIG. 4(*a*) (detail (b)), in front perspective view (detail (c)), in a rear perspective view (detail (d)).
Figure 5:
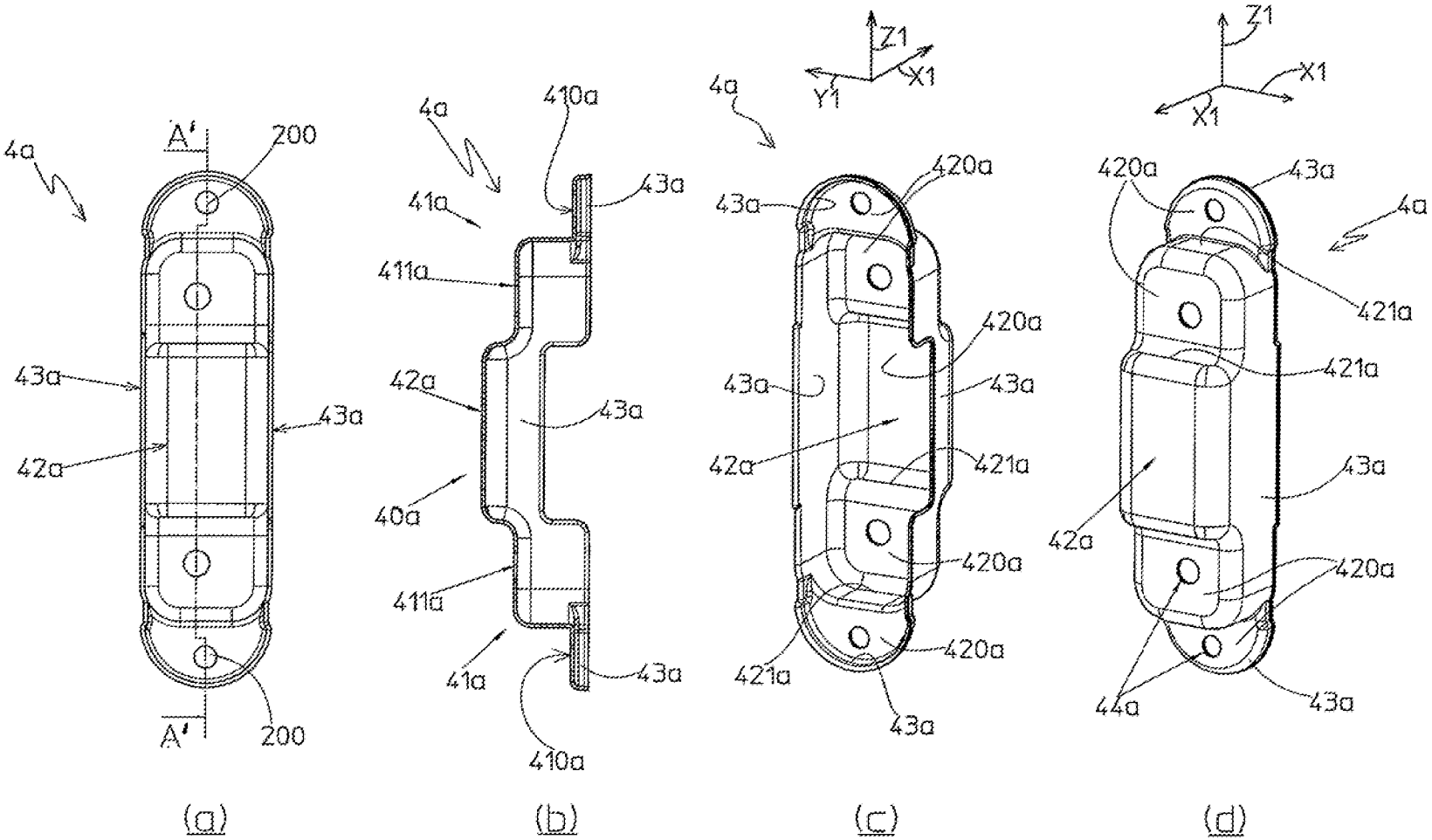
FIG. 5 shows a second variation of a support structure for the first connecting body of the hinge according to the invention, in particular for the hinge of FIG. 2: in forefront view (detail (a)), in longitudinal section in the plane A-A' of FIG. 5(*a*) (detail (b)), in front perspective view (detail (c)), in a rear perspective view (detail (d)).
Figure 6:
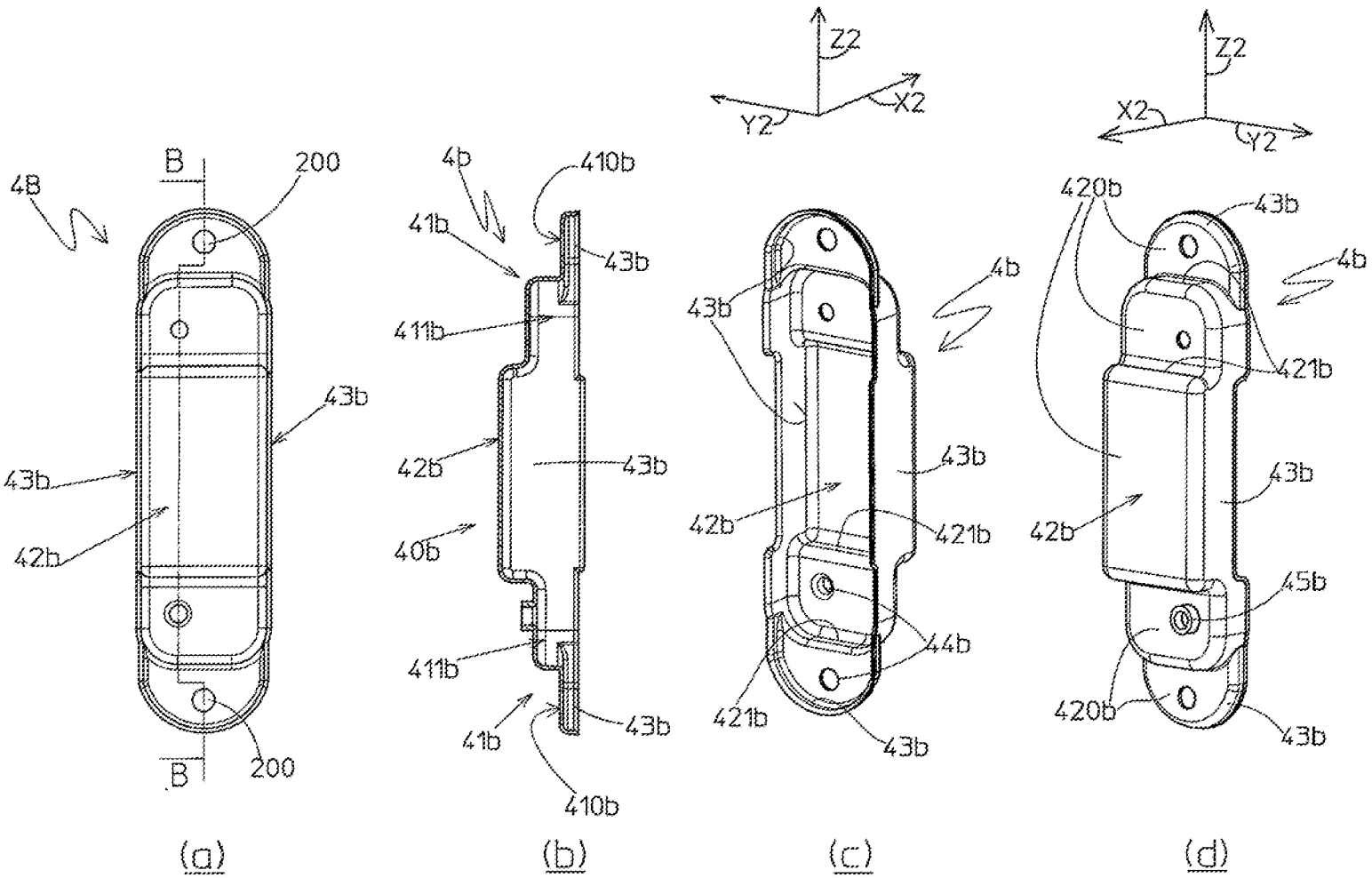
FIG. 6 illustrates a support structure for the second connecting body of the hinge according to the invention, in particular: in forefront view (detail (a)), in longitudinal section in the plane B-B of FIG. 6(*a*) (detail (b)), in front perspective view (detail (c)), in a rear perspective view (detail (d)).

According to a first inventive solution, in particular illustrated in FIGS. 4 to 6, the support structure 4*a*, 4*b* is shaped from a single metal sheet in a single concave piece having concavity facing in a direction opposite to the direction of the depth X1, X2 of the connecting body 2*a*, 2*b* and defined by a bottom 42*a*, 42*b* of the support structure 4*a*, 4*b* and by side walls 43*a*, 43*b* of the support structure 4*a*, 4*b* that realize a peripheral continuous edge of the bottom 42*a*, 42*b*, united to the bottom 42*a*, 42*b* without interruption of the material of which said single metallic sheet is made and completely surrounding the bottom 42*a*, 42*b* in accordance with a curve closed around the direction of the depth X1, X2 of the connecting body 2*a*, 2*b*. Being substantially box-shaped, consisting of a single shaped metal sheet that realizes simultaneously both the bottom 42*a*, 42*b* and the relevant side walls 43*a*, 43*b* (that enclose the bottom 42*a*, 42*b* on all sides both in the central part 40*a*, 40*b* and in the end parts 41*a*, 41*b* seamlessly), the support structure 4*a*, 4*b* has a shape that is able to withstand mechanical stresses in a highly efficient manner and can therefore be realized with a sheet material, for example steel, which has a thickness that, with equal mechanical properties, is considerably less than that of the known hinges, thus obtaining a considerable saving of material and costs. Furthermore, the substantial box shape of support structure 4*a*, 4*b* protects the hinge in case of need for foaming of the housing cavity with polyurethane foam or similar material. The so configured support structure 4*a*, 4*b* can be made by the drawing/deep drawing technique according to industry practices. The side walls 43*a*, 43*b* can have a height from the bottom 42*a*, 42*b* that is not uniform and/or varied as a function of the requirements (in particular to allow the housing and/or the passage of other parts of the hinge 1, for example of portions the articulation device 3). The continuity between the side walls 43*a*, 43*b* and the bottom 42*a*, 42*b* of the support structure 4*a*, 4*b* does not imply the complete absence of apertures. Without substantially adversely affecting the mechanical seal of the support structure 4*a*, 4*b*, openings can locally be provided at the junction between the bottom 42*a*, 42*b* and the peripheral edge of the same, or in other parts of the support structure 4*a*, 4*b*. Specifically, in the junction area between its bottom 42*a*, 42*b* and their side walls 43*a*, 43*b* and/or on its bottom 42*a*, 42*b* and/or on its side walls 43*a*, 43*b*, the support structure 4*a*, 4*b* provides for one or more localized through openings 44*a*, 44*b* made for the purpose of lightening the structure and/or for functional service. In particular, in correspondence of at least one of said one or more localized through openings 44*a*, 44*b*, the bottom 42*a*, 42*b* is folded to form a sleeve 45*a*, 45*b* which at least partially surrounds said at least one of said one or more localized through openings 44*a*, 44*b* and extends away from the bottom 42*a*, 42*b* for a predetermined distance towards the inside or towards the outside of the concavity of the support structure 4*a*, 4*b*. As it will be seen also in the following, these through openings 44*a*, 44*b* can be used for the engagement of clamping screws or of position adjustment means. In the case in which the sleeve 45*a*, 45*b* is present, the latter (optionally threaded) can serve as a guide for the screws and/or for the adjustment means. In some cases, the through-opening 42*a*, 42*b* cannot have a direct functional connotation and the sleeve 45*a*, 45*b* created around it can be used as guide element. The through openings can be obtained by drilling the single metallic sheet, from which the support structure is shaped. The relevant sleeves can also be obtained in the course of drawing operations.

As illustrated in the figures, the bottom 42*a*, 42*b* of the support structure 4*a*, 4*b* is shaped and comprises, along the direction of length Z1, Z2 of the connecting body 2*a*, 2*b*, a plurality of floor portions 420*a*, 420*b*, each of which develops primarily in a respective plane parallel to the direction of the length Z1, Z2 and to the width direction Y1, Y2 of the connecting body 2*a*, 2*b*. The bottom 42*a*, 42*b* of the support structure 4*a*, 4*b* also comprises one or more transverse portions 421*a*, 421*b* each of which is mainly developed in a respective plane parallel to the depth direction of the X1, X2 and connects, without solutions of continuity in the material constituting said single metal sheet, two neighboring and different floor portions 420*a*, 420*b* to each other. In correspondence of said transverse portions 421*a*, 421*b*, the perimetric edge created by the side walls 43*a*, 43*b* is joined with said transverse portions 421*a*, 421*b* without interruption in the material forming said single metallic sheet. In particular, preferably, as illustrated in the figures, at least one or more of the one or more transverse portions 421*a*, 421*b* of the bottom 42*a*, 42*b* of the support structure 4*a*, 4*b* extends mainly in a respective plane parallel to both the direction of the depth X1, X2 and the direction of width Y1, Y2.

Figures 11, 12:
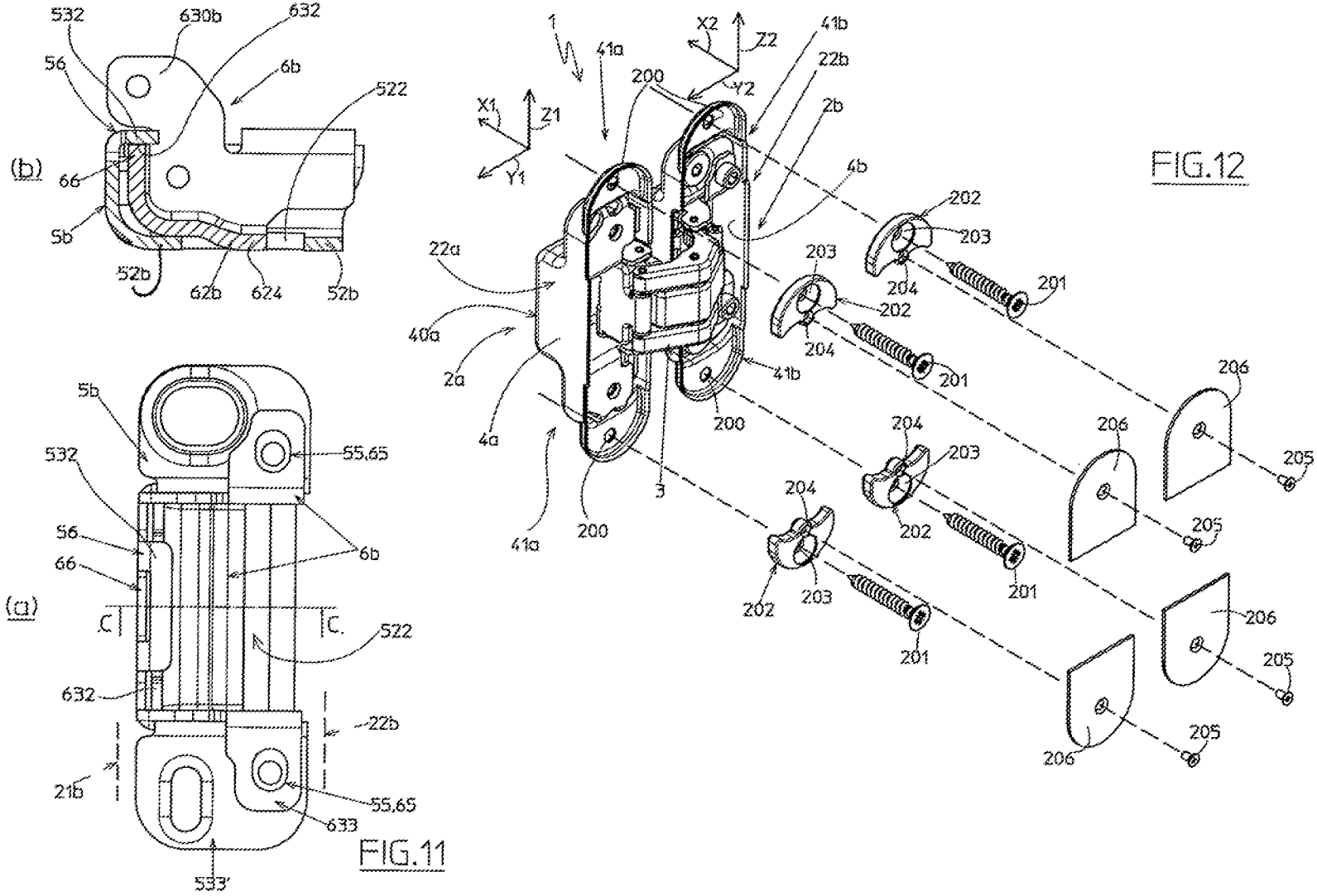
FIG. 11 shows the engagement of the second movable body of FIG. 10 within the first movable body of FIG. 9, respectively in forefront view (detail (a)) and in section view in plane C-C of FIG. 11(*a*) (detail (b)).
FIG. 12 illustrates a partially exploded perspective view of a variation of the system for the application of the cover plates to the outermost parts of the connecting bodies of the hinge according to the invention.

The support structure 4*a*, 4*b*, shaped from a single metal sheet may then comprise areas of different depths for the housing of other components of the hinge 1, or for other purposes. The central part 40*a*, 40*b* of the support structure 4*a*, 4*b* may comprise one or more of the floor portions 420*a*, 420*b* of the bottom 42*a*, 42*b*, each located at one of its own predetermined depth along the direction of the depth X1, X2 of the connecting body 2*a*, 2*b*. The end parts 41*a*, 41*b* of the support structure 4*a*, 4*b* may comprise, in turn, one or more of the portions of the floor 420*a*, 420*b* of the bottom 42*a*, 42*b*, each located at one of its own predetermined depth along the direction of depth X1, X2 of the connecting body 2*a*, 2*b*, preferably smaller than that of the floor portions 420*a*, 420*b* of the central part 40*a*, 40*b*. This type of structure can allow the housing of further parts of the hinge 1 in the central part 40*a*, 40*b* of the support structure 4*a*, 4*b*, in particular the housing of at least part of the articulation device 1, maintaining the overall dimensions of the hinge 1 in the direction of depth X1, X2 of the connecting body 2*a*, 2*b* as limited. Preferably, the end parts 41*a*, 41*b* of the support structure 4*a*, 4*b* each comprise a respective portion 410*a*, 410*b* distal from the central part 40*a*, 40*b* and a respective portion 411*a*, 411*b* proximal to the central part 40*a*, 40*b*. The proximal portion 411*a*, 411*b* includes one or more of the floor portions 420*a*, 420*b* of the bottom 42*a*, 42*b*, each located at one of its own predetermined depth along the direction of the depth X1, X2 of the connecting body 2*a*, 2*b* that is smaller than that of the floor portions 420*a*, 420*b* of the central part 40*a*, 40*b*. The distal portion 410*a*, 410*b*, in turn, comprises one or more of the portions of the floor 420*a*, 420*b* of the bottom 42*a*, 42*b*, each located at one of its own predetermined depth along the direction of the depth X1, X2 of the connecting body 2*a*, 2*b* that it is smaller than that of the floor portions 420*a*, 420*b* of the proximal portion 411*a*, 411*b*. In this way, there is a structure wherein the various portions of the support structure 4*a*, 4*b*, all molded from the same single metal sheet, are concave, the end parts 41*a*, 41*b* thus presenting cavities for the housing of other parts of the hinge 1. Such a structure is always all obtainable, by deep drawing, from the single metallic sheet which is shaped by the support structure 4*a*, 4*b*. In FIGS. 4, 5, 6 a special case of this structure is illustrated, in which, both in the central part 40*a*, 40*b* and in the distal 410*a*, 411*a* and proximal 411*a*, 411*b* portions of the support structure 4*a*, 4*b*, the bottom 42*a*, 42*b* presents a unique, respective floor portion 420*a*, 420*b* and the only respective transverse portions 411*a*, 411*b* needed to delimit and connect said floor portions 420*a*, 420*b* to each other. Preferably, the fastening means for fastening the connecting body 2*a*, 2*b* (in particular to the jamb, or to the door) are housed in the end parts 41*a*, 41*b*, preferably in a portion 410*a*, 410*b* of the end parts 41*a*, 41*b* which is distal from the central part 40*a*, 40*b* (in particular, specifically, in the concave one as described and illustrated above, among other, in the figures from 4 to 6). Advantageously, in one embodiment of the invention illustrated in particular in FIG. 12, the fastening means for fastening the connecting body 2*a*, 2*b* (in particular to the jamb or the door) comprise, for each end portion 41*a*, 41*b*, a spacer insert 202 insertable into a cavity of the end portion 41*a*, 41*b*, (preferably in the distal portion 410*a*, 410*b*). The insert spacer 202 has a through hole 203 (preferably with inlet opening having flared walls) which, when the insert spacer 202 is housed in the end part 41*a*, 41*b*, is placed in correspondence with a through hole 200 made on the bottom 42*a*, 42*b* of the support structure 4*a*, 4*b*. The fixing means for fixing the connecting body 2*a*, 2*b* further comprise a fixing screw 201 inserted simultaneously into the through hole 203 of the insert spacer 202 and into the through hole 200 of the bottom 42*a*, 42*b*, for fixing the connecting body 2*a*, 2*b* to the relative jamb or door. The spacer insert 202 is provided with an auxiliary hole 204 for insertion of a locking screw 205 for a flange 206 for covering the end portion 41*a*, 41*b* of the support structure 4*a*, 4*b*. The spacer insert 202 is shaped as a single concave body by a respective additional single metal sheet and inserted in the end portion 41*a*, 41*b* of the support structure 4*a*, 4*b* with the concavity facing in the direction of depth X1, X2 of the second connecting body 2*a*, 2*b* (FIG. 12).

All of the above described about the support structure 4*a*, 4*b* can be realized only in one of the two connecting bodies 2*a*, 2*b* or in both.

The first 2*a* and/or second 2*b* connecting body further comprises one or more movable inserts accommodated in the support structure 4*a*, 4*b*, which are movable with respect to the latter for adjusting the position of the hinge 1, and are intended to engage, directly or indirectly, part of the articulation device 3. Said movable inserts may be positioned in both the connecting bodies 2*a*, 2*b* (in particular in the relative support structure 4*a*, 4*b*) or only in one of them. Preferably, each of said one or more movable inserts is shaped from a respective single metal sheet, as it will be described in detail below. Said movable inserts may also be accommodated in one or more intermediate bodies inserted, in turn, in the support structure 4*a*, 4*b*. These intermediate bodies can be, for example, movable bodies such as it will be described below. Said movable inserts can themselves coincide with one or more movable bodies, as again described hereinafter.

Figure 14:
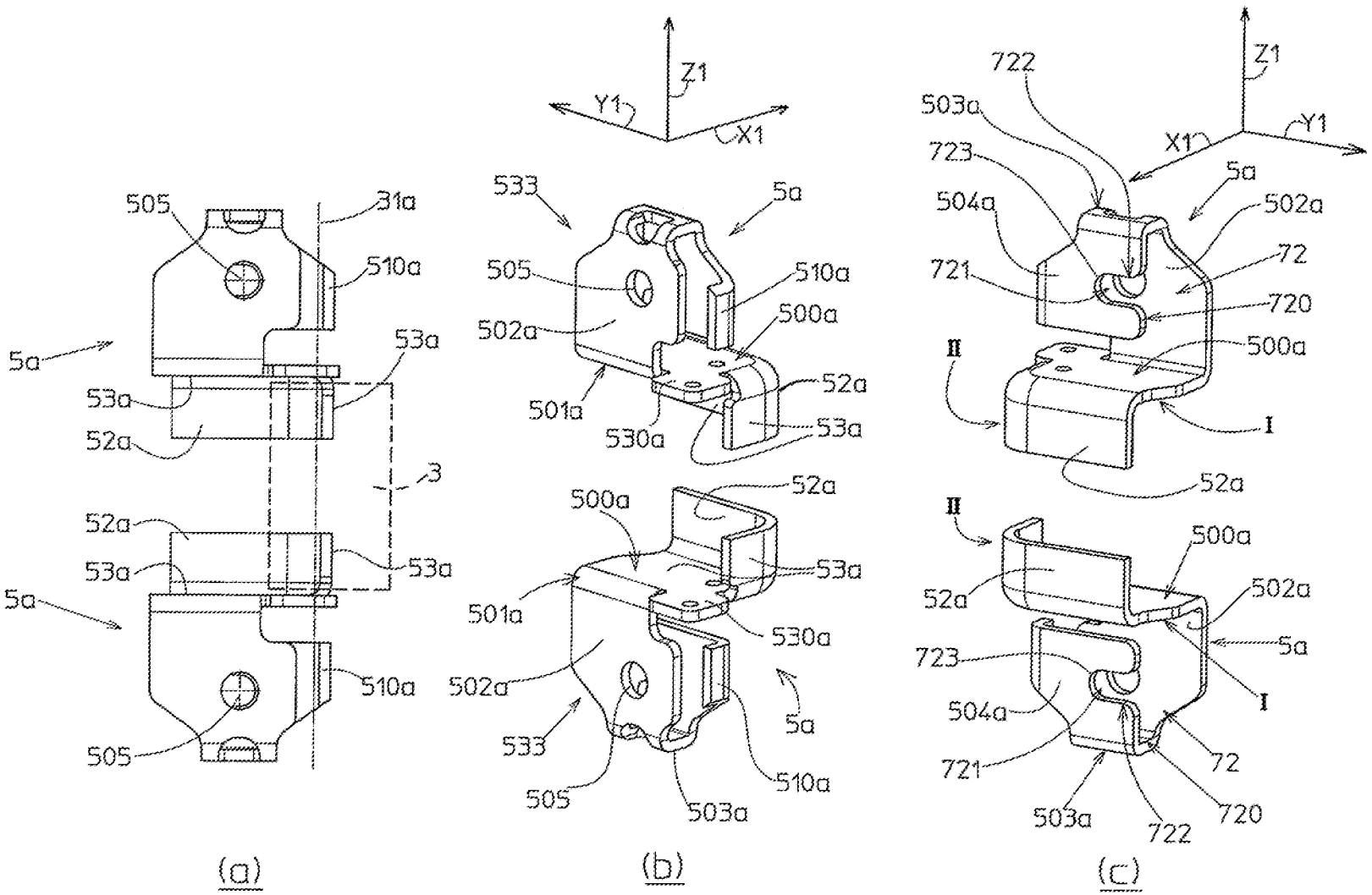
FIG. 14 illustrates a variation of movable inserts for the hinge according to the invention, in particular a pair of said movable inserts: in forefront view (detail (a)), in front perspective view (detail (b)) and in rear perspective view (detail (c)).

The first 2*a* and/or second 2*b* connecting body (preferably both, as will also be described later) includes at least one movable insert 5*a*, 5*b*. Said at least one movable insert 5*a*, 5*b* preferably and advantageously is shaped from a respective single metal sheet in one piece comprising a portion 500*a*, 500*b* transverse to the direction of the length Z1, Z2 of the connecting body 2*a*, 2*b*. Said transverse portion 500*a*, 500*b*, from a right side 501*a*, 501*b* facing in the opposite direction with respect to the direction of the depth X1, X2 of the connecting body 2*a*, 2*b*, extends without interruption in the material forming the single metal sheet from which said at least one movable insert 5*a*, 5*b* is shaped and folds back around an axis parallel to the width direction Y1, Y2 of the connecting body 2*a*, 2*b*, into flat flange portions 533, 533'. Said flat flange portions 533, 533' lie parallel to a plane defined by a direction parallel to the width direction Y1, Y2 of the connecting body 2*a*, 2*b* by a direction parallel to the length direction of Z1, Z2 of the connecting body 2*a*, 2*b*. In said flat flange portions 533, 533', an adjustment member 7, 8 is operatively engaged for the adjustment of the position of said at least one movable insert 5*a*, 5*b* with respect to the support structure 4*a*, 4*b*. In its simplest form, the movable insert 5*a*, 5*b* may be realized by simple blanking and bending of a metal sheet in a simple "L" structure, one of the relevant mechanical appendages realizing a portion of the flat flange 533, 533'; or it can be realized by simple bending and punching of a metal sheet in a simple "U"-shaped structure with opposite appendages which realize each a corresponding portion of the flat flange. In this simple capacity, however, a high thickness of the metal sheet is required to ensure an adequate mechanical strength. According to the invention, preferably, said at least one movable insert 5*a*, 5*b* is shaped from a respective single metal sheet in a single piece having concave concavity defined by a bottom 52*a*, 52*b* of the at least one movable insert 5*a*, 5*b* and by side walls 53*a*, 53*b* of the at least one movable insert 5*a*, 5*b*, that are raised from the bottom 52*a*, 52*b* in the opposite direction to that of the depth X1, X2 of the connecting body 2*a*, 2*b* and develop mainly parallel to said direction of depth X1, X2 realizing a peripheral edge of the bottom 52*a*, 52*b* that is continuous and joined to the bottom 52*a*, 52*b* without interruption of the material of which said respective single metal sheet is made and surrounding the bottom 52*a*, 52*b* on at least two consecutive sides according to a curve that develops around the direction of depth X1, X2 of the connecting body 2*a*, 2*b*. Of said at least two consecutive sides, the first (indicated by I in FIG. 14(*c*)) is parallel to the width direction Y1, Y2 of the connecting body 2*a*, 2*b*, the second (indicated by II in FIG. 14(*c*)) is parallel to the direction of the length Z1, Z2 of the second connecting body 2*b*. The first I and second II consecutive sides according to above are to be understood in a purely geometrical way, simply to indicate from which side around the direction of depth X1, X2 the corresponding portion of the curve defined by the perimeter edge develops. Obviously, said curve can be a more or less complete arc of a circle or any other appropriate geometric curve (elliptical arc, parabolic or generally curved, a portion of straight line, broken line, etc. . . . , or any suitable combination thereof). In the examples illustrated by way of example, but not by way of limitation, in the figures, the side walls forming the perimeter edge are represented as elements substantially flat with curved fittings, more or less pronounced, to the other movable insert portions 5*a*, 5*b*. The side wall 53*a*, 53*b* corresponding to the first side I coincides with said portion 500*a*, 500*b* transverse to the direction of the length Z1, Z2 of the connecting body 2*a*, 2*b*. In this way, the movable insert 5*a*, 5*b* has a box structure that allows its realization by deep drawing of a metal sheet of reduced thickness, with saving of material and costs. As shown in particular in FIG. 14, the movable insert 5*a* may have a substantially "L"-shaped structure and therefore include only a single portion of the flat flange 533. In the event that it presents a concave structure as shown in FIG. 14 and described above, the peripheral edge of its bottom 52*a* surrounds the latter only on two consecutive sides (the first I and the second II), so as to easily allow (where appropriate) the direct engagement of the articulation device 3 (indicated schematically in dashed lines in FIG. 14(*a*)) on the movable insert 5*a*. This condition is illustrated in FIG. 14 with reference to the movable inserts 5*a* of the first connecting body 2*a*, but it is understood that a similar configuration may also be realized for movable inserts 5*b* of the second connecting body 2*b*. Preferably, the hinge 1 comprises a further movable insert 5*a*, 5*b* identical and symmetrical to said at least one movable insert 5*a*, 5*b* with respect to a median plane of the connecting body 2*a*, 2*b* parallel to both the width direction Y1, Y2 and the direction of depth X1, X2 of the connecting body 2*a*, 2*b*. This condition is illustrated in FIG. 14 with reference to the movable inserts 5*a* of the first connecting body 2*a*, but it is understood that a similar configuration may also be realized for movable inserts 5*b* of the second connecting body 2*b*. The hinge 1 preferably also comprises a further adjustment member 7, 8 of said further movable insert position 5*a*, 5*b* with respect to the support structure 4*a*, 4*b*, operatively engaged in said further movable insert 5*a*, 5*b*. Advantageously, said at least one movable insert 5*a*, 5*b* and said further movable insert 5*a*, 5*b* are made integral with each other from the side of the articulation device 3 housed in the connecting body 2*a*, 2*b* (as illustrated in dashed lines in FIG. 14(*a*) for the first connecting body 2*a*, representation that is meant to be extendable, with respect to this feature, also to the second connecting body 2*b*). In particular, preferably, said at least one movable insert 5*a*, 5*b* and said further movable insert 5*a*, 5*b* are made integral with each other by/at at least a fixed axis of rotation 31*a*, 31*b* of the articulation device 3.

Alternatively to the configuration of the two separate symmetrical movable inserts (preferably maintained as integral by the engagement with the articulation device 3), the at least one movable insert 5*a*, 5*b* can be at least a movable body 5*a*, 5*b* as described below (or, depending on the requirements, it is inserted in at least one movable body 5*a*, 5*b*, 6*b* as described below).

Figure 7:
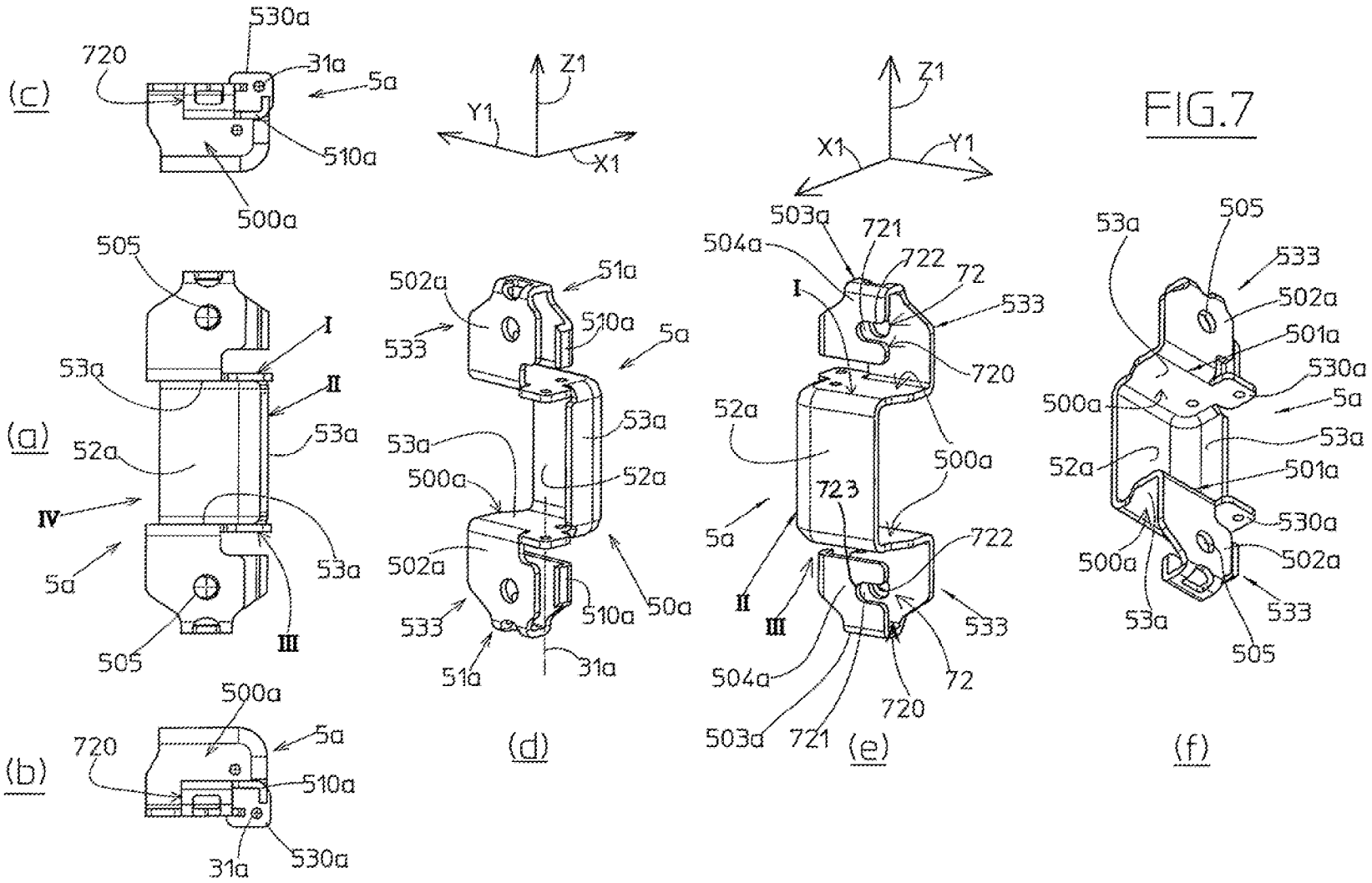
FIG. 7 shows a first variation of a first movable body of the first connecting body of the hinge according to the invention, in particular for the hinge of FIG. 1(*a*): in forefront view (detail (a)), top plan view (detail (b)), bottom plan view (detail (c)), in front perspective view (detail (d)), in rear perspective view (detail (e)) and in rotated front perspective view (detail (f)).
Figure 8:
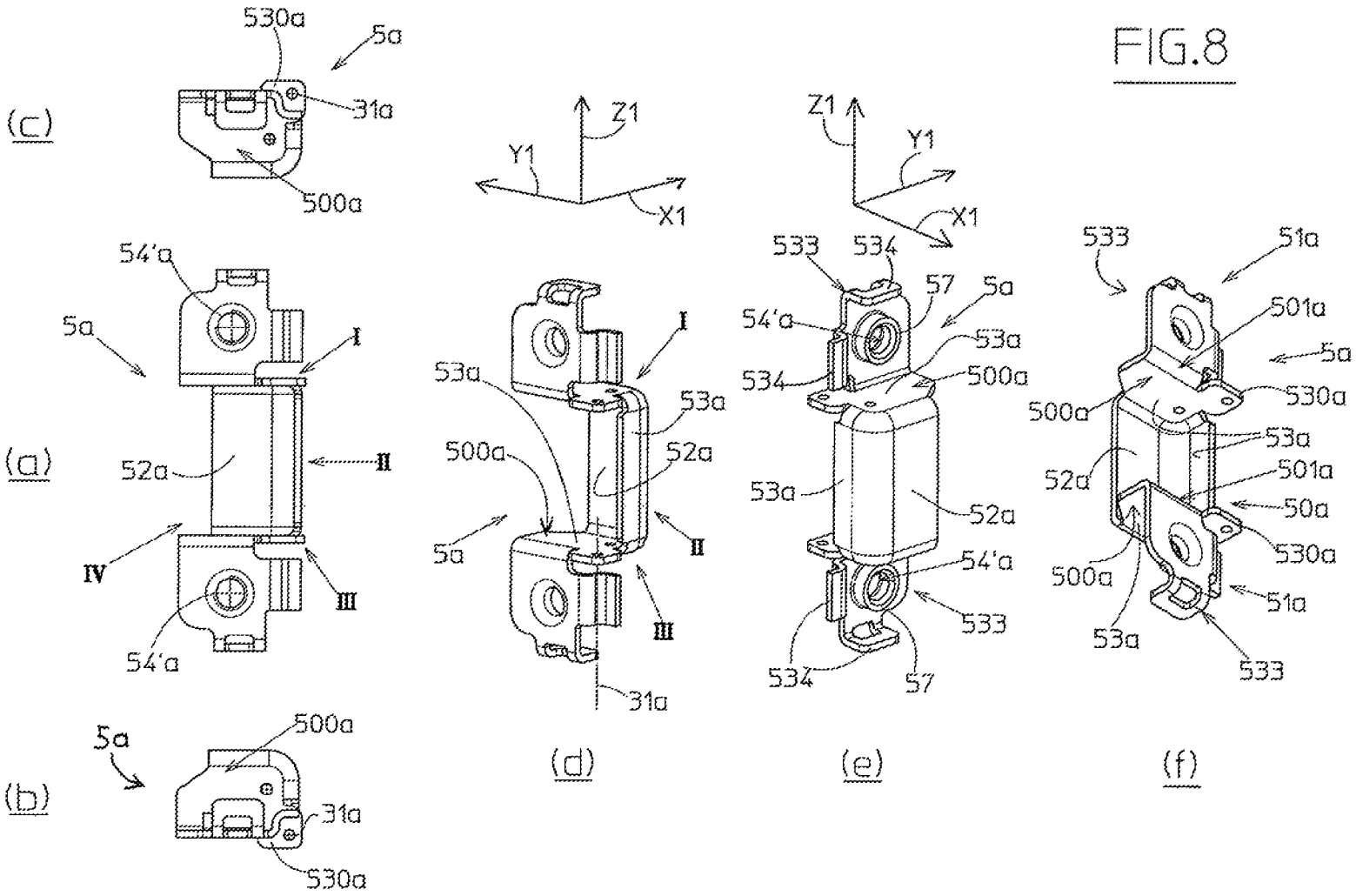
FIG. 8 shows a second variation of a first movable body of the first connecting body of the hinge according to the invention, in particular for the hinge of FIG. 2: in forefront view (detail (a)), in top plan view (detail (b)), in bottom plan view (the detail (c)), in front perspective view (detail (d)), in a rear perspective view (detail (e)) and in rotated perspective front view (detail (f)).
Figure 9:
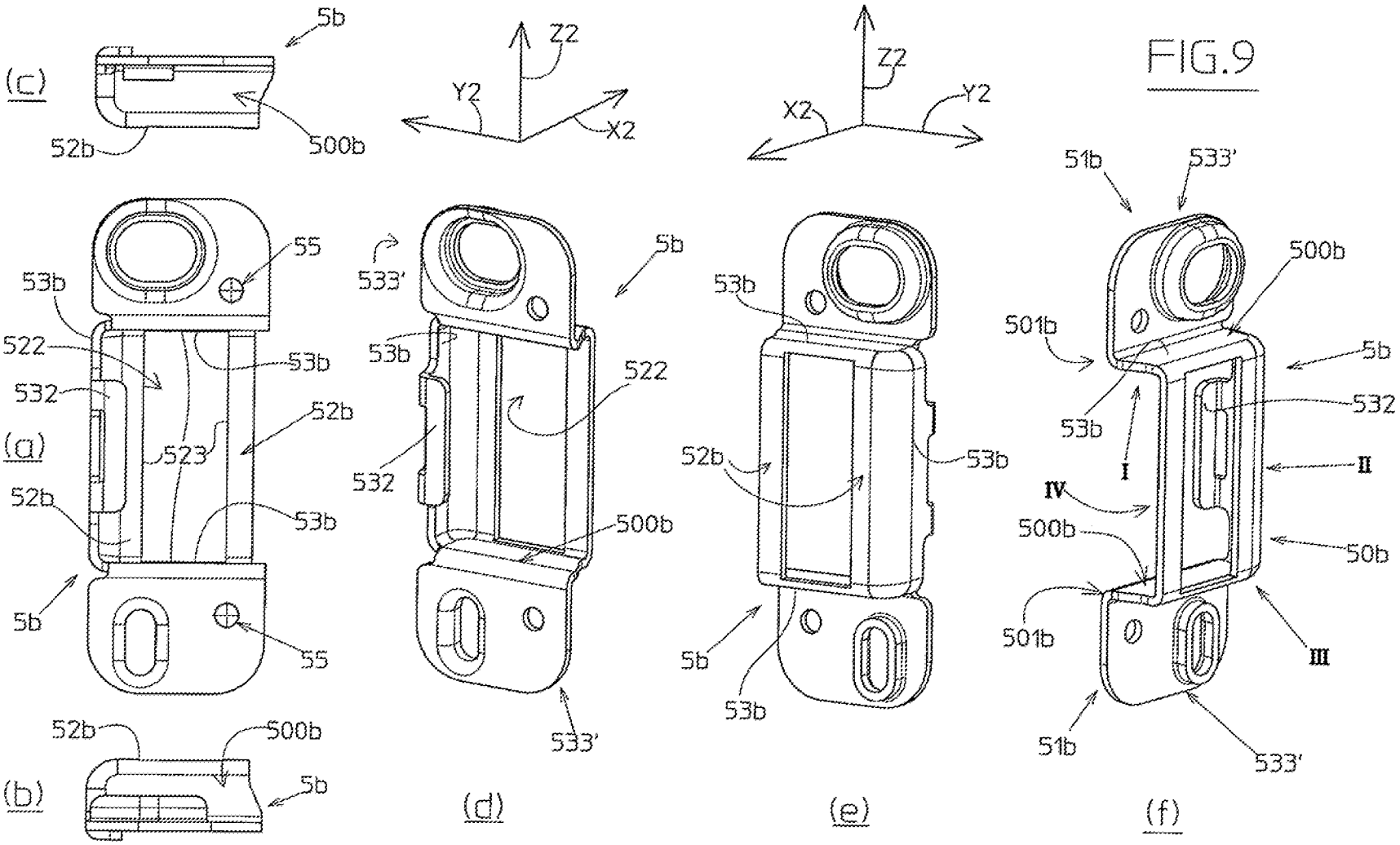
FIG. 9 shows a first movable body of the second connecting body of the hinge according to the invention: in forefront view (detail (a)), in top plan view (detail (b)), in bottom plan view (the detail (c)), in front perspective view (detail (d)), in a rear perspective view (detail (e)) and in a rotated rear perspective view (detail (f)).
Figure 10:
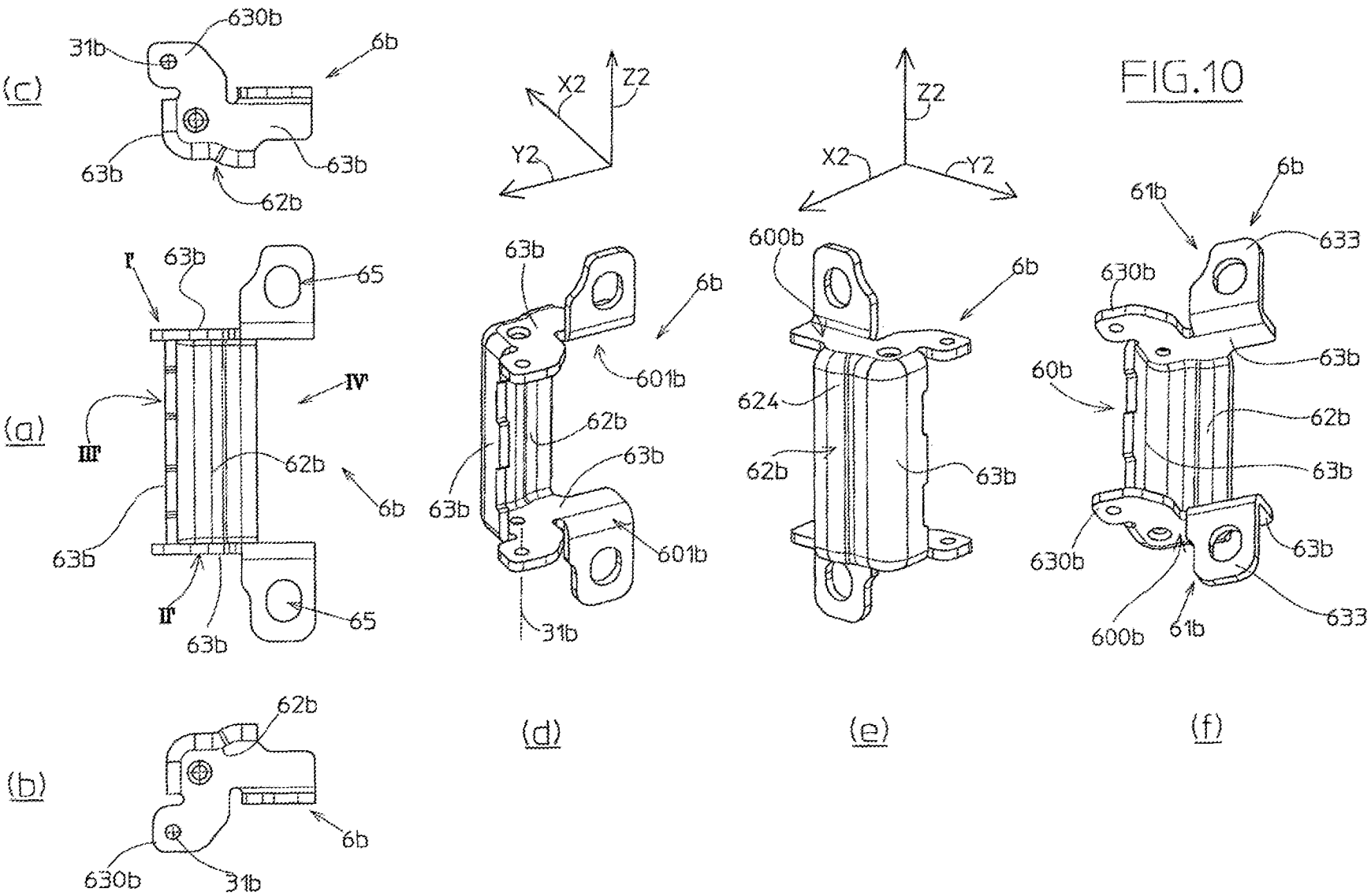
FIG. 10 shows a second movable body of the second connecting body of the hinge according to the invention: in forefront view (detail (a)), in top plan view (detail (b)), in bottom plan view (detail (c)), in front perspective view (detail (d)), in a rear perspective view (detail (e)) and in rotated front perspective view (detail (f)).

Specifically, at least one movable insert 5*a*, 5*b* has at least one movable body 5*a*, 5*b* shaped starting from a respective single metal sheet in a single piece having concave concavity defined by a bottom 52*a*, 52*b* of said at least one movable body 5*a*, 5*b* and by side walls 53*a*, 53*b* of said at least one movable body 5*a*, 5*b* that are raised from the bottom 52*a*, 52*b* in the direction opposite to that of the depth X1, X2 of the connecting body 2*a*, 2*b* and predominantly extend parallel to said direction of depth X1, X2, realizing a peripheral edge of the bottom 52*a*, 52*b* that is continuous and joined to the bottom 52*a*, 52*b* without interruption of the material of which said respective single metal sheet is made and surrounding the bottom 52*a*, 52*b* on at least three consecutive sides according to a curve that develops around the direction of depth X1, X2 of the connecting body 2*a*, 2*b*. With reference, in particular, to FIGS. 7 to 9, of said at least three consecutive sides, the first I and third III are parallel to the width direction Y1, Y2 of the connecting body 2*a*, 2*b*, the second II being parallel to the direction of length Z1, Z2 of the connecting body 2*a*, 2*b*. Also in this case, the consecutive sides of the above mentioned first I, second II and third III are understood in a purely geometrical way, simply to indicate on which side around the direction of depth X1, X2 the corresponding portion of the curve defined by the peripheral edge develops. Obviously, said curve can be a more or less complete arc of a circle or any other appropriate geometric curve (elliptical arc, parabolic or generally curved, a portion of straight line, broken line, etc. . . . , or any suitable combination thereof). In the examples illustrated by way of example, but not by way of limitation, in the figures the side walls forming the perimeter edge are represented as elements substantially flat with more or less pronounced curved fittings to the other portions of said at least one movable body 5*a*, 5*b*. The side wall 53*a*, 53*b* corresponding to the first side I coincides with said portion 500*a*, 500*b* transverse to the direction of the length Z1, Z2 of the connecting body 2*a*, 2*b*. In particular, also in this case, said transverse portion 500*a*, 500*b*, by a own side 501*a*, 501*b* facing in the direction opposite with respect to the depth direction X1, X2 of the connecting body 2*a*, 2*b*, extends without interruption in the material constituting the single metal sheet from which said at least one movable insert 5*a*, 5*b* (which realizes said at least one movable body 5*a*, 5*b*) is shaped and folds back around an axis parallel to the width direction Y1, Y2 of the connecting body 2*a*, 2*b*, into the flat flange portions 533, 533'. Said flat flange portions 533, 533' lie parallel to a plane defined by a direction parallel to the width direction Y1, Y2 of the connecting body 2*a*, 2*b* and from a direction parallel to the length direction of Z1, Z2 of the connecting body 2*a*, 2*b*. To said flat flange portions 533, 533' an adjustment member 7, 8, for the adjustment of the position of said at least one movable insert 5*a*, 5*b* (which realizes said at least one movable body 5*a*, 5*b*) with respect to the support structure 4*a*, 4*b*, is operatively engaged.

As illustrated in the FIGS. 7 to 9, preferably the side wall 53*a*, 53*b* corresponding to the third side III realizes a further portion 500*a*, 500*b* transverse to the direction of the length Z1, Z2 of the connecting body 2*a*, 2*b* identical to that realized by the side wall 53*a*, 53*b* corresponding to the first side I and symmetrical to it with respect to a median plane of the connecting body 2*a*, 2*b* parallel to both the width direction Y1, Y2 and the direction of the depth X1, X2 of the connecting body 2*a*, 2*b*. Specifically, also this further transverse portion 500*a*, 500*b*, on a own right side 501*a*, 501*b* facing in the direction opposite with respect to the direction of the depth X1, X2 of the connecting body 2*a*, 2*b*, is extended, without interruption, in the material forming the single metal sheet from which said at least one movable insert 5*a*, 5*b* (which realizes said at least one movable body 5*a*, 5*b*) is shaped and folds back around an axis parallel to the width direction Y1, Y2 of the connecting body 2*a*, 2*b*, in additional, respective portions of the flat flange 533, 533' which lie parallel to a plane defined by a direction parallel to the width direction Y1, Y2 of the connecting body 2*a*, 2*b* and from a direction parallel to the direction of the length Z1, Z2 of the the connecting body 2*a*, 2*b*. To said further respective flat flange portions 533, 533', a further adjustment member 7, 8, for the adjustment of the position of said at least one movable insert 5*a*, 5*b* with respect to the support structure 4*a*, 4*b*, is operatively engaged.

In one form of the invention (see in particular the figures different from FIG. 14) and both in the presence and absence of one or more of the movable inserts described above (which may or may not be used depending on the needs, and which may coincide or not with the at least one movable body as described above), the first 2*a* and/or second 2*b* connecting body comprises a first movable body 5*a*, 5*b* housed in the support structure 4*a*, 4*b* movable with respect to the latter for an adjustment of position of the hinge 1 and is intended to house part of the articulation device 3, the support structure 4*a*, 4*b* thus realizing a housing structure for housing the first movable body 5*a*, 5*b*. Said first movable body 5*a*, 5*b* (see in particular FIGS. 7, 8, 9) is shaped from a respective single metal sheet in a single piece having concave concavity defined by a bottom 52*a*, 52*b* of the first movable body 5*a*, 5*b* and by side walls 53*a*, 53*b* of the first movable body 5*a*, 5*b* that are raised from the bottom 52*a*, 52*b* in the direction opposite to that of the depth X1, X2 of the connecting body 2*a*, 2*b* and develop mainly parallel to said direction of depth X1, X2 realizing a peripheral edge of the bottom 52*a*, 52*b* that is continuous and joined to the bottom 52*a*, 52*b* without interruption of the material of which said respective single metal sheet is made and surrounding the bottom 52*a*, 52*b* on at least three consecutive sides according to a curve that develops around the direction of depth X1, X2 of the connecting body 2*a*, 2*b*. Of said at least three consecutive sides, the first I and third III are parallel to the width direction Y1, Y2 of the connecting body 2*a*, 2*b*, while the second II is parallel to the direction of the length Z1, Z2 of the connecting body 2*a*, 2*b*.

Also in this case, the first I, second II and third III consecutive sides above are understood in a purely geometrical way, simply to indicate which side around the direction of depth X1, X2 the corresponding portion of the curve defined by the peripheral edge develops. Obviously, said curve can be a more or less complete arc of a circle or any other appropriate geometric curve (elliptical arc, parabolic or generally curved, a portion of straight line, broken line, etc. . . . , or any suitable combination thereof). In the examples illustrated by way of example, but not by way of limitation, in the figures the side walls forming the perimeter edge are represented as elements substantially flat with more or less pronounced curved fittings to the other portions of the first movable body 5*a*, 5*b*.

The first 2*a* and/or second 2*b* connecting body further comprises a second movable body. In the figures, said second movable body is indicated as 6*b* and illustrated only in the second connecting body 2*b*. In general, however, the hinge 1 according to the invention may provide a nested structure with such a second movable body even on the first connecting body 2*a*, depending on the requirements. Therefore, and unless explicitly mentioned, in the following, on the first connecting body 2*a*, the presence of a second movable body 6*b* with similar characteristics will also be deemed possible. The second 6*b* movable body is housed in the first 5*b* movable body, movable with respect to the latter for a further adjustment of the position of the hinge 1 and is intended to house part of the articulation device 3. The first movable body 5*b* thus realizes a housing structure for the second movable body 6*b*. Said second 6*b* movable body is shaped from a respective single metal sheet in a single concave piece having concavity defined by a bottom 62*b* of the second movable body 6*b* and by side walls 63*b* of the second movable body 6*b*, which rise from the bottom 62*b* in the direction opposite to that of the depth X2 of the connecting body 2*b* and develop mainly parallel to said direction of depth X2 by providing a continuous peripheral edge of the bottom 62*b*, joined to the bottom 62*b* without interruption of the material which said respective single metal sheet consists of and surrounding the bottom 62*b* on at least three consecutive sides according to a curve developing around the direction of depth X2 of the connecting body 2*b*. Of said at least three consecutive sides, the first I' and the third III' are parallel to the direction of the width Y2 of the connecting body 2*b*, the second II' is parallel to the direction of the length Z2 of the connecting body 2*b*.

The first 2*a* and/or second 2*b* connecting body may comprise a plurality of second movable bodies 6*b* housed in one another, each movable with respect to each other and with respect to the first movable body 5*b* for a respective further adjustment of the position of the hinge 1. The first movable body 5*b* thus realizes a housing structure for the first of the second movable bodies 6*b* of said plurality and each second movable body 6*b*, in turn, thus realizes a respective housing structure for the second movable body 6*b* housed therein. Although in the figures the presence of only one second movable body 6*b* is illustrated, it is evident that further one or more can be provided, inserted into each other to form a corresponding nested structure. Each of said second movable bodies 6*b* is shaped from a respective single metal sheet in a single concave piece having concavity defined by a respective bottom 62*b* and by respective side walls 63*b* that rise from the bottom 62*b* in the opposite direction to that of X2 depth of the connecting body 2*b* and develop mainly parallel to said direction of depth X2 realizing a continuous peripheral edge of the bottom 62*b*, joined to the bottom 62*b* without interruption of the material which said respective single metal sheet 62*b* consists of and surrounding the bottom of at least three consecutive sides according to a curve that is developed around the X2 depth direction of the connecting body 2*b*. Of said at least three consecutive sides, the first I' and the third III' are parallel to the direction of the width Y2 of the connecting body 2*b*, the second II' being parallel to the direction of the length Z2 of the connecting body 2*b*.

Also in this case, with respect to the second movable body 6*b* (or any of second movable bodies 6*b* of the respective plurality of second movable bodies 6*b*), the first I', second, II' and third III' consecutive sides mentioned above are intended in a purely geometrical way, simply to indicate on which side around the direction of depth X2 the corresponding portion of the curve defined by the perimeter edge develops. Obviously, said curve can be a more or less complete arc of a circle or any other appropriate geometric curve (elliptical arc, parabolic or generally curved, a portion of straight line, broken line, etc. . . . , or any suitable combination thereof). In the examples, illustrated by way of example, but not by way of limitation, in the figures the side walls forming the perimeter edge are represented as elements substantially flat with more or less pronounced curved fittings to the other portions of the second movable body 6*b*.

Being substantially box-shaped, consisting of a single shaped metal sheet that realizes simultaneously both the bottom 52*a*, 52*b*, 62*b* and the relative side walls 53*a*, 53*b*, 63*b* (which enclose seamlessly the bottom 52*a*, 52*b*, 63*b* on at least three consecutive sides, one of which is parallel to the direction of the length Z1, Z2 of the connecting body 2*a*, 2*b*), a movable body 5*a*, 5*b*, 6*b* as described above (also the at least one movable body which can realize one of the above described movable inserts) presents a shape that is able to withstand mechanical stresses in a highly efficient manner and can therefore be realized with a sheet material, for example steel, that has a thickness that, at equal mechanical properties, is considerably smaller than that of the known hinges, thus obtaining a considerable saving of material and costs. A so configured movable body 5*a*, 5*b*, 6*b* can be realized by deep drawing technique (also known as "drawing", or "deep drawing") according to industry practices. The side walls 53*a*, 53*b*, 63*b* can have a height from the bottom 52*a*, 52*b*, 62*b* not uniform and/or varied as a function of the requirements (in particular to allow the housing and/or the passage of other parts of the hinge 1, for example of portions of the articulation device 3). The continuity between the side walls 53*a*, 53*b*, 63*b* and the bottom 52*a*, 52*b*, 63*b* of the movable body 5*a*, 5*b*, 6*b* does not imply the complete absence of apertures. Without substantially adversely affecting the mechanical seal of the movable body 5*a*, 5*b*, 6*b*, openings can be locally provided at the junction between the bottom 52*a*, 52*b*, 62*b* and the peripheral edge of the same, or in other parts of the movable body 5*a*, 5*b*, 6*b*. Specifically, in the junction area between its own bottom 52*a*, 52*b*, 62*b* and its side walls 53*a*, 53*b*, 63*b* and/or on its bottom 52*a*, 52*b*, 62*b* and/or on its own side walls 53*a*, 53*b*, 63*b*, the movable body 5*a*, 5*b*, 6*b* provides for one or more localized through openings realized for the purpose of lightening the structure and/or of functional service.

In at least one of the movable bodies 5*a*, 5*b*, 6*b* chosen among the first movable body 5*a*, 5*b*, the second movable body 6*b* or the movable bodies 6*b* of the plurality of movable bodies (preferably more than one, and even more preferably in all movable bodies 5*a*, 5*b*, 6*b*), the side wall 53*a*, 53*b*, 63*b* corresponding to the first side I, I', and the side wall 53*a*, 53*b*, 63*b* corresponding to the third side III, III' of the perimeter edge of the respective bottom 52*a*, 52*b*, 62*b* extend, seamlessly, into the material constituting the only metal foil from which said at least one of the movable bodies 5*a*, 5*b*, 6*b* is shaped and folding back about an axis parallel to the direction of width Y1, Y2 of the connecting body 2*a*, 2*b* into flat flange portions 533, 533', 633 lying on a plane defined by a direction parallel to the direction of width Y1, Y2 of the connecting body 2*a*, 2*b* and from a direction parallel to the direction of length Z1, Z2 of the connecting body 2*a*, 2*b*. In particular, said side walls 53*a*, 53*b*, 63*b* corresponding to the first I, I' and to the third side III, III' of the peripheral edge of the respective bottom 52*a*, 52*b*, 62*b* each realize a respective portion 500*a*, 500*b*, 600*b* transverse to the direction the length Z1, Z2 of the connecting body 2*a*, 2*b* that extend on a own side 501*a*, 501*b*, 601*b*, facing in the opposite direction with respect to the direction of the depth Z1, Z2 of the connecting body 2*a*, 2*b*, folding back around an axis parallel to the width direction Y1, Y2 of the connecting body 2*a*, 2*b*, in the corresponding flat flange portions 533, 533', 633. In said portions of flat flange 533, 533', 633, corresponding adjustment actuators 7, 8 can be engaged for the adjustment of position of the hinge 1.

The configuration of the hinge 1, if one wants to realize a position adjustment (or more than one of said adjustments), may comprise one or more movable inserts (also in the form of corresponding movable bodies) and/or one or more movable bodies on a the connecting body or on the other or on both according to any combination depending on the needs.

In particular, in addition to what already said, the first 2*a* and/or second 2*b* connecting body can further comprise one or more movable inserts accommodated in the movable body 5*a*, 5*b*, 6*b* which is distal from a bottom of the central part 40*a*, 40*b* of the support structure 4*a*, 4*b* in the direction opposite to the direction of the depth X1, X2 of the connecting body 2*a*, 2*b*. Said one or more movable inserts are movable with respect to said distal movable body 5*a*, 5*b*, 6*b* for a position adjustment of the hinge 1, and are intended to engage, directly or indirectly, part of the articulation device 3. Preferably, also each of said one or more movable inserts is shaped from a respective single metal sheet. Preferably, also one or all of said one or more movable inserts may be made as described above, in particular as movable bodies.

In the following, unless explicitly mentioned, we will describe the characteristics common to any moving body, implying that they can be applied to movable bodies that realize the movable inserts and/or to any of the movable bodies mentioned above.

Preferably, said second side II, II' of at least one of the movable bodies 5*a*, 5*b*, 6*b* of the connecting body 2*a*, 2*b* (preferably two or more of them, even more, preferably all of the movable bodies 5*a*, 5*b*, 6*b* of the connecting body 2*a*, 2*b*) is located at the inner side 21*a*, 21*b* of the connecting body 2*a*, 2*b*. This allows to stiffen the structure where, typically, the stress concentrates by the effect of configuration change of the articulation device 3 in the passage of the hinge from the closed condition to the open condition.

Advantageously, the peripheral edge of at least one of the movable bodies 5*a*, 5*b*, 6*b* of the connecting body 2*a*, 2*b* (preferably two or more of them, even more preferably all) is closed around the bottom 52*a*, 52*b*, 62*b* of the movable body 5*a*, 5*b*, 6*b* itself, surrounding also on its fourth side IV, IV' parallel and opposite to the second side II, II'. The height of the corresponding side wall of said fourth side IV, IV' can also be very limited, depending on the needs. Also this fourth side IV, IV' should be understood in the a purely geometrical way as explained above in relation to the first I, I', second II, II' and third III, III' side.

As already mentioned, in the junction area between its bottom 52*a*, 52*b*, 62*b* and its own side walls 53*a*, 53*b*, 63*b* and/or on its bottom 52*a*, 52*b*, 62*b* and/or on its side walls 53*a*, 53*b*, 63*b*, at least one of the movable bodies 5*a*, 5*b*, 6*b* of the connecting body 2*a*, 2*b* includes one or more localized through openings realized for the purpose of lightening the structure and/or functional service.

Suitably, at least one of the movable bodies 5*a*, 5*b*, 6*b* of the connecting body 2*a*, 2*b* (preferably two or more, even more preferably all) comprises:

a respective central part 50*a*, 50*b*, 60*b* intended to house part of the articulation device 3 and inserted into a central part 40*a*, 40*b*, 50*a*, 50*b* of the respective housing structure 4*a*, 4*b*, 5*a*, 5*b;* two respective end parts 51*a*, 51*b*, 61*b* located on opposite sides of the central part 50*a*, 50*b*, 60*b* along the direction of length Z1, Z2 of the respective connecting body 2*a*, 2*b* and coupled with one, preferably the corresponding, housing structure 4*a*, 4*b*, 5*a*, 5*b* of the two end parts 41*a*, 41*b*, 51*a*, 51*b* of the latter, placed on opposite sides of the central part 40*a*, 40*b*, 50*a*, 50*b* along the direction of length Z1, Z2 of the respective connecting body 2*a*, 2*b.*

The end parts 51*a*, 51*b*, 61*b* of said at least one of the movable bodies 5*a*, 5*b*, 6*b* may coincide with the respective flat flange portions 533, 533', 633 described above. The end parts 51*a*, 51*b*, 61*a*, 61*b* of said at least one of the movable bodies 5*a*, 5*b*, 6*b* are coupled to the housing structure 4*a*, 4*b*, 5*a*, 5*b* on portions of said two end parts 41*a*, 41*b*, 51*a*, 51*b* of the housing structure 4*a*, 4*b*, 5*a*, 5*b* proximal to its central part 40*a*, 40*b*, 50*a*, 50*b*. In particular, preferably, this occurs for the first movable body (5*a*, 5*b*) with respect to the support structure 4*a*, 4*b*. In this case, the coupling can take advantage of the guide and/or the seats offered to the outermost parts 51*a*, 51*b* of the first movable body 5*a*, 5*b* by the areas defined by corresponding floor portions 420*a*, 420*b* and transverse portions 421*a*, 421*b* of the bottom 42*a*, 42*b* of the support structure 4*a*, 4*b* in combination with corresponding portions of the side walls 43*a*, 43*b* of the bottom 42*a*, 42*b* of the support structure 4*a*, 4*b*.

The movable body 5*a*, 6*b* (and/or, correspondingly, the movable insert 5*a*, or the movable inserts 5*a*) most distal in the direction opposite to the direction of the depth X1, X2 of the connecting body 2*a*, 2*b* from a bottom of the central part 40*a*, 40*b* of the support structure 4*a*, 4*b*, supports at least one fixed axis 31*a*, 31*b* of rotation of the articulation device 3 parallel to the direction of the length Z1, Z2 of the connecting body 2*a*, 2*b*. Preferably, said at least one fixed rotation axis 31*a*, 31*b* is placed at the inner side 21*a*, 21*b* of the connecting body 2*a*, 2*b*.

On said most distal movable body 5*a*, 6*b*, at the inner side 21*a*, 21*b* of the connecting body 2*a*, 2*b*, the side walls 53*a*, 63*b* corresponding to the first I, I' and the third III, III' side of the peripheral edge have each a respective appendage 530*a*, 630*b* which protrudes toward the outside of the movable body 5*a*, 6*b* in the direction opposite to the direction of the depth X1, X2 of the connecting body 2*a*, 2*b*. Said respective mechanical appendages 530*a*, 630*b* are aligned with each other along an axis parallel to the direction of the length Z1, Z2 of the connecting body 2*a*, 2*b* and support said at least one fixed rotation axis 31*a*, 31*b* of the articulation device 3. As also seen in FIG. 14, said feature can also be found in the movable inserts 5*a* that are not realized as movable bodies, in particular as an extension of the transverse portion 500*a*.

Advantageously, in addition or alternatively, on said more distal movable body 5*a*, 6*b*, the side wall 53*a*, 63*b* corresponding to the second II, II' side of the perimeter edge has one or more respective shaped mechanical appendages (not shown) which protrude toward the outside of the movable body 5*a*, 6*b* in the direction opposite to the direction of the depth X1, X2 of the connecting body 2*a*, 2*b*, aligned with each other along an axis parallel to the direction of the length Z1, Z2 of the connecting body 2*a*, 2*b* to support and/or maintain on a guide said at least one fixed rotation axis 31*a*, 31*b* of the articulation device 3. Said shaped mechanical appendages may be shaped in the form of cylindrical portion obtained by folding the extension of the side wall 53*a*, 63*b* around an axis parallel to the direction of the length Z1, Z2 of the connecting body 2*a*, 2*b*. In this case, a plurality of coaxial contoured mechanical appendages can be provided, which are distributed over the length of said side wall, or a single shaped mechanical appendage can be provided that extends for the entire length of said side wall along the direction of length Z1, Z2 of the respective connecting body 2*a*, 2*b*. Said more distal movable body 5*a*, 6*b* supports, in particular, the portion of the articulation device 3 which is supported by the connecting body 2*a*, 2*b*.

In the hinge 1, at least one movable body 5*a*, 5*b*, 6*b* is movable on a guide along the direction of the width Y1, Y2 or along the direction of length Z1, Z2 of the respective connecting body 2*a*, 2*b* with respect to the relevant housing structure 4*a*, 4*b*, 5*a*, 5*b* for an adjustment of position of the hinge 1 along said direction. In the attached figures, the situation is illustrated dealing with at least a movable body 5*b*, 6*b* belonging to the second 2*b* connecting body. However, it is noted that an analogous structure could also be realized on the first connecting body, in addition or alternatively depending on the needs. Therefore, unless there is explicit restrictive indication, although in the description that follows the reference numbers that refer to components of the second movable body 2*b* will be used, it is understood that the content can be applied to a similar structure made on the first connecting body 2*a*. Furthermore, as already said, the fact that the figures illustrate, on the first connecting body 2*a*, a nested structure that provides the only support structure 4*a* and a single connecting body 5*a* (or only one movable insert 5*a*, or only one pair of movable inserts 5*a*; see in particular FIG. 14), while on the second connecting body 2*b* a nested structure is illustrated that provides support structure 4*b*, the first movable body structure 5*b* and the second movable body 6*b*, does not exclude that the hinge according to the invention may provide, on the two connecting bodies 2*a*, 2*b*, nested structures in a different way, with a different number of elements and/or with the addition of further intermediate bodies (possibly movable as well).

As it will be made explicit in the following description, even if the technical solution is specified with respect to a particular nested structure of the second 2*b* connecting body 2*b*, it will be obvious that the same solution can be applied in a different succession between the support structure and relative movable body/ies. In particular, it may be formed on a portion of the nested structure of the first movable body 2*a*.

As said, then, in the hinge 1, at least one movable body 5*a*, 5*b*, 6*b* is movable along the guide direction of the width Y1, Y2 or along the direction of length Z1, Z2 of the respective connecting body 2*a*, 2*b* with respect to its structure of housing 4*a*, 4*b*, 5*a*, 5*b* for a position adjustment of the hinge 1 along said direction. In the figures, the embodiment is shown in which the at least one movable body 5*a*, 5*b*, 6*b* with these features is located on the second connecting body 2*b*. However, although not illustrated, it is also clearly possible a situation in which this structure may be realized on the first connecting body 2*a*, or on both. Said at least one movable body 5*a*, 5*b*, 6*b* which has the aforesaid feature could be the first movable body 2*b* of the second connecting body 5*b* and said relevant housing structure 4*a*, 4*b*, 5*a*, 5*b* be the housing structure of the first movable body 5*b* of the second connecting body 2*b*, in particular the support structure 4*b* of the second connecting body 2*b*. Said at least one movable body 5*a*, 5*b*, 6*b* could be the second movable body 6*b* of the second connecting body 2*b*, and said relevant housing structure be the housing structure 5*b* of the second movable body 6*b* of the second connecting body 2*b*, in particular the first movable body 5*b* of the second connecting body 2*b*. Said at least one movable body 5*a*, 5*b*, 6*b* could be a further second movable body 6*b* of the second connecting body 2*b*, and said relevant housing structure be the housing structure of said further second movable body 6*b* of the second connecting body 2*b*, in particular the second movable body 6*b* of the second connecting body 2*b* in which said further second movable body 6*b* of the second connecting body 2*b* is housed. Therefore, even if the following description is made in relation to the figures, with reference to the situation in which said at least one movable body 5*a*, 5*b*, 6*b* is the second movable body 6*b* of the second connecting body 2*b*, and said relevant housing structure 5*b* is the housing structure of the second movable body 6*b* of the second connecting body 2*b*, and in particular the first movable body 5*b* of the second connecting body 2*b*, its contents are identically carried forward to any of the situations described above (in which case the features described below could be correspondingly brought on and/or referred to therein corresponding elements).

With particular reference to FIGS. 11(*a*) and 11(*b*), in correspondence of the bottom 52*b* of said relevant housing structure 5*b*, a seat 522 is formed for the insertion of a shaped portion 624 of the bottom 62*b* of said at least one movable body 6*b* that is housed in said relevant housing structure 5*b*. In said seat 522, a stroke is provided for the position adjustment of said at least one movable body 6*b* in its housing structure 5*b* along the direction of the width Y2 or along the direction of length Z2 of the respective connecting body 2*b* for a position adjustment of the hinge 1 in said direction. Preferably, as illustrated in the figures, said adjustment stroke is along the direction of the width Y2 with respect to the relevant housing structure 5*b*. Advantageously, the shaped portion 624 of the bottom 62*b* of said at least one movable body 6*b* inserted in the seat 522 completes, except for the adjustment stroke, the bottom 52*b* of said relevant housing structure 5*b*. Preferably, the thickness of the one metallic sheet from which of the housing structure 5*b* is shaped, that presents the seat 520 on its bottom 52*b*, is substantially equal to the thickness of the one metallic sheet from which the movable body 6*b* housed in said housing structure 5*b* is shaped. Preferably, said relevant housing structure 5*b* presents, on its bottom 52*b*, a through opening that realizes said seat 522, enclosed on its four sides by a continuous frame 523 (FIG. 9(*a*)) belonging to said own bottom 52*b*. Through the opening of the seat 522, the shaped portion 624 of the bottom 62*b* is inserted, which is the bottom of said at least one movable body 6*b* which is housed in said relevant housing structure 5*b*. Between said shaped portion 642 and said frame 523, the stroke is defined for the position adjustment of said at least one movable body 6*b* in its housing structure 5*b* along the direction of the width Y2 or along the direction of the length Z2 of the respective connecting body 2*b* with respect to the relevant housing structure 5*b* for an adjustment of position of the hinge 1 along said direction. Preferably, as illustrated in the figures, the adjustment stroke is defined along the direction of the width Y2.

Advantageously, the hinge 1 comprises coupling means 55, 65 of said at least one movable body 6*b* with said relevant housing structure 5*b*, placed between the outer side 22*b* of the respective connecting body 2*b* (illustrated schematically in dashed lines in FIG. 11(*a*)) and a center-line plane of the same connecting body 2*b* as defined by a direction parallel to the direction of depth X2 of the connecting body 2*b* and a direction parallel to the direction of length Z2 of the connecting body 2*b*. The hinge 1 further comprises elements 56, 66 of interference against the rotation of said at least one movable body 6*b* around an axis parallel to the direction of the length Z2 of the connecting body 2*b* and passing through said coupling means 55, 65. Said interference elements 56, 66 are preferably placed on the opposite side of the coupling means 55, 65 with respect to said center-line plane of the connecting body 2*b*, even more preferably placed at the inner side 21*b* of the connecting body 2*b* (shown in dashed line schematically in FIG. 11(*a*)). Said coupling means 55, 65 can be realized in the form of holes for accommodating locking screws of the at least a movable body 6*b* on its own housing structure 5*b* and/or for the housing of one or more adjustment actuators 8' for the adjustment of the position of the at least one movable body 6*b* with respect to its own housing structure 5*b*.

In a non-illustrated embodiment, said relevant housing structure of said at least one movable body 6*b* may be straightforwardly the support structure 4*b* of the connecting body 2*b*. In one embodiment of the invention illustrated in the figures, said relevant housing structure of said at least one movable body 6*b* is a further movable body 5*b* between the support structure 4*b* and said at least one movable body 6*b* and movable in its own housing structure 4*b* along the other direction, between the directions of the width Y2 and length Z2 of the connecting body 2*b*, with respect to that along which said at least one movable body 6*b* is movable. Preferably, said at least one movable body 6*b* is movable along the direction of the width Y2, while said further movable body 5*b* is movable along the direction of the length Z2 of the connecting body 2*b*.

As illustrated in the figures, in particular in FIG. 11(*a*), the elements 56, 66 of interference against the rotation of said at least one movable body 6*b* comprise:

- A tab 532 projecting from the side wall 53*b* of the bottom 52*b* of the further movable body 5*b* corresponding to the inner side 21*b* of the connecting body 2*b*, transversely folded at said side wall 5*b* around an axis parallel to the length direction Z2 of the connecting body 2*b* towards the inside of the latter and formed from said side wall 53*b* without interruption in the material forming the single metal sheet from which the further movable body 5*b* is shaped;
- A portion 632, preferably a free edge, of the side wall 63*b* of the bottom 62*b* of said at least one movable body 6*b* corresponding to the inner side 21*b* of the connecting body 2*b* in abutment on and/or in engagement with said tab 532.

Preferably, as already mentioned above in relation to the structure of a generic movable body of the hinge 1, both in said at least one movable body 6*b*, as in the further movable body 5*b*, the side walls 53*b*, 63*b* corresponding to the first I, I' and the third III, III' side of the peripheral edge of the respective bottom 52*b*, 62*b* extend each, without interruption, in the material forming the single metal sheet which is shaped by said at least one movable body 6*b* and without interruption in the material constituting the single metal sheet which is shaped by the further 5*b* movable body, folding back around an axis parallel to the direction of the width Y2 of the connecting body 2*b*, in flat flange portions 533', 633 lying in a plane defined by a direction parallel to the direction of the width Y2 of the connecting body 2*b* and a direction parallel to the direction of the length Z2 of the connecting body 2*b*. As shown in particular in FIG. 11(*a*) (but also seen in FIGS. 1(1), 2, 25(*b*), 26(*a*), 27(*a*), 28(*b*), 29(*b*)), the portions of the flat flange 633 of said at least one movable body 6*b* are resting on the flat flange portions 533' of the further movable body 5*b*. On the flat flange portions 533', 633, corresponding openings and/or through seats are provided for the housing and/or the locking of:

Fixing screws of said at least one movable body 6*b* with respect to said further movable body 5*b* and/or the further movable body 5*b* with respect to the relevant housing structure 4*b*, and/or Parts of actuators 8, 8' of the adjustment of the position of said at least one movable body 6*b* with respect to said further movable body 5*b* and/or the further movable body 5*b* with respect to the relevant housing structure 4*b*.

As mentioned in the introduction, an object of the present invention is to provide a structurally improved invisible hidden hinge for doors in which at least the structure of a movable insert and/or of a movable body is configured in such a way as to make possible to simply realize in it a seat for the insertion of a head of an adjusting actuator, the movable insert and/or the movable body and said seat being obtained from a material with high mechanical performance, at the same time realizing a considerable saving of the same material. In the following, this solution will be described with reference in particular to FIGS. 1*a*, 3 (excluding the detail indicated by "a"), 7, 13, 14, 28 illustrating it as realized on a movable insert and/or a movable body belonging to first connecting body 2*a*, for which the reference numbers relating to the first movable body 2*a* will be used. However, as already mentioned above for other details of the hinge 1 according to the invention, what is described in the following may similarly be realized on the second movable body 2*b* (in particular on corresponding elements and accordingly) and for an adjustment along a different direction with respect to that for which the solution is specifically illustrated in the above figures. The description that follows will refer, unless otherwise explicitly mentioned, to a movable insert 5*a*, 5*b* or a movable body 5*a*, 5*b*, 6*b* in any of the variations described above. In the description that follows, in addition, a structure for engagement is illustrated, in at least one of the flat flange portions 533, 533', 633 of said movable insert 5*a*, 5*b* movable body 5*a*, 5*b*, 6*b*, of a corresponding adjustment actuator 7, 8, 8'. In addition, also in all situations in which the presence of more than one flat flange portions 533, 533', 633 has been previously described, which are symmetrical with respect to a plane parallel to the direction of the depth X1, X2 and the width direction of Y1, Y2 of the of the connecting body 2*a*, 2*b* (either because in two movable inserts 5*a*, 5*b* symmetrical with respect to this plane and preferably made integral with each other by articulation device 3; or because placed on opposite sides, along the direction of length Z1, Z2 of the connecting body 2*a*, 2*b* in a movable body 5*a*, 5*b*, 6*b*), the structure that is described below may be realized.

The hinge 1 comprises at least one adjustment actuator 7. The actuator 7 is engaged in one of the portions of the flat flange 533 of a corresponding movable insert 5*a* or of a corresponding moving body 5*a* (in particular and preferably one for each part of a flat flange having the following described characteristics). The adjustment actuator 7 comprises, along its own direction of development, a head 70 and a stem 71. The actuator 7 provides for a reduction in diameter on the stem 71 with respect to the head 70 along its direction of development. This reduction in diameter is made consecutively to the head 70 at least for a predetermined length along the stem 71. In the figures, the reduction in diameter with respect to the head 70 is characteristic of the whole stem 71, but could also be localized at a predetermined portion of the length of the stem according to the requirements. Furthermore, the stem 71, here shown with a cylindrical shape, may have different shapes depending on the requirements and/or the type of adjustment actuator used (for example: the adjusting screw, the eccentric element or the like). Said adjustment actuator 7 is inserted, with its direction of development parallel to the direction of the depth X1 of the connecting body 2*a*, in a housing groove 72. The housing groove 72 develops perpendicularly to the direction of the depth X1 of the second connecting body. The housing groove 72 has one end 720 open for the insertion of adjustment actuator 7 and a cross section along the direction of the depth X1 of the connecting body 2*a* is locally complementary to said reduction in diameter on the stem 71 with respect to the head 70 so that the actuator 7 is free to rotate about an axis parallel to the direction of the depth X1 of the second connecting body but not to translate along this axis. The axis of rotation of the actuator 7 can be the common axis to the head 70 and stem 71 (as in the figures, in which an actuator 7 is depicted in the form of adjusting screw, as described below); however, the rotation axis may not coincide with an axis of symmetry of the actuator 7 (and the actuator may have no axis of symmetry), as in the case of an eccentric adjustment (solution not illustrated).

The stem 71 is engaged on connecting body portions 2*a* in such a way that rotations in opposite actuator 7 directions around said axis parallel to the direction of the depth X1 of the connecting body 2*a* correspond to opposing movements of the movable body 5*a* with respect to the support structure 4*a* along a direction of adjustment. In particular, and specifically, the stem 71 may be threaded and engaged in a threaded hole (possibly provided with threaded sleeve) formed on the bottom 42*a* of the support structure 4*a* (in particular, as illustrated in the figures, in one of the end parts 41*a*, preferably in a proximal portion 411*a*). The housing groove 72 is formed on the flat portion of the flange 533 as described below. As previously said, at least one movable insert 5*a*, 5*b*, or at least a movable body 5*a*, 5*b* (in particular a first movable body 5*a* of the first connecting body 2*a*, or a corresponding movable body 5*b*, 6*b* on the second connecting body 2*b*) is shaped from a respective single metal sheet in one piece comprising a portion 500*a*, 500*b* transverse to the length direction Z1, Z2 of the connecting body 2*a*, 2*b* that is prolonged by a own side 501*a*, 501*b* facing in the opposite direction with respect to the direction the depth X1, X2 of the connecting body 2*a*, 2*b*, without interruption in the material forming the single metal sheet from said at least one movable insert 5*a*, 5*b* or said at least one movable body 5*a*, 5*b* which is shaped, folding around axes parallel to the width direction Y1, Y2 of the connecting body 2*a*, 2*b* to form a portion of the flat flange 533, 533'. Specifically, preferably, said portion 500*a* transverse to the direction of the length Z1 of the connecting body 2*a*, extends from said own side 501*a* facing in the opposite direction with respect to the direction of the depth X1 of the connecting body 2*a* without interruption in the material forming the single metal sheet which is shaped by said at least one movable insert 5*a* or said at least one movable body 5*a* and folding back consecutively around respective axes parallel to the width direction Y1 of the connecting body 2*a*, in:

A first portion 502*a* parallel to both the width direction Y1 and the length direction Z1 of the connecting body 2*a* and which extends along the length direction Z1 of the second connecting body away from the central part 40*a* of the support structure 4*a;*

A second portion 503*a* consecutive and transverse to the first 502*a*, preferably at least also parallel to the width direction Y1, and even more preferably also parallel to the depth direction of X1, of the connecting body 2*a;*

A third portion 504*a*, consecutive to the first one, parallel to both the width direction Y1 and the length direction Z1 of the connecting body 2*a*.

The third portion 504*a* is facing the first portion 502*a* at a predetermined distance from the latter in the direction of the depth X1 of the connecting body 2*a* and extends along the direction length Z1 of the connecting body 2*a* approaching to the central part 40*a* of the support structure 2*a*. The distance between the first 502*a* and the third 504*a* section corresponds to the height of the head 70 of the actuator 7 in the direction of development of the actuator 7. The groove 72 of the housing is defined by the space between the first 502*a* and the third 504*a* section, in combination with a slot 721 formed in the third portion 504*a*. Said slot 721 develops from the inside of the third portion 504*a* up to an own open end 722 positioned in correspondence of a perimetric side of the third portion 504*a*. The slot 721 can be inserted the stem 71 of the actuator 7. The insertion of the stem 71 of the actuator 7 in the slot 721 is made possible at least in correspondence with said reduction in diameter of the stem 71 relative to the head 70.

The above structure is simply achievable by means of operations of further folding, in that one metal sheet which is shaped by the movable insert 5*a* or movable body 5*a* in question, of that part that realizes a portion of the flat flange 533. Therefore, the movable insert 5*a*, in its simplest form (as obtained by folding a metallic sheet), can be realized by bending (with blanking and/or cutting which allow the realization of the slot 721 and/or open end 720 of the housing groove 72). Preferably, as mentioned, the movable insert 5*a* and/or the movable body 5*a* (in particular the one which may coincide with the movable insert) is made with a box-shaped structure from a single metal sheet and that can be realized by deep drawing. In the latter case, the above structure is simply achievable by means of operations of further folding, in that one metal sheet which is shaped by the movable insert 5*a* or the movable body 5*a* in question, of the part which realizes the portion of a flat flange 533, in particular with blanking and/or cutting which allow the realization of the slot 721 and/or open end 720 of the housing groove 72. As mentioned in the course of the present description, in the case of the movable body 5*a* (in particular the one which may coincide with the movable insert), the box-like structure can have the bottom 52*a* as closed on at least three sides I, II, II by its board perimeter. In this case, preferably, as already mentioned above in general, the side wall 53*a* corresponding to the third side III realizes a further portion 500*a* transverse to the direction of the length Z1 of the connecting body 2*a* identical to that realized by the side wall 53*a* corresponding to the first the side and symmetrical to it with respect to a median plane of the connecting body 2*a* which is parallel to both the width direction Y1 and the direction of the depth X1 of the connecting body 2*a*. The hinge 1 also comprises a second adjustment actuator 7 similar to the first and insertable in the housing groove 72 defined in the further transverse portion 500*a*. To this further transverse portion 500*a*, a description identical to that given above therefore applies for the transverse portion 500*a* placed on the other end of the movable body 5*a* and, for it as well, all the same parts with the same characteristics (and using in the figures, as done, the same reference numerals) can be defined respectively.

Figure 3:
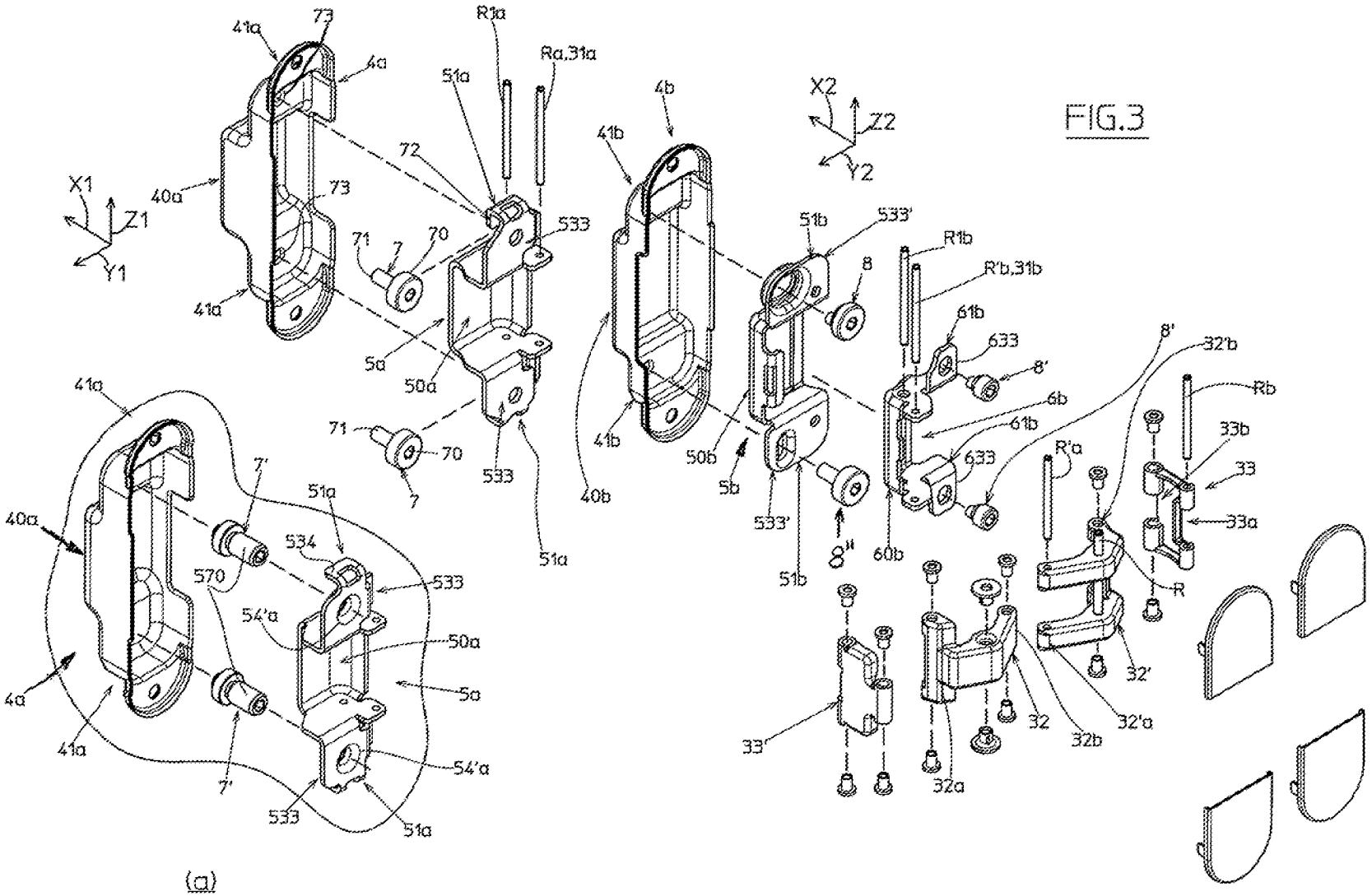
FIG. 3 is an exploded view of the hinge according to FIGS. 1(*a*) and 1(*b*).

In the embodiment illustrated in FIGS. 3 (excluding the detail "a"), 7, 14, 28, the slot 721 has its open end 722 in correspondence with a perimetric side of the third portion 504*a* that is parallel to the direction of the length Z1 of the connecting body 2*a*. Said perimeter side of the third portion 504*a* is preferably that corresponding to the outer side 22*a* of the connecting body 2*a*. The open end 720 of the housing groove 72 is then composed by the space between the first 502*a* and third portion 504*a* of the transverse portion 500*a* in combination with the open end 722 of the slot 721. In the embodiment illustrated in FIG. 13, the slot 721 has its open end 722 in correspondence of the perimeter side of the third portion 504*a* that is parallel to the width direction Y1 of the connecting body 2*a* and that is shared with the second portion 503*a*. On the second portion 503*a* a through opening 723 is made which communicates with the open end 722 of the slot 721 and defines, in combination with said open end 722, the open end 720 of the housing groove 72.

Figure 28:
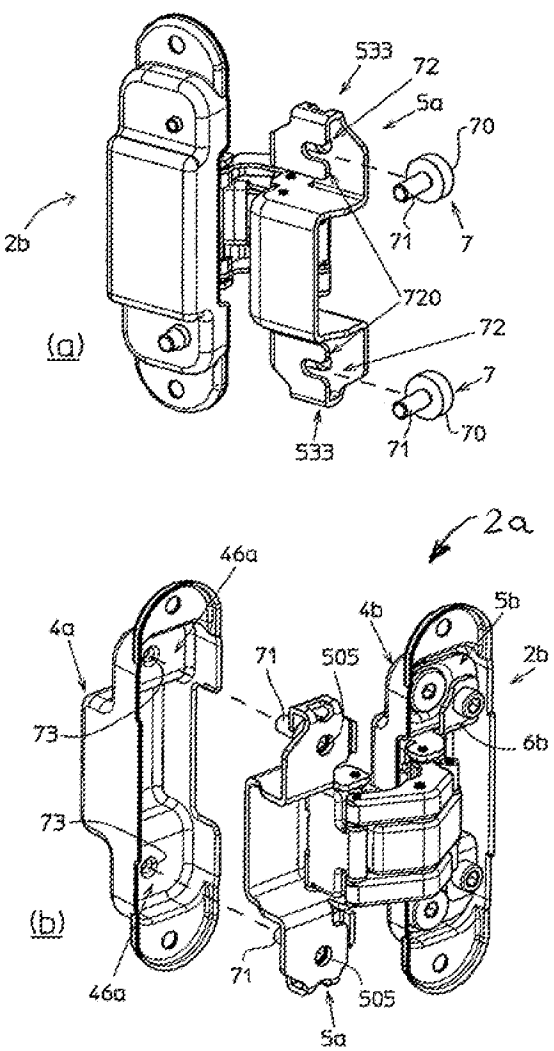

Advantageously, on the first portion 502*a* of the extension of the transverse portion 500*a*, a through opening 505 is formed to allow a user to access with a tool the adjustment actuator head 7 from the front part of the connecting body 2*a*. Said through opening 505 is located at a closed end 723 of the slot 721 opposite to the open end 722. The extension of the transverse portion 500*a* formed by the respective first 502*a*, second 503*a* and third portion 504*a* is inserted in a respective housing and guide cavity 46*a* in the second connecting body. Said housing and guide cavity 46*a* is preferably formed in the support 4*a*, in particular in correspondence with a respective portion 411*a* of the end portion 41*a* of the support structure 4*a* which is proximal to the central part 40*a* (FIG. 28 and FIG. 4).

Figure 13:
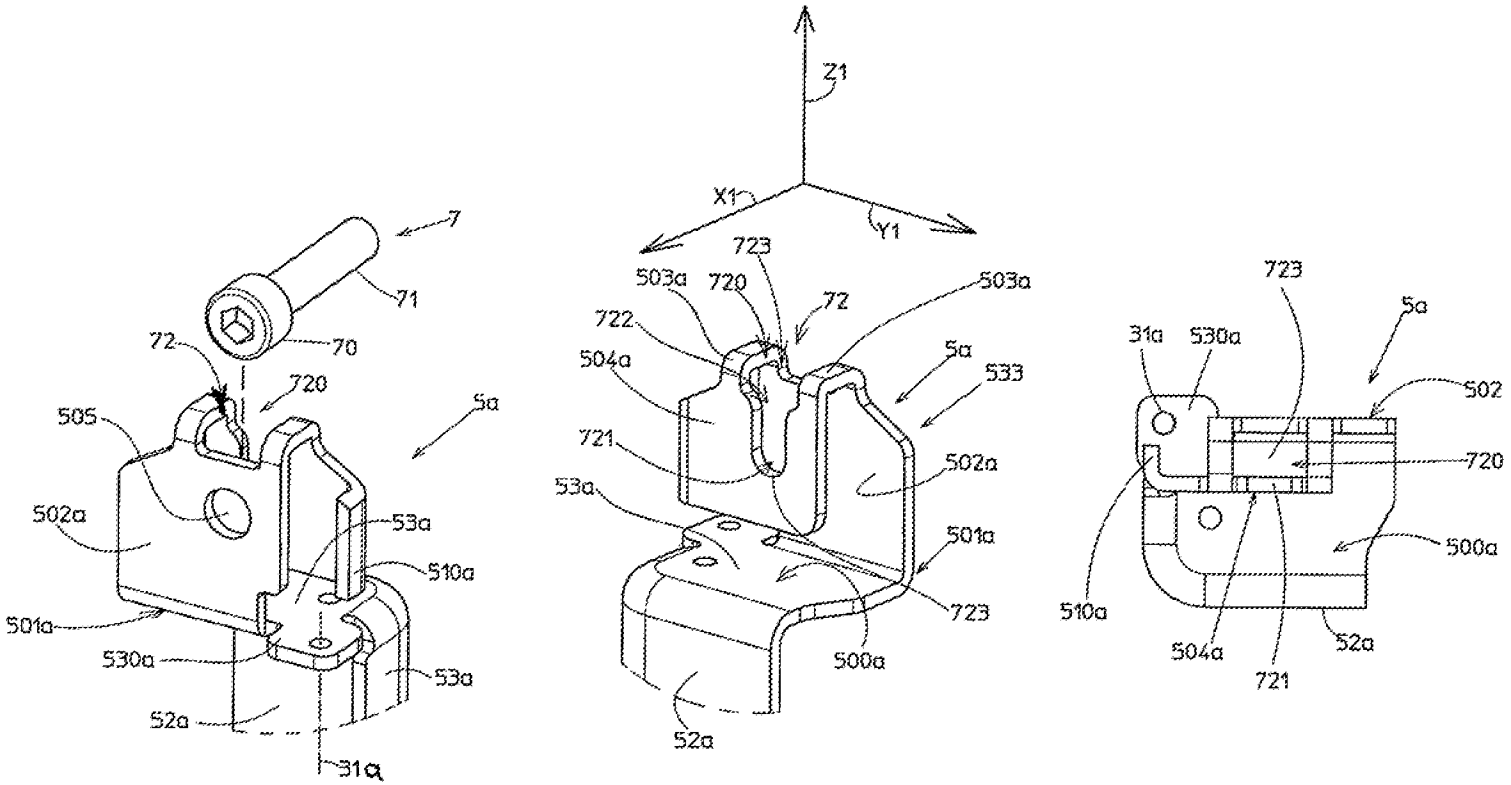
FIG. 13 shows an enlarged detail of the first movable body of FIG. 7: in front perspective view (detail (a)), in a rear perspective view (detail (b)), in top plan view (detail (c)).

In correspondence of one of the sides 21*a*, 22*a* of the connecting body 2*a*, preferably at the inner side 21*a*, the transverse portions 550*a* each have a respective mechanical appendage 530*a* which, without interruption in the material of which the single metal sheet it is made, from which said at least one of the movable inserts 5*a*, 5*a* or at least one of the movable bodies is shaped, protrudes outwards in the opposite direction to that of the depth X1 of the connecting body 2*a* to support at least one fixed axis 31*a* of rotation of the articulation device 3. In this case, preferably, the first section 502*a* of the extension of the transverse portion 500*a* is at the side of said mechanical appendage 530*a*, towards the opposite side 22*a*, 21*a* of the second connecting body, preferably the outer side 22*a*. This structure, shown in particular in FIGS. 7, 13 and 14, is advantageous in that it can be easily obtained by the one metallic sheet from which the movable insert or movable body 5*a* is shaped. In fact, the mechanical appendage 530*a* may be obtained from the portion of the metal sheet from which the first section 502*a* is obtained, by cutting the metal sheet itself in correspondence of the mechanical appendage 530*a* and keeping it steady while the first section 502*a* is folded (at an angle of about 90° relative to the plane in which the mechanical appendage 530*a* is located).

Advantageously, the third portion 504*a* of the extension 500*a* of the transverse portion, without interruption in the material of which the single metal sheet consists, from which said at least one of the movable inserts and/or the movable bodies 5*a* is shaped, extends laterally towards the side 21*a*, 22*a* of the connecting body 2*a* in correspondence of which the mechanical appendage 530*a* is made, therein presenting a folding about an axis parallel to the length direction Z1 of the connecting body 2*a* to form an abutment and guide offshoot 510*a* on walls of the connecting body 2*a*, preferably on the walls of the support structure 4*a*. Suitably, the abutment and guide offshoot 510*a* is sized, shaped and positioned in such a way as not to obstruct a chance to access the fixed axis 31*a* of rotation of the articulation device 3 supported by the appendage 530*a*. The second portion 503*a* is preferably located around a connecting body 2*a* of the center plane defined by a direction parallel to the depth X1 direction and by a direction parallel to the direction of the length Z1 of the connecting body 2*a*.

The structure of the flat flange portions 533 described above can be used for the housing of an eccentric adjustment. In this case, the movable insert or movable body 5*a* adjustment with respect to the corresponding housing structure 4*a* can be performed along the width direction Y1 of the connecting body 2*a*, or along the length direction Z1 of the connecting body 2*a*. In an embodiment shown in the figures, the actuator 7 inserted in the housing groove 72 is rotatable about the longitudinal axis of the stem 71. The stem 71 is threaded and engaged in a corresponding female thread 73 formed on the connecting body 2*a*. Preferably, the female thread 73 is formed on a bottom of the support structure 4*a*, even more preferably on a bottom of the end portion 41*a* which corresponds to the adjustment actuator 7 position. The position of said at least one movable insert or at least one of the movable bodies 5*a* can then be adjusted in opposite directions along the direction of the depth X1 of the connecting body 2*a* by unscrewing and screwing the adjustment actuator 7, thus realizing a corresponding position adjustment of the hinge 1.

In general, in the hinge 1, at least one of the movable bodies 5*a*, 5*b*, 6*b* is movable along on a guide in the direction of the depth X1, X2 of the respective connecting body 2*a*, 2*b* with respect to the corresponding housing structure 4*a*, 4*b*, 5*b* for an adjustment of the position of the hinge 1 along said direction. Preferably, in said at least one of the movable bodies 5*a*, 5*b*, 6*b*, and the side walls 53*a*, 53*b*, 63*b* corresponding to the first I, I' and the third III, III' side of the peripheral edge of the respective bottom 52*a*, 52*b*, 62*b*, each extends, without interruption in the material forming the single metal sheet from which said at least one of the movable bodies 5*a*, 5*b*, 6*b* is shaped and folding back around an axis parallel to the width direction Y1, Y2 of the connecting body 2*a*, 2*b*, into flat flange portions 533, 533', 633 lying on a plane defined by a direction parallel to the width direction Y1, Y2 of the connecting body 2*a*, 2*b* and from a direction parallel to the direction of the length Z1, Z2 of the connecting body 2*a*, 2*b*. At each of said flat flange portions 533, 533, 633 a corresponding adjustment element 7, 7', 8 is engaged for the adjustment of the position of said at least one of the movable bodies 5*a*, 5*b*, 6*b* with respect to the relevant housing structure 4*a*, 4*b*, 5*b*.

Figure 2:
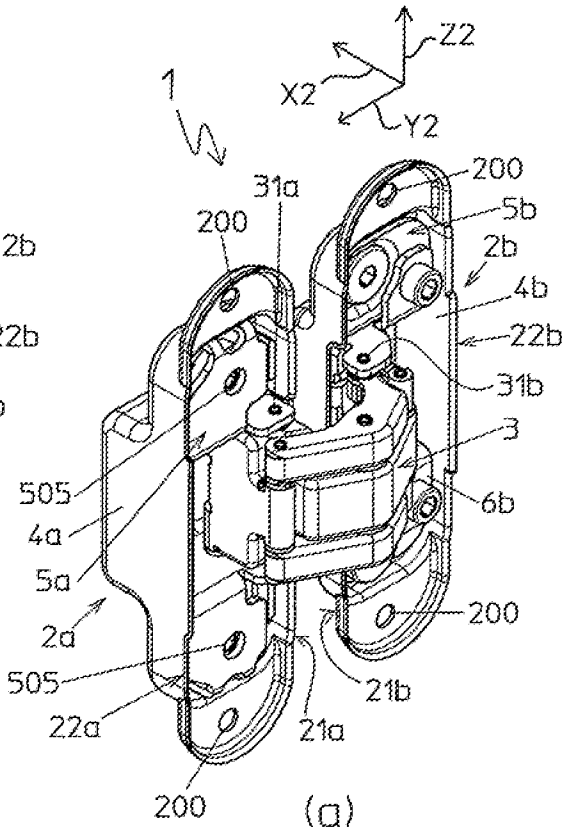
FIG. 2 shows a second variation of the hinge in a view similar to that of FIG. 1(*a*). The hinge is shown in a condition of complete opening.
Figure 2:
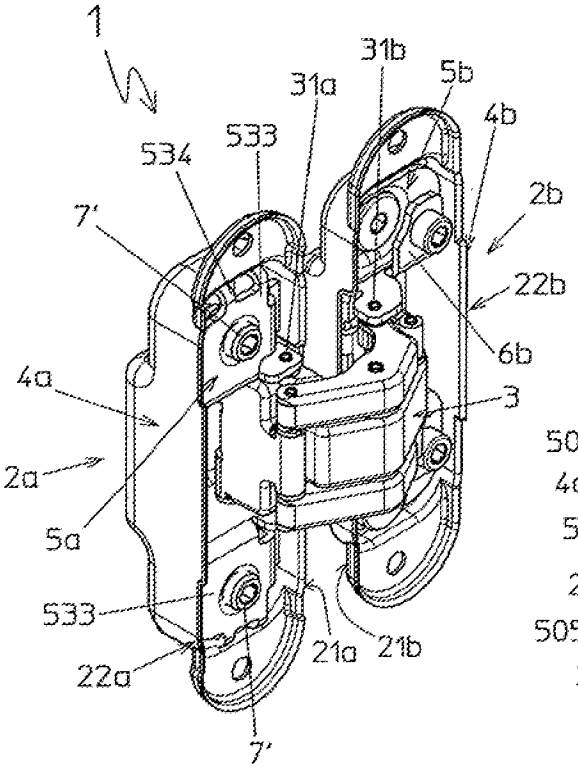

As already described above and as shown in particular in relation to the first connecting body 2*a* (as said, purely by way of example, being able to do the same thing also on the second 2*b*), the movable body 5*a* may provide portions of flat flange 533 shaped in a first 502*a*, second 503*a* and third portion 504*a* as described above to provide a housing groove 72 for an adjustment actuator 7 (in particular for its head 70). An alternative solution to this is illustrated in particular in FIGS. 2, 3(*a*), 8, 29, always with reference to the first housing body 2*a*, but in a purely example-like way, being able to realize the same structure even on the second connecting body 2*b*; furthermore, even if the solution is described with reference to a movable body 5*a* whose housing is directly the support structure 4*a*, nothing impedes to realize the same solution also in a more nested movable body within the respective housing body (said movable body being able to also be an intermediate element in said nested structure and not necessarily the most distal element from the support structure). With this warning, in the alternative solution illustrated in particular in FIGS. 2, 3(*a*), 8, 29, in said at least one of the movable bodies 5*a*, 5*b*, 6*b* (the movable body by way of example indicated by the reference numeral 5*a*), the walls side 53*a* corresponding to the first I and third III side of the peripheral edge of the respective bottom 52*a* extend each, without interruption in the material forming the single metal sheet from which said at least one of the movable bodies 5*a* is shaped and folding back around an axis parallel to the direction of the width Y1 of the connecting body 2*a*, in flat flange portions 533 lying on a plane defined by a direction parallel to the width direction Y1 of the connecting body 2*a* and from a direction parallel to the length direction Z1 of the connecting body 2*a*. In each of said flat flange portions 533, a corresponding through-opening 54'*a* is made for the insertion of an adjustment member 7' of the position of said at least one of the movable bodies 5*a* with respect to the relevant housing structure 4*a*. In one embodiment not illustrated in the figures, but that can be easily derived from, the through opening may be a through hole 54'*a* in which the stem of an adjustment screw is inserted which engages in a corresponding thread, which is made in parts of the movable body 2*a* different from said at least one of the movable bodies 5*a*. Preferably, the thread in which the adjustment screw engages is made in the relevant housing structure 4*a*. To prevent the translational movement of the adjusting screw along its own axis with respect to the flat portion of the flange 533, selective locking means are provided for locking said translation, the locking means not preventing the rotation of the screw about its axis, for example a stop ring (preferably of the type so-called "Seeger"). The through-opening can also be a slot which is open in correspondence of a free side edge of the flat flange portion 533. In this case, in addition to the adjusting screw engaged as described above, it is possible to use an adjusting actuator 7' in the form of a threaded element, which provides, in correspondence to and below its own head, a reduction in diameter for an axial length equal to the thickness of the flat flange portion 533, so as to allow the insertion into the slot, blocking the axial translation, but at the same time allowing its free rotation around the axis. The threaded member can then be engaged in a corresponding thread, made in parts of the movable body 2*a* different from said at least one movable body 5*a*. Preferably, the thread in which the threaded element engages is made in the relevant housing structure 4*a*. In the embodiment specifically illustrated in the figures, in correspondence of the through opening 54'*a*, the portion of the flat flange 533 is bent to form a corresponding threaded sleeve 57 which surrounds said through opening 54'*a* and extends away from the flat flange portion 533 by a predetermined distance toward the inside of the second connecting body along the direction of the depth X1. In each threaded sleeve 57, a corresponding threaded pin 570 is engaged, which is rotatably coupled to the relevant housing structure 4*a* and/or the support structure 4*a* with its longitudinal axis parallel to the direction of the depth and without freedom to translate along said longitudinal axis. The threaded pin 570 realizes the adjustment actuator 7'. Rotations in opposite directions of the threaded pin 570 determine opposite movements of the movable body 5*a* along the direction of the depth X1 of the connecting body 2*a*. Each of said flat flange portions 533 extends, on a own side edge and without interruption in the material of which the single metal sheet consists from which said at least one of the movable bodies 5*a* is shaped, in one or more portions folded around an axis parallel to the direction of the length Z1 and/or to the direction of the width Y1 of the connecting body 2*a* and having at least a portion lying in a plane parallel to the direction of the depth X1 of the connecting body 2*a*, to form one or more corresponding tabs 534 of abutment on walls of the relevant housing structure 4*a* and/or the support structure 4*a*. Said abutment tabs 534 at least assist the guidance of the movement of said at least one of the movable bodies 5*a* along the direction of the depth X1 of the connecting body 2*a*. At least one abutment tab 534 is realized in correspondence of the flat flange portion 533 which is located at the first I and/or third III side. At least one abutment tab 534 is formed at one of the sides 21*a*, 22*a* of the connecting body 2*a*, preferably at the inner side 21*a*. The abutment tab 534 formed on the side 21*a*, 21*b* of the connecting body 2*a*, if corresponding to the side of the connecting body 2*a* in correspondence of which the at least one fixed axis 31*a*, 31*b* of the pivot device 3 is placed, must be shaped suitably in such a way as to allow the insertion of the relative rotation pins.

In a preferred embodiment, illustrated in the figures, the first connecting body 2*a* comprises a respective supporting structure 4*a* and a respective first movable body 5*a* movable with respect to the support structure 4*a*, which is its housing structure, along the depth direction X1 of the first connecting body 2*a*. Said respective first movable body 5*a* is a movable body according to any of the variations previously described and adaptable to a position of adjustment along the direction of the depth X1, X2 of the respective movable body 2*a*, 2*b*. The connecting body 2*a* comprises a respective support structure 4*b*, a respective first movable body 5*b* having the respective support structure 4*b* as its housing structure, and a respective second movable body 6*b* having the respective first movable body 5*b* as its structure housing. Said respective first movable body 5*b* is movable relative to the support structure 4*b* along the direction of the length Z2 of the second connecting body 2*b*. Said respective second movable body 6*b* is movable relative to the respective first movable body 5*b* along the direction of the width Y2 of the second connecting body 2*b*. The nested structure of the second connecting body 2*b* is made according to any of the previously described variations in which at least a movable body (in this case corresponding to the "respective second movable body 6*b*" above) is housed inside a respective housing structure, in particular realized by a further movable body (in this case corresponding to the "respective first movable body 5*b*" above), which is in turn housed inside a respective housing structure (in particular the support structure 4*b*).

In the hinge 1 according to the invention, the articulation device 3 that connects the first 2*a* and the second 2*b* connecting body to each other comprises at least a first arm 32 having a first end 32*a* engaged directly or indirectly on the first connecting body 2*a* and a own second end 32*b*, opposite the first, engaged directly or indirectly on the second connecting body 2*b*. The articulation device 3 comprises at least a second arm 32' having a first end 32'*a* engaged directly or indirectly on the first connecting body 2*a* and a own second end 32'*b*, opposite to the first, directly or indirectly engaged on the second connecting body 2*b*.

The sixth direction Z2 in space, that is the direction of the length Z2 of the second connecting body 2*b* is parallel to the third direction Z1 in space, which is in turn the direction of the length Z1 of the first connecting body 2*a* in space.

Said first arm 32 is shaped starting from a respective single metal sheet in one concave piece with its concavity directed towards a reference plane parallel to the direction of the length Z1, Z2 of the connecting bodies 2*a*, 2*b* and passing through the ends 32*a*, 32*b* of the first arm 32. The reference plane of the first arm 32 is shown in FIGS. 15(*d*), 15(*f*), 16(*d*), 16(*f*) by a dashed line T which represents its track in the plane of the sheet (which, in the FIGS. 15(*d*), 15(*f*), 16(*d*), 16(*f*) is perpendicular to the direction of the length Z1, Z2 of the connecting bodies 2*a*, 2*b*).

Figure 15:
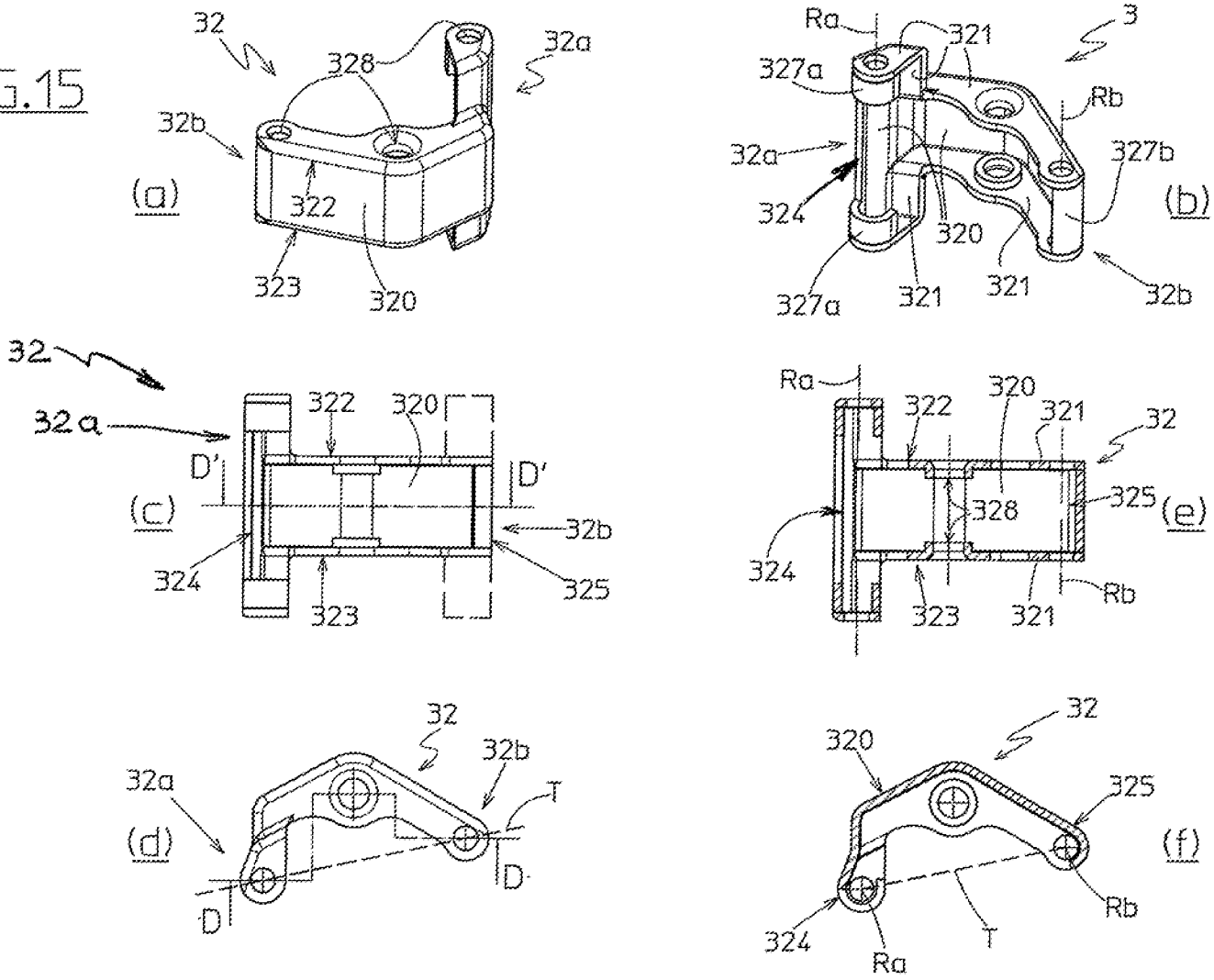
FIG. 15 illustrates a first arm of the articulation device of the hinge according to the invention: in a perspective front view (detail (a)), in a rear perspective view (detail (b)), in a rear view (detail (c)), in top plan view (detail (d)), in longitudinal section view along the plane indicated by D-D in FIG. 15(*d*) (detail (e)), in cross-section in the plane indicated by D'-D' in FIG. 15(*c*) (detail (f)).

Said concavity of the only concave piece, in which said first arm 32 is shaped, is defined, in combination:

By a shaped bottom 320 of the first arm 32 which, in orthogonal projection on a plane perpendicular to the direction of the length Z1, Z2 of the connecting bodies 2*a*, 2*b* (plane of the sheet in FIGS. 15(*d*), 15(*f*), 16(*d*), 16(*f*)), following a concave curve with concavity facing towards the first reference plane, said curve connecting to each other the ends 32*a*, 32*b* of the first arm 32, said bottom 320 further providing a first 322 and a second 323 transverse side which are arranged on opposite sides of the bottom 320 along the direction of length Z1, Z2 of the connecting bodies 2*a*, 2*b* and which develop transversely to said direction of length Z1, Z2, preferably perpendicular to it;

At least in correspondence of the first 322 and the second transverse side 323 of the bottom 320 from the side walls 321 of the first arm 32 that rise from the bottom 320 away from this towards the first reference plane, making therein corresponding sections of a peripheral edge of the bottom 320, each of which is continuous and joined to the bottom without interruption in the material forming said respective single metal sheet.

A first longitudinal side 324 of the bottom 320, corresponding to the first end 32*a* of the first arm 32, and a second longitudinal side 325 of the bottom 320, corresponding to the second end 32*b* of the first arm 32, opposite each other and which extend parallel to the direction of length Z1, Z2, ideally define with the first 322 and the second 323 transverse side a geometric figure that, in orthogonal projection on the reference plane, is substantially quadrilateral. One such projection is shown in FIGS. 15(*c*) and 16(*c*), wherein, to locate said substantially quadrilateral figure, one should ideally extend the two transverse sides 233, 323 to the ends indicated by 32*a*, 32*b*.

Said second arm 32 is shaped from a respective single metal sheet in one piece concave with the concavity facing towards a respective reference plane parallel to the direction of the length Z1, Z2 of the connecting bodies 2*a*, 2*b* and passing through the ends 32'*a*, 32'*b* of the second arm 32'. The reference plane of the second arm 32' is shown in FIGS. 17(*d*), (*f*), (*g*), 18(*d*), (*f*), (*g*) by a dashed line T' which represents its track in plane of the sheet (which, in FIGS. 17(*d*), (*f*), (*g*), 18(*d*), (*f*), (*g*) is perpendicular to the direction of the length Z1, Z2 of the connecting bodies 2*a*, 2*b*).

Figure 17:
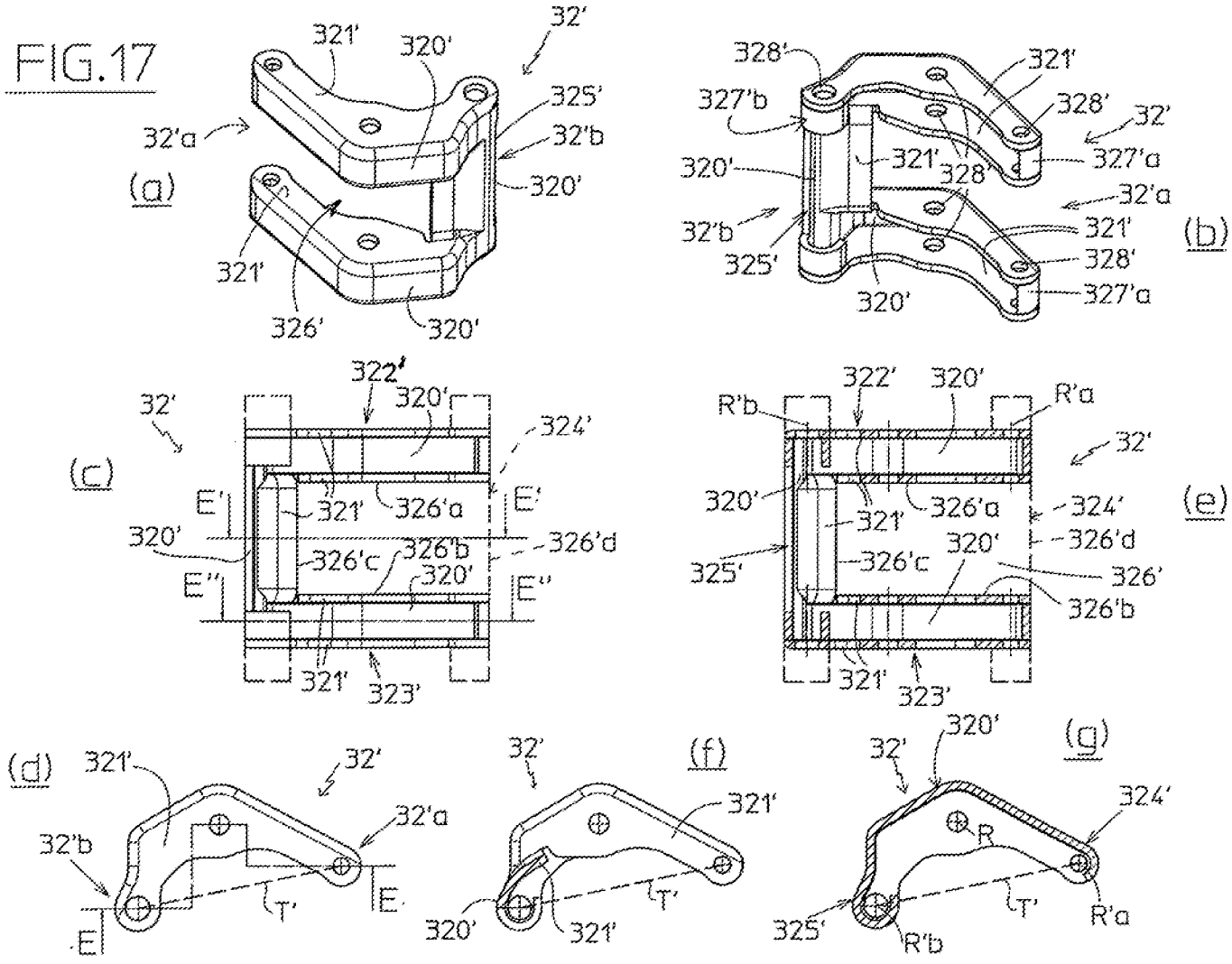
FIG. 17 illustrates a second arm of the articulation device of the hinge according to the invention: in a perspective front view (detail (a)), in a rear perspective view (detail (b)), in a rear view (detail (c)), in top plan view (detail (d)), in longitudinal section view along the plane indicated by E-E in FIG. 17(*d*) (detail (a)), in cross-section on the plane indicated by E"-E" in FIG. 17(*c*) (detail (f)), in cross-section view on the plane indicated by E'-E' in FIG. 17(*c*) (detail (g)).

Said concavity of the only one concave piece in which said second arm 32' is shaped is defined, in combination:

By a shaped bottom 320' of the second arm 32' that, in orthogonal projection on a plane perpendicular to the direction of the length Z1, Z2 of the connecting bodies 2*a*, 2*b* (plane of the paper sheet in FIGS. 17(*d*), (*f*), (*g*), 18(*d*), (*f*), (*g*)), following a concave curve with concavity facing towards the respective reference plane, said curve connecting to each other the ends 32'*a*, 32'*b* of the second arm 32', said bottom 320' further providing a first 322' and second 323' transverse side which are arranged on opposite sides of the bottom 320' along the direction of length Z1, Z2 of the connecting bodies 2*a*, 2*b* and which extend transversely to the said direction of the length Z1 Z2, preferably perpendicular to it;

At least in correspondence of the first 322' and second 323' transverse side of the bottom 320' by side walls 321' of the second arm 32' that rise from the bottom 320' away from this towards the respective first reference plane, realizing therein corresponding lengths of a peripheral edge of the bottom 320' each of which is continuous and joined to the bottom without interruption in the material forming said respective single metal sheet.

A first longitudinal side 324' of the bottom 320', corresponding to the first end 32'*a* of the second arm 32', and a second longitudinal side 325' of the bottom 320', corresponding to the second end 32'*b* of the second arm 32', opposite to each other and that extend parallel to the direction of the length Z1, Z2, ideally define, with the first 322' and second 323' transverse side, a geometric figure that, in orthogonal projection on the respective reference plane, is substantially quadrilateral. One such projection is shown in FIG. 17(*c*), 17(*e*), 18(*c*), 18(*e*), wherein, to locate said substantially quadrilateral figure, account must be taken of the hatch which completes ideally the first longitudinal side 324'.

Said curve formed by the first arm 32 and/or the second arm 32' in orthogonal projection on a plane perpendicular to the direction of the length Z1, Z2 of the first and of the second connecting body 2*a*, 2*b* can be a broken line (composed of two or consecutive segments), an arc (in particular of circumference and/or ellipse) and/or combinations of the same, drawing several forms in said perpendicular plane (for example "V"- or "U"-shaped or similar). The curves corresponding to the two arms 32, 32' may be symmetrical to each other, the same or different depending on the needs.

Such a concave three-dimensional structure, which contribute to the side walls 321, 321' and the bottom 320, 320' (also with a concave orthogonal projection in the plane perpendicular to the direction of the length Z1, Z2 of the connecting bodies 2*a*, 2*b*), confers to an arm 32, 32' a good mechanical resistance, that allows to realize the piece with a single metal sheet of limited thickness, with considerable saving of material and/or increase in performance compared to the corresponding arms of the known art, with respect to equal general geometric shape of the arms. The piece can be realized by drawing.

Figure 27:
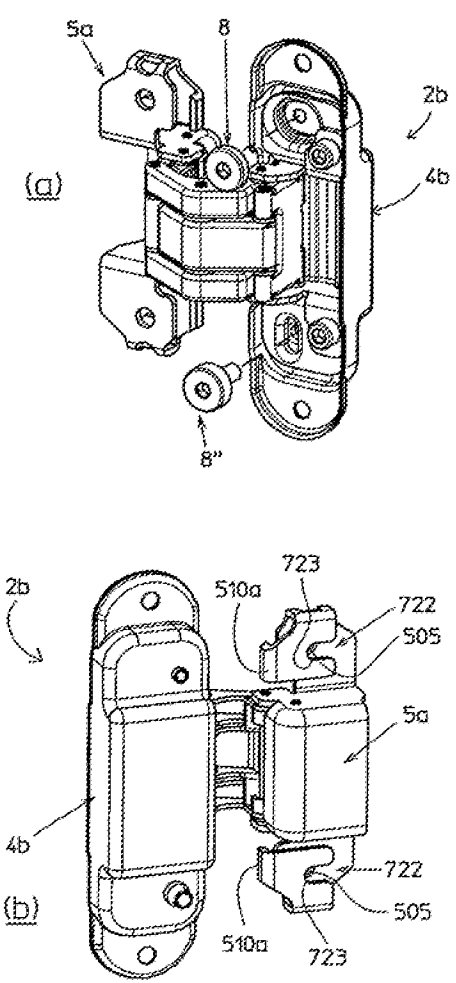
in FIG. 27(*a*) the insertion of the group formed by the first and second movable body of the second connecting body within their support structure.

The articulation device 3 may be composed of a single arm 32, 32', or by two or more arms 32, 32'. In a configuration comprising at least the first 32 and the second arm 32', preferably, as illustrated in the figures, said second arm 32' is hinged to the first arm 32 in correspondence with a common rotation axis R parallel to the direction of the length Z1, Z2 of the connecting bodies 2*a*, 2*b* and passing between the two ends 32*a*, 32*b*, 32'*a*, 32'*b* of each arm 32, 32'. Advantageously, always as shown in the figures, at least in correspondence with the rotation axis R, portions of an arm 32, 32' contiguous to portions of another arm 32', 32 face to each other their side walls 321,321' that extend transversely, preferably perpendicularly, to the direction of the length Z1, Z2 of the connecting bodies 2*a*, 2*b* (see, in particular, FIGS. 1, 2, 3, 24, 26-29. This type of coupling is particularly visible in FIG. 27(*b*) and in FIG. 28). The articulation device 3 can also comprise a plurality of arms 32, 32' hinged to one another in correspondence with the rotation axis R parallel to the direction of the length Z1, Z2 of the connecting bodies 2*a*, 2*b* and passing between the two ends 32*a*, 32*b*, 32'*a*, 32'*b* of each arm 32, 32'. All arms have concave three-dimensional structures with similar characteristics (even though, as we shall see, in a sense complementary, at least in orthogonal projection on a plane parallel to the reference plane T, T' of each arm).

Advantageously, the arms 32, 32' of the articulation device 3 coupled to each other in correspondence with the axis of rotation R realize a structure along the direction of length Z1, Z2 of the connecting bodies 2*a*, 2*b* has a length substantially equal to that of the seat in which the articulation device 3 is enclosed. In this way, one obtains a much more resistant hinge 1, in particular to the bending consequent to the opening of the door.

In correspondence of the first 322, 322' and/or of the second 323, 323' transverse side of the bottom 320, 320' of an arm 32, 32', the bottom 320, 320' itself extends, developing, along the first 324, 324' and/or along the second 325, 325' longitudinal side besides said first 322, 322' and/or second 323, 323' transverse side. A solution of this kind for the first arm 32 is illustrated in continuous curves on the first longitudinal side 324 and (alternatively or additionally) in dotted curves on the second longitudinal side 325 in FIGS. 15(*c*) and 16(*c*). A solution of this kind for the second arm 32' is always shown in dotted lines on the first longitudinal side 324' and (alternatively or additionally) on the second longitudinal side 325' in FIGS. 17 (*c*), 17(*e*) and 18(*c*), 18(*e*). As shown in particular in the portions in the continuous curve of the figures above mentioned (and also in the remaining figures that illustrate the arms 32, 32'), the side wall 321, 321' corresponding to said first 322, 322' and/or second 323, 323' transverse side is prolonged, without interruption of the material constituting said respective single metal sheet from which the arm 32, 32' is shaped, for a predetermined distance along said extension of the first 324, 324' and/or of the second 325, 325' longitudinal side to extend the corresponding portion of the peripheral edge of the bottom 320, 320' in a configuration that, in the orthogonal projection on the respective reference plane T, T', assumes at least a "L"-shaped configuration. Preferably, the side wall 321, 321' corresponding to said first 322, 322' and/or second 323, 323' transverse side is prolonged, without interruption of the material constituting said respective single metal sheet from which the arm 32, 32' is shaped up to one end of the first 324, 324' and/or of the second 325, 325' longitudinal side, folding back on the latter and extending correspondingly the section of the peripheral edge of the bottom 320, 320' corresponding to the first 322, 322' and/or second 323, 323' transverse side of the bottom 320, 320', keeping it continuous and joined to the bottom 320, 320' without interruption of the material constituting the single metal sheet from which the arm 32, 32' is shaped.

This creates on the first and/or second longitudinal side of the bottom, at the junction with the first and/or the second transverse side, a locally stepped and/or "Z"- and/or "S"-shaped configuration, depending on the orientation of the corresponding arm, as well visible, for example, in FIG. 15 (if one considers, one at a time, the upper part or the lower part of the arm 32 in correspondence of the longitudinal first side 324).

The extensions are also stiffened by the prolongation of the side walls 321, 321' as well as of that of the bottom 320, 320'.

Always with reference to FIGS. 15(*c*) and 16(*c*) for the first arm 32, as well as to FIGS. 17(*c*), 17(*e*) and 18(*c*), 18(*e*) for the second arm 32', both in correspondence of the first 322, 322' and second 323, 323' transverse side of the bottom 320, 320', the same bottom 320, 320' extends, developing, along the first 324, 324' and/or along the second 325, 325' longitudinal side both besides said first 322, 322' and said second 323, 323' transverse side. The side walls 321, 321' corresponding to said first 322, 322' and second 323, 323' transversal side each extend, without interruption of the material constituting said respective single metal sheet from which the arm 32, 32' is shaped, along the respective extension of the first 324, 324' and/or the second 325, 325' longitudinal side to prolong the corresponding portion of the peripheral edge of the bottom 320, 320' in a configuration that, in the orthogonal projection on the respective first reference plane, assumes a configuration substantially specular with respect to a center plane of the bottom 320, 320' perpendicular to the reference plane of the arm 32, 32'.

The bottom 320, 320' of the arm 32, 32' is so projected onto the reference plane in a "T"- or "H"-shape figure. The "T"-shape has the "stem", or prong, horizontal (see also the reference number 329 in FIG. 23(*b*)) and the "hat" (the portion corresponding to the first and/or second longitudinal side 324, 324', 325, 325') which can also be asymmetric, depending on the requirements. Also the "H" shape can present the horizontal portion not exactly at half height. The vertical extensions of the "H" shape are not necessarily of equal length with each other, but can be realized each with its own predetermined length depending on the requirements. Preferably, also in this case, the side walls 321, 321' corresponding to both said first 322, 322' and said second 323, 323' transverse side are prolonged, without interruption of the material constituting said respective single metal sheet from which arm 32, 32' is shaped, until the two ends of the first 324, 324' and/or of the second 325, 325' longitudinal side, folding back on the latter and extending correspondingly the section of the peripheral edge of the bottom 320, 320' corresponding to the first 322, 322' and second 323, 323' transverse side of the bottom 320, 320' and keeping it continuously joined to the bottom 320, 320' without interruption of the material constituting the single metal sheet from which the arm 32, 32' is shaped.

This creates on the first and/or second longitudinal side of the bottom, both in correspondence of the junction with the first and with the second transverse side, a locally stepped and/or "Z"- and/or "S"-shaped configuration, depending on orientation of the corresponding arm, as well visible, for example, in FIG. 15 (if one considers, one at a time, the upper part or the lower part of the arm 32 in correspondence of the longitudinal first side 324).

In one embodiment of the articulation device 3, the bottom 320, 320' and the related side walls 321, 321' of an arm 32, 32' realize a structure in which the orthogonal projection onto the reference plane of the arm 32, 32' assumes a symmetrical configuration with respect to an axis of the center line of the arm 32, 32' parallel to the direction of the length Z1, Z2 of the connecting bodies 2*a*, 2*b*. This means that the bottom 320, 320' extends also along the second longitudinal side 323, 323' widening itself with the side walls 321, 321' of the first and/or the second transverse side 322, 322' that realize the same "L"- and/or "S"- and/or "Z"-shaped or steped structure. If this happens in correspondence of both transverse sides 322, 322', the bottom 320, 320' (and also the corresponding arm 32, 32', of course . . . ) assumes a configuration that, projected on the reference plane of the arm, is "H"-shaped.

If this happens only at the first or the second of the transverse sides 322, 322', the bottom 320, 320' (and also the corresponding arm 32, 32', of course . . . ) assumes a configuration that, projected on the plane of the reference arm, is "U"- or inverted "U"-shaped. See, for example, FIG. 15(*d*) and FIG. 16(*d*), considering the dashed part as integration of solid line one and considering one at a time the portions of the figure which are located one on a side and one on the other side of the section plane D'-D', D"-D" (the portion of the opposite figure to said track having to be thought without dashes and extensions of the longitudinal sides): the portion of the figure above the trace of the plane of section D'-D', D"-D" shows a "U"-shaped configuration, while that below it illustrates a configuration of inverted "U" shape.

Figure 18:
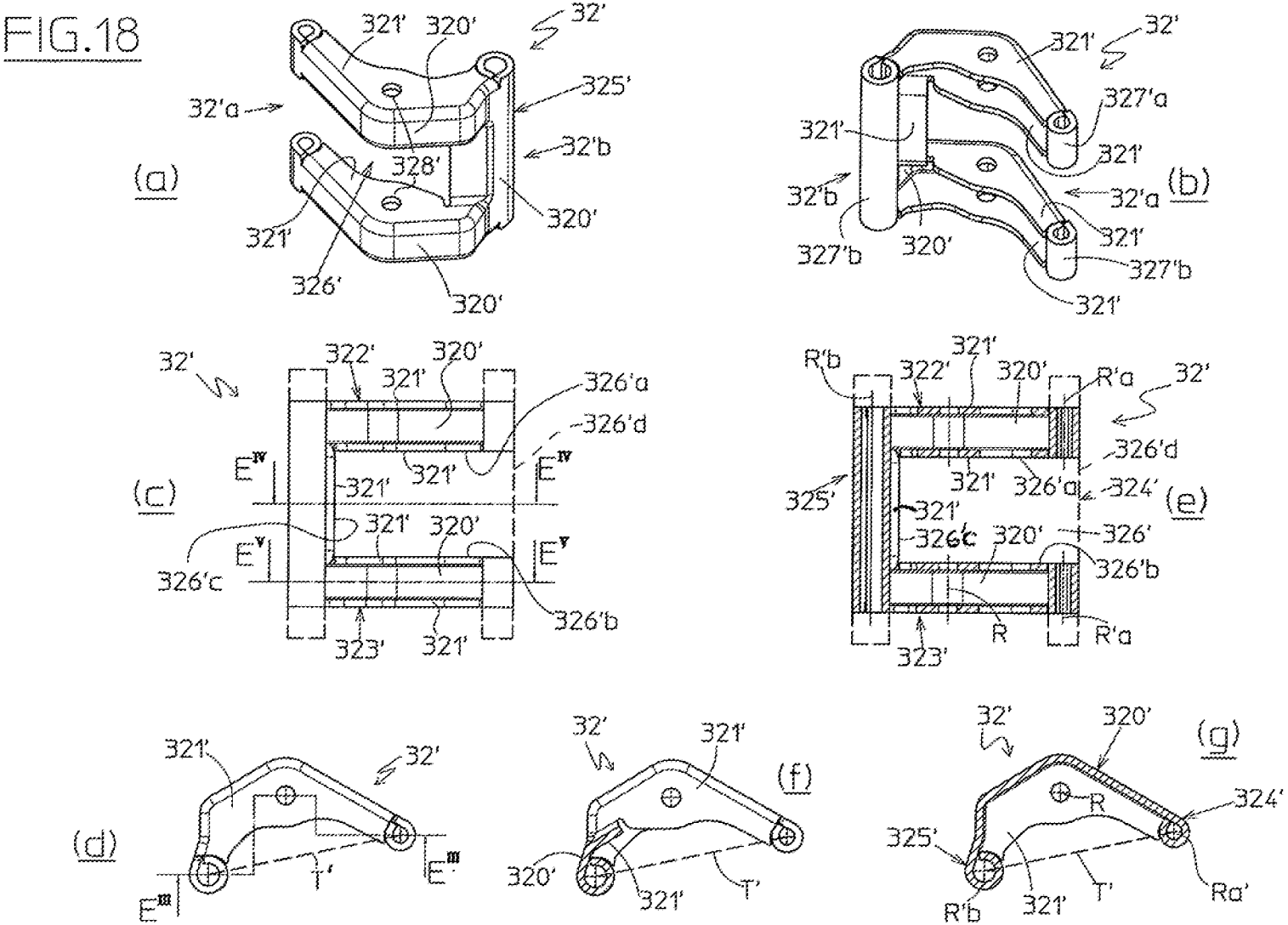
FIG. 18 illustrates a variation of the second arm of the articulation device of the hinge of FIG. 17: in a perspective front view (detail (a)), in a rear perspective view (detail (b)), in a rear view (detail (c)), in top plan view (detail (d)), in longitudinal section view along the plane indicated by E'"-E'" in FIG. 18(*d*) (detail (e)), in cross-section on the plane indicated by $E^{V}$-$E^{V}$ in FIG. 18(*c*) (detail (f)), in cross-section on the plane indicated by $E^{IV}$-$E^{IV}$ in FIG. 18(*c*) (detail (g)).
Figure 23:
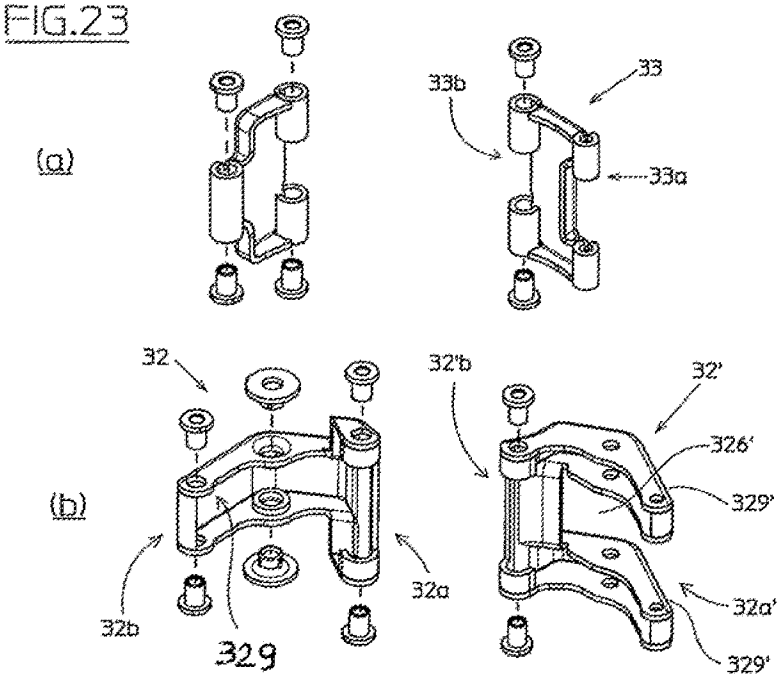
in FIGS. 23(*a*) and 23(*b*), the introduction of sliding bushes at the ends of the first and second connecting rod and, respectively, the first and second arm of the articulation device.

With reference in particular to FIGS. 17 and 18, as well as to FIG. 23, on the bottom 320' of an arm 32', one or more through slots 326 are made, which extend parallel to both the first 322' and second 323' transverse side the bottom 320'. In the figures, this feature is illustrated in the second arm 32' and the numerical references are assigned accordingly. However, the same structure (or similar structure) may also be implemented on the first arm 32, or on any of the arms 32, 32' that make up the articulation device 3. This observation applies to the description which follows and for the relevant details.

Each of the one or more through slots 326' has at least:

A first 326'*a* and a second 326'*b* transverse edge, which extends transversely, preferably perpendicularly, to the direction of the length Z1, Z2 of the connecting bodies 2*a*, 2*b;*

At least one first longitudinal edge 326'*c*, that, placed on the side of the through slot 326' facing the first 324' or the second 325' longitudinal side of the bottom 320', runs parallel to the direction of the length Z1, Z2 of connecting bodies 2*a*, 2*b* (in the figures the first longitudinal edge 326'*c* is explicitly indicated in respect of the second side 325' of arm 32').

Along the first transverse edge 326'*a*, along the first longitudinal edge 326'*c* and along the second transverse edge 326'*b*, transverse walls 321' of arm 32' rise from the bottom 320' away from this towards the reference plane T' and therein form a respective continuous portion of the peripheral edge of the bottom 320', joined to the bottom without interruption of the material constituting the single metal sheet from which the arm 32' is shaped and that surrounds the whole slot 326' passing on all of said edges.

Said one or more slots 326' of the bottom 320' are extended, together with the associated peripheral edge, to the second 325' or, respectively, the first 324' longitudinal side, where they are open (in the figures the open part of one or more slots 326' of the bottom 320' is explicitly shown and illustrated in correspondence of the first side 324' of arm 32'). The second 325' or, respectively, the first 324' longitudinal side of the bottom 320' it is thus broken into a series of successive sections equal to the number of through-slots 326' increased by one unit. The arm 32' thus has a series of shaped prongs 329' which extend from the first 324' or the second 325' longitudinal side of the bottom 320' (illustrated in the figures is the case of the shaped prongs 329' which extend from the second side 325' of arm 32'). Therefore, the shaped prongs 329' branch off from the first 32'*a* or, respectively, from the second end 32'*b* of the same arm 32' (in the figures, in particular, shows a case in which the shaped prongs 329' branch off from the second end 32'*b*), to realize, when the first 324' and second 325' longitudinal side of the bottom do not extend beyond the transverse sides 322', 323' of the same, a "C" structure formed by the two end shaped prongs 329' and by the first 32'*a* or by the second end 32'*b* (in the figures: from the second end 32'*b*). In one embodiment not shown explicitly in the figures, but easily deducible from what is described and illustrated, such a "C" structure may possibly enclose one or more additional shaped prongs 329' between the two shaped prongs 329' ends, to form a comb structure. When the first 324' or the second 325' longitudinal side extends beyond the two transverse sides 322', 323' of the bottom 320', the arm 32' assumes an "L" or "T" structure comprising a comb with one or more shaped prongs 329' in addition to that which would produce the base of the "L" or the (horizontally oriented) stem of the "T".

If also the second 325' or, respectively, the first 324' longitudinal side extends beyond the two transverse sides 322' 323' of the bottom 320', the perimetric edge of the bottom 320' corresponding to the first 322' and/or the second 323' transverse side of the bottom 320' assumes a shape of a "U" or, respectively, inverted "U".

Obviously, the structures described here can never be symmetrical with respect to a centerline plane of the arm 32' parallel to the direction of the length Z1, Z2 of the connecting bodies 2*a*, 2*b*, being the through slots 326' open on one side. Alternatively, in an embodiment illustrated only schematically in dashed lines in FIGS. 17(*c*), 17(*e*) and in FIGS. 18(*c*), 18(*e*), said one or more slots 326' of the bottom 320' are closed in correspondence of one of their second longitudinal edge 326'*d* opposite to the first 326'*c*, the section of the peripheral edge of the bottom 320' corresponding to each of the one or more slots 326' enclosing the whole slot 326' corresponding on all its edges. The second 325' and/or the first 324' longitudinal side of the bottom 320' it is thus continuous. The arm 32' thus has a closed frame, possibly prolonged in correspondence with the structure of one or both of its longitudinal sides 324', 325', and which is internally provided with either a single hole or a sort of "grid" that crosses with transverse elements the internal opening to the frame.

Obviously, this structure may be symmetrical with respect to a centerline plane of the arm 32' parallel to the direction of the length Z1, Z2 of the connecting bodies 2*a*, 2*b*.

With the forms described so far one can produce structures with at least two arms engaged on one another in a complementary manner. For example, always taking as reference an orthogonal projection of arm 32, 32' on its own reference plane T, T', one can bind complementary to each other: a U-shaped structure and a corresponding inverted "U-shaped" structure; a T-shaped structure with a corresponding C-shaped structure (for example as happens to arms 32, 32' illustrated in FIGS. 1 and 3); a T-shaped structure (like that of the first arm 32) coupled with a closed frame, or "O"-shaped (like that of the second arm 32', completed with the closing of the first side wall 324'); an "H"-shaped structure (like that of the first arm 32 of FIG. 15(*c*) completed as from the corresponding dashing at the second longitudinal side 325) combined with a corresponding "C"-shaped structure (like that of the second arm 32' illustrated by continual line for example in FIG. 17(*c*)) whose prongs fit in top and bottom spaces of the "H"-shaped structure; a "L"-shaped structure with a corresponding inverted L-shaped structure; and so on . . . . The arm can also be a simple structure (with a bottom that, in projection on the reference plane, is rectangular and has the side walls on the two transverse sides) and combine with another simple arm and/or with other simple arms, or with one or more arms according to any of the preceding forms, depending on the need, the structural convenience or the like. Obviously, in the light of what has been described and illustrated, one can also realize structures with a number of arms greater than two, for example coupled to one another and to a common axis of rotation that passes between the ends thereof, in a suitable way.

Preferably, in each slot 326', that in the bottom 320' of an arm 32' extends parallel to the first 322' and/or the second 323' transverse side of the bottom 320', a corresponding prong 329 is inserted to another arm 32 extending parallel the first 322 and/or to the second 323 transverse side of the respective bottom 320, in a substantially complementary configuration at least in correspondence to the axis of rotation R.

Suitably, at at least one end 32*a*, 32*b*, 32'*a*, 32'*b* of the arm 32, 32' on the bottom 320, 320' is extended by at least sections of, or by all, the corresponding longitudinal side 324, 325, 324', 325' towards the outside and transversely to the direction of the length Z1, Z2 of the connecting bodies 2*a*, 2*b* cylindrically folding back on itself around an axis parallel to the direction of the length Z1, Z2 of connecting bodies 2*a*, 2*b*, to form at least partially a cylindrical seat 327*a*, 327*b*, 327'*a*, 327'*b*, continuous at least in sections along its axis, for the housing of at least a corresponding pin for defining a respective axis of rotation Ra, Rb, R'a, R'b.

Figure 16:
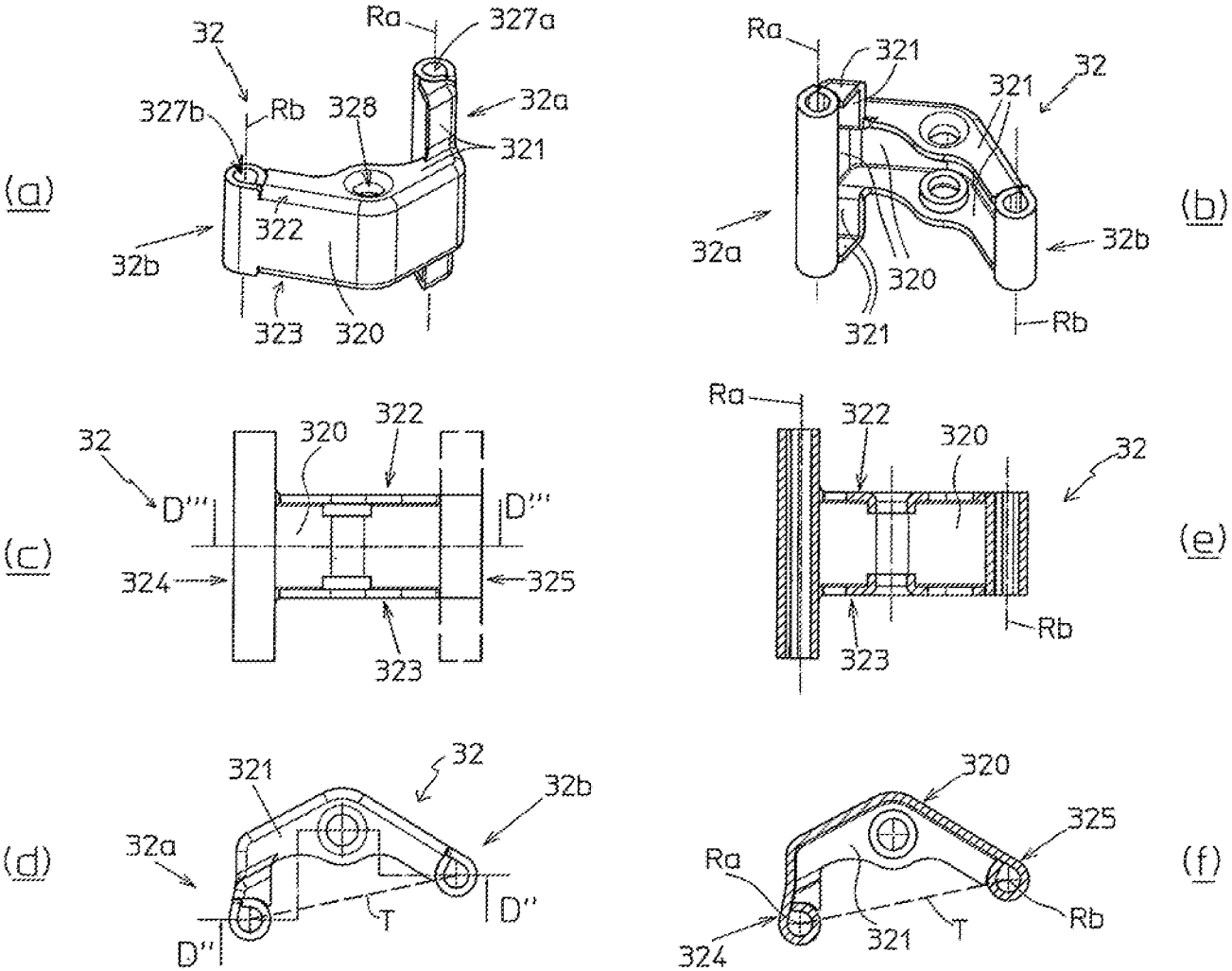
FIG. 16 illustrates a variation of the first arm of the articulation device of the hinge of FIG. 15: in a perspective front view (detail (a)), in a rear perspective view (detail (b)), in a rear view (detail (c)), in top plan view (detail (d)), in longitudinal section view along the plane indicated by D"-D" in FIG. 16(*d*) (detail (e)), in cross-section on the plane indicated by D'"-D'" in FIG. 16(*c*) (detail (f)).

The cylindrical seat 327*a*, 327*b*, 327'*a*, 327'*b* (or one or more of its sections if it is discontinuous) has its ends in contact with the corresponding side walls 321, 321' of the arm 32, 32' which run transversely (preferably perpendicular) to the direction of the length Z1, Z2 of the second connecting bodies, 2*b*. In FIGS. 16 and 18, cylindrical seats 327*a*, 327*b*, 327'*a*, 327'*b* are illustrated that fold in front of an edge of said side walls 321, preferably up to get in contact with the same. In FIG. 18, on the first longitudinal side 324' two sections 327'*a* of seats (or, if desired, two separate seats 327'*a*) are present: one in correspondence with a first prong of the bottom 320' and the other in correspondence of a second prong of the bottom 320'. These separate sections define an axis of rotation indicated by R'a. On the second longitudinal side 325' there is a single seat 327'*b* that develops for the entire length of said second longitudinal side 325'. Such single seat defines an axis of rotation indicated by R'b. In FIG. 16, a similar configuration is visible. A seat 327*a* develops throughout the longitudinal first side 324 of the bottom 320 (in this case up to the prolongations of the latter beyond the first 322 and/or the second transverse side 323 of the bottom 320) going into contact with the edges of the side walls 321 extensions lining the first 322 and the second 323 transverse side of the bottom 320. This seat defines an axis of rotation indicated by Ra. A seat 327*b*, localized in correspondence of the second longitudinal side 325, develops across the width of a prong of the bottom 320. The latter seat defines an axis of rotation indicated by Rb.

Preferably, wherever possible, one adopts a configuration in which the cylindrical seat 327*a*, 327*b*, 327'*a*, 327'*b* (or one or more of its sections if it is discontinuous) is preferably between said corresponding side walls 321, 321' of the arm 32, 32'. Between said corresponding side walls 321, 321' of the arm 32, 32' and said contacting ends, there may be discontinuities in the material forming the single metal sheet from which the arm 32, 32' is shaped (the latter feature in particular making the most simple embodiment of the arm by deep drawing followed by drilling or cutting and bending). In FIGS. 15 and 17, cylindrical seats 327*a*, 327*b*, 327'*a*, 327'*b* are illustrated that have this feature. In FIG. 17, on the first longitudinal side 324', two sections 327'*a* of seats (or, if desired, two separate seats 327'*a*) are present: one in correspondence to a first prong of the bottom 320' and the other in correspondence to a second prong of the bottom 320'. These separate sections define an axis of rotation indicated by R'a. Each of the two separate sections is inserted between corresponding sections of the side walls 321' corresponding to the long sides of the respective prong. On the second longitudinal side 325' there are two seas 327'*b*, one in correspondence of one end and the other in correspondence of the other end of the second longitudinal side 325'. These seats define an axis of rotation indicated by R'b. Each seat is in contact with the inner face of a side wall 321' which corresponds to transverse side 322', 323' in correspondence of which the seat is placed. In FIG. 15, a similar configuration is visible. Two locations 327*a*, one in correspondence of one end and the other in correspondence of the other end of the first longitudinal side 324'. This seat defines an axis of rotation indicated by Ra. Each seat is in contact with the inner face of a side wall 321 which corresponds to the transverse side 322, 323 at which the seat is placed (in particular the side wall portion 321 which is the extension to the end of the first longitudinal side 324). A seat 327*b*, localized in correspondence of the second longitudinal side 325, develops across the whole width of a prong of the bottom 320. The latter seat defines an axis of rotation indicated by Rb. Said seat is inserted between corresponding sections of the side walls 321 corresponding to the long sides of the respective prong. In correspondence with the cylindrical seats 327*a*, 327*b*, 327'*a*, 327'*b*, the side walls 321, 321' preferably have through holes 328, 328' to allow the passage of corresponding pins.

In general, in the side walls 321, 321' of the arm 32, 32' which run transversely (preferably perpendicularly) to the direction of the length Z1, Z2 of the connecting bodies 2*a*, 2*b*, one or more through holes 328, 328' are drilled for the insertion of at least one pin for the definition of one or more respective axes of rotation R, Ra, Rb, R'a, R'b. As illustrated by way of example in FIGS. 15(*b*), 15 (*e*), 16(*b*), 16(*s*) (the illustration is given by way of example with reference to the first arm 32, but it is understood that the same feature could also be realized on the second arm 32' or on any of the arms 32, 32' according to the needs), in correspondence of at least one of said through holes 328, the corresponding side wall 321 of the arm 32 extends along the axis of the through hole 328 in a respective sleeve. Two side walls 321 consecutive along the direction of length Z1, Z2 of the connecting bodies 2*a*, 2*b* and equipped with through-hole 328 with sleeve preferably have said sleeves which develop coaxially towards one another or in the opposite direction.

The first arm 32 has the first end 32*a* hinged on the first connecting body 2*a* in correspondence of a respective rotation axis Ra parallel to the direction of the length Z1 of the first connecting body 2*a*. The second arm 32' has the second end 3*b'* hinged on the second connecting body 2*b* in correspondence of a respective rotation axis R'b.

The first arm 32 has the second end 32*b* movable by driven motion with respect to the second coupling body 2*b* and the second arm 32' has the first end 32'*a* movable by driven motion with respect to the first connecting body 2*a*. In general, the axis of rotation Rb defined at the second end 32*b* of the first arm 32 and the axis of rotation R'a defined in correspondence of the first end 23'*a* of the second arm 32' will not be fixed in space with respect to any of the connecting bodies 2*a*, 2*b*, but will move by guided motion exactly as the respective ends 32*b*, 32'*a* of the arm 32, 32'. In one embodiment not illustrated in the figures, the first end 32'*a* of the second arm 32' is engaged in a respective sliding guide on the first connecting body 2*a*, and/or the second end 32*b* of the first arm 32 is engaged in a respective sliding guide on the second connecting body 2*b*. In the presence of movable inserts 5*a*, 5*b* and/or movable bodies 5*a*, 5*b*, 6*b* housed in respective housing structures on the connecting bodies 2*a*, 2*b*, the sliding guides are preferably realized on movable inserts 5*a*, 5*b* and/or on movable bodies 5*a*, 5*b*, 6*b* which are most distal from the respective support structures 4*a*, 4*b*. In one embodiment illustrated in the accompanying figures, the articulation device 3 also comprises a first connecting rod 33 having a first end 33*a* hinged to the second ends 32*b* of the first arm 32 in a corresponding rotation axis Rb and a second end 33*b* opposite to the first and hinged to the second connecting body 2*b* of the body in a corresponding rotation axis R1*b*. The motion of the second end 32*b* of the first arm 32 (and thus also of the corresponding rotation axis Rb) with respect to the second connecting body 2*b* is guided by the first connecting rod 33. The articulation device 3 also comprises a second connecting rod 33' having a first end 33'*a* hinged to the first connecting body 2*a* in a corresponding axis of rotation R1*a* and a second end 33'*b* opposite to the first and hinged to the first end 32'*a* of the second arm 32' in a corresponding R'a rotation axis. The motion of the first end 32'*a* of the second arm 32' (and thus also of the corresponding rotation axis R'a) relevant to the first connecting body 2*a* is driven by the second connecting rod 33'. In the presence of a plurality of arms 32, 32' (in particular having a common axis of rotation R), it is possible to provide a corresponding plurality of connecting rods 33, 33'.

With reference now in particular to FIGS. 19 to 22, a specific and advantageous structure of the first 33 and second 33' connecting rod is illustrated. The structure is similar to that already described for the first 32 and/or for the second 32' arm, therefore the conventions used in the description will be the same.

Said first 33 and/or said second 33' connecting rod is shaped from a respective single metal sheet in one concave piece with the concavity facing towards a respective reference plane parallel to the direction of the length Z1, Z2 of connecting bodies 2*a*, 2*b* and passing through the ends 33*a*, 33*b*, 33'*a*, 33'*b* of the first 33 or, respectively, of the second 33' connecting rod.

Figure 19:
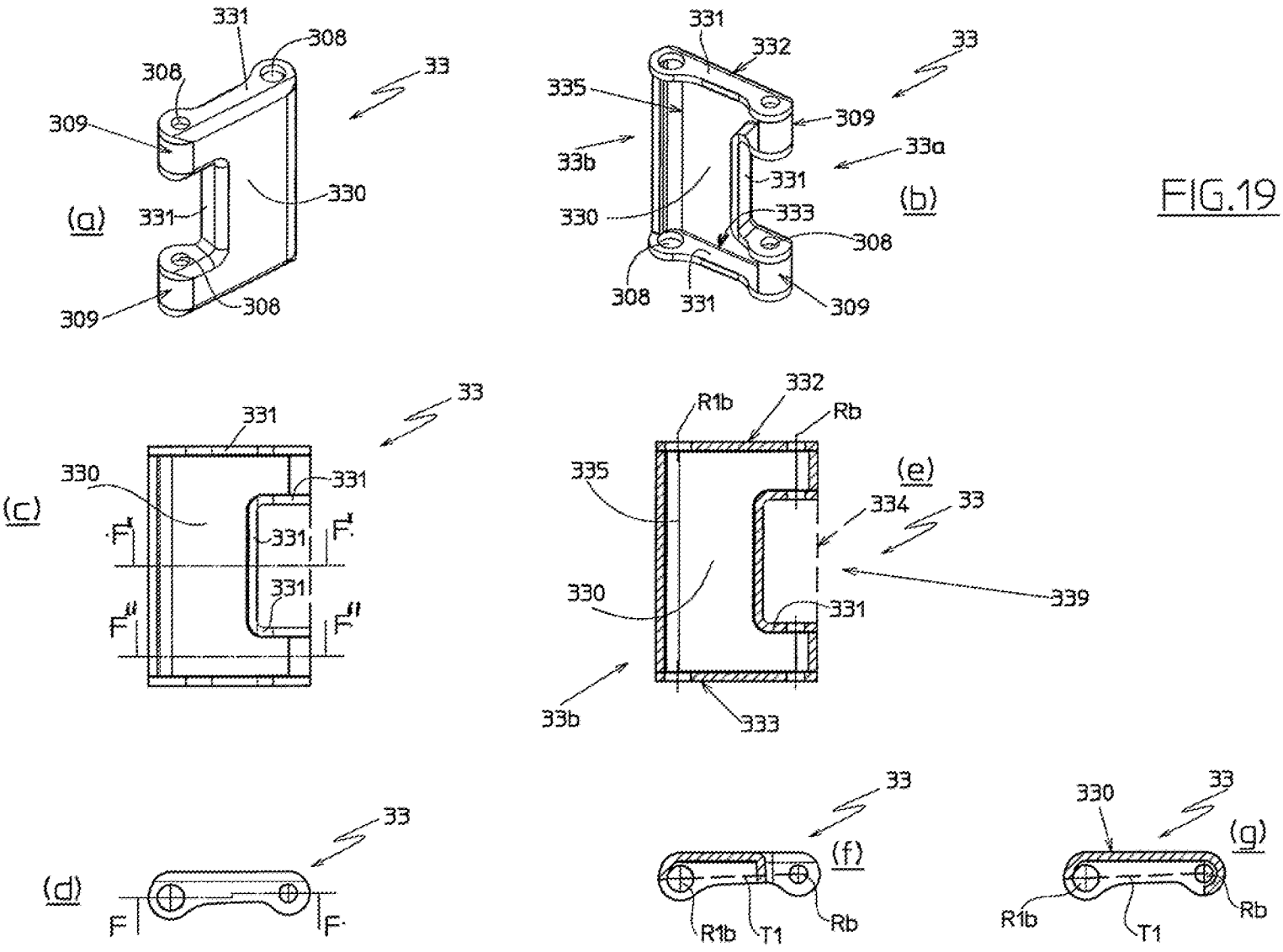
FIG. 19 illustrates a first connecting rod of the articulation device of the hinge according to the invention: in a perspective front view (detail (a)), in a rear perspective view (detail (b)), in a rear view (detail (c)), in a top plan view (detail (d)), in longitudinal section along the plane indicated by F-F in FIG. 19(*d*) (detail (e)), in cross-section on the plane indicated by F'-F' in FIG. 19(*c*) (detail (f)), in cross-section on the plane indicated by F"-F" in FIG. 19(*c*) (detail (g)).

The reference plane of the first connecting rod 33 is shown in FIGS. 19(*f*), 19(*g*) and 20(*g*), where it is represented with its trace on a plane perpendicular to the direction of the length Z1, Z2 of the connecting bodies 2*a*, 2*b* (see the corresponding dotted line) and indicated by the reference symbol T1.

Figure 21:
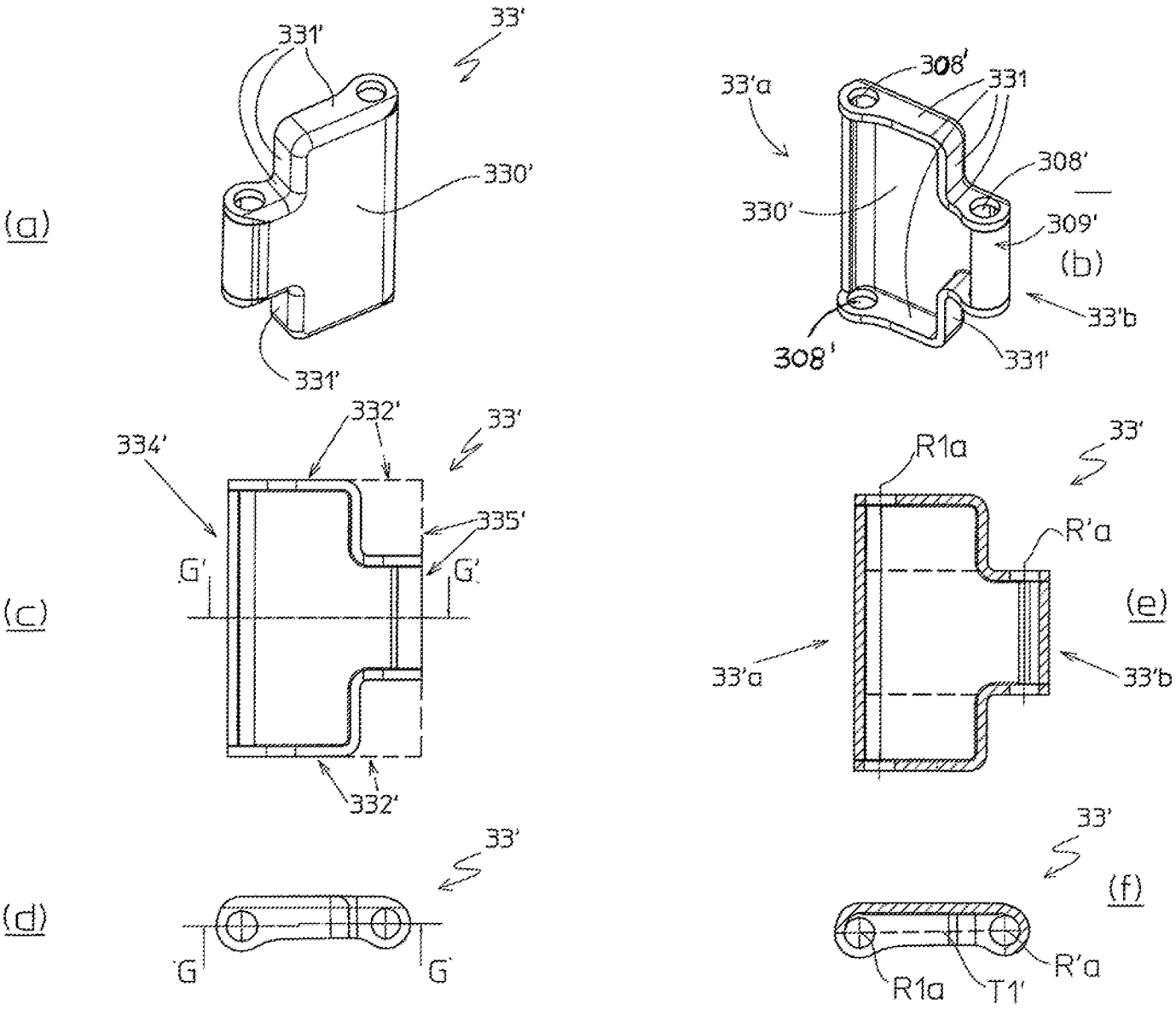
FIG. 21 illustrates a second connecting rod of the articulation device of the hinge according to the invention: in a perspective front view (detail (a)), in a rear perspective view (detail (b)), in a rear view (detail (c)), from above (detail (d)), in longitudinal section along the plane indicated by G-G in FIG. 21(*d*) (detail (e)), in cross-section on the plane indicated by G'-G' in FIG. 21(*c*) (detail (f)).
Figure 22:
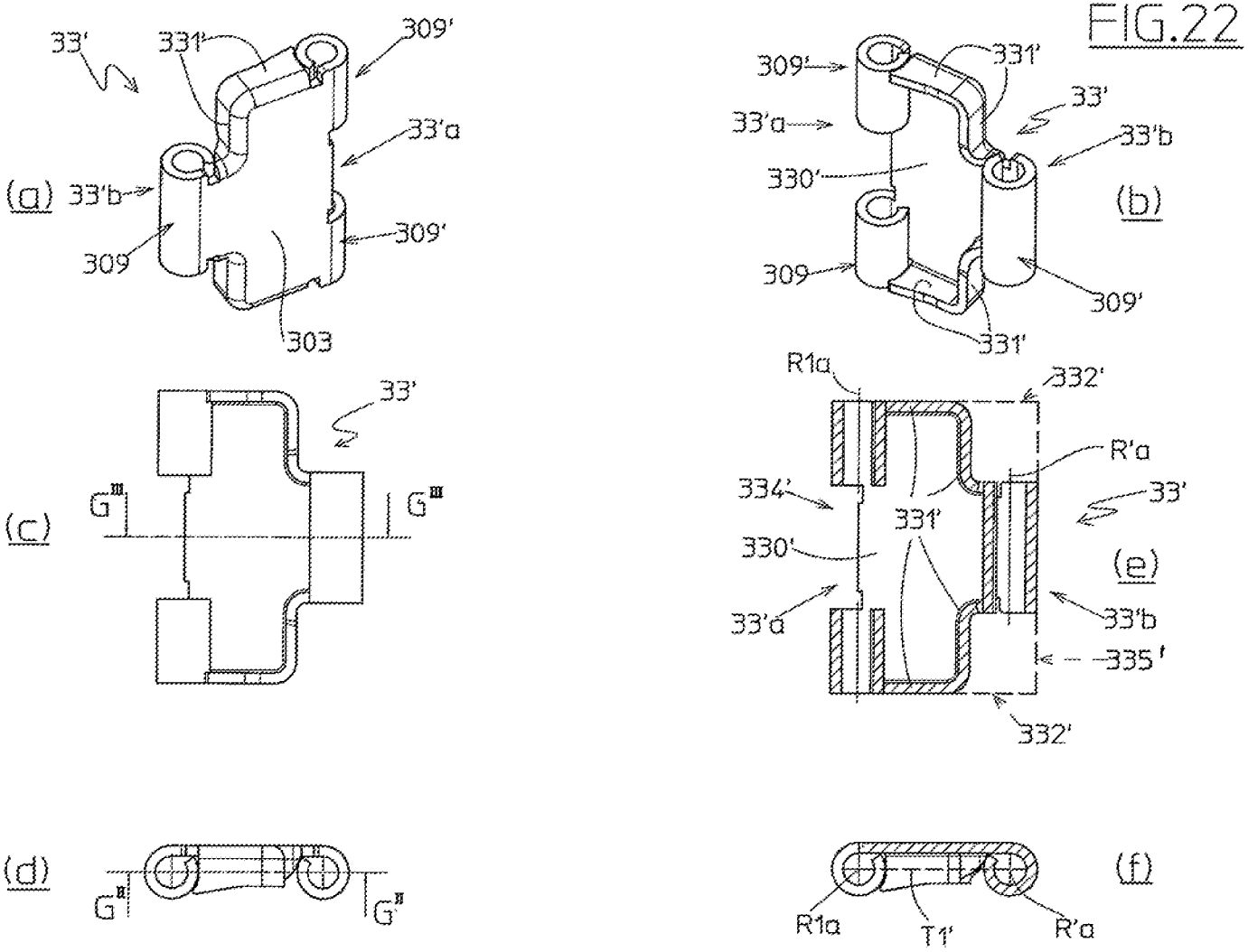
FIG. 22 illustrates a variation of the second connecting rod of the articulation device of the hinge of FIG. 21: in a perspective front view (detail (a)), in a rear perspective view (detail (b)), in a rear view (detail (c)), in top plan view (detail (d)), in longitudinal section along the plane indicated by G"-G" in FIG. 22(*d*) (detail (e)), in cross-section on the plane indicated by G'"-G'" in FIG. 22(*c*) (detail (f)).

The reference plane of the second connecting rod 33' is shown in FIGS. 21(*f*) and 22(*f*), where it is represented with its trace on a plane perpendicular to the direction of the length Z1, Z2 of the connecting bodies 2*a*, 2*b* (see the corresponding dotted line) and indicated by the reference symbol T1'.

Said concavity of the concave shaped piece in which the first 33 and/or the second connecting rod 33' is shaped is defined, in combination, respectively:

By a shaped bottom 330, 330' of the first 33, respectively the second 33' connecting rod which, in orthogonal projection on a plane perpendicular to the direction of the length Z1, Z2 of the connecting bodies 2*a*, 2*b*, follows a curve that connects together the ends 33*a*, 33*b*, 33'*a*, 33'*b* of the first 33, respectively the second 33' connecting rod, said bottom 330, 330' also providing a first 332, 332' and a second 333, 333' transverse side that are placed on opposite sides of the bottom 330, 330' along the direction of length Z1, Z2 of connecting bodies 2*a*, 2*b* and which develop transversely to said direction of length Z1, Z2, preferably perpendicular to it;

At least in correspondence of the first 332, 332' and second 333, 333' transverse side of the bottom 330, 330' from side walls 331, 331' of the first 33, respectively the second 33' connecting rod that rise from the bottom 330, 330' away from this towards the reference plane T1, T1', and therein realizing corresponding sections of a peripheral edge of the bottom 330, 330' each of which is continuous and joined to the bottom without interruption in the material forming said respective single metal sheet.

The curve that the shaped bottom 330, 330' of the first 33, respectively the second 33' connecting rod defines in orthogonal projection on a plane perpendicular to the direction of the length Z1, Z2 of the connecting bodies 2*a*, 2*b* can be a line segment (as illustrated in the figures), or any other convenient curve, in particular a concave curve with concavity facing towards the reference plane T1, T1' of the connecting rod 33, 33' according to all the procedures described for the first 32 and/or for the second 32' arm.

A first longitudinal side 334, 334' of the bottom 330, 330', corresponding to the first ends 33*a*, 33'*a* of the first 33, respectively the second 33' connecting rod, and a second longitudinal side 335, 335' of the bottom 330, 330', corresponding to the second end 32*b*, 32'*b* of the first 33, respectively the second 33' connecting rod, opposite to each other and that extend parallel to the direction of the length Z1, Z2, ideally define with the first 332, 332' and the second 333, 333' transverse side a geometric figure that, in orthogonal projection on the reference plane, is substantially quadrilateral.

Figure 20:
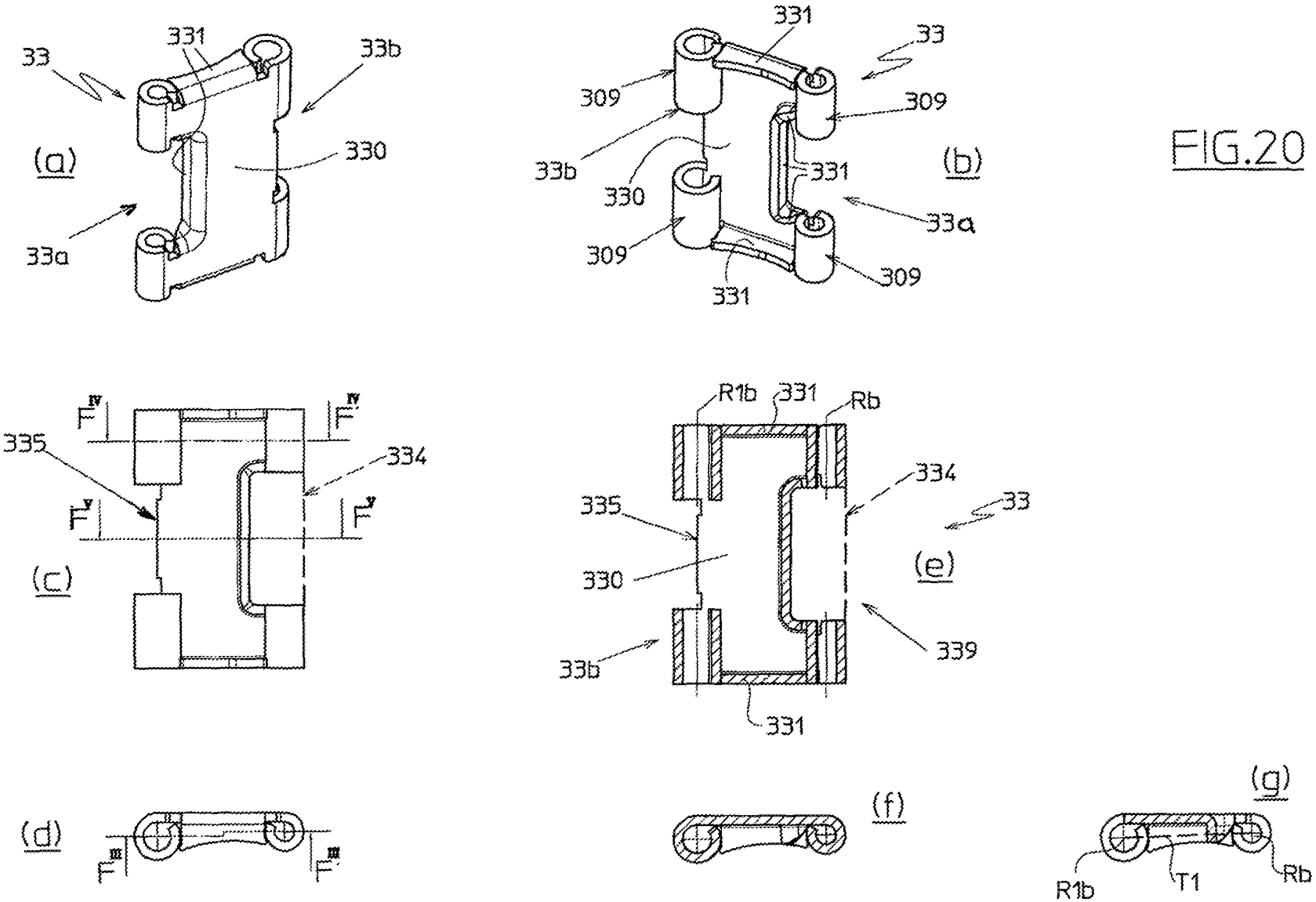
FIG. 20 illustrates a variation of the first connecting rod of the articulation device of the hinge of FIG. 19: in a front perspective view (detail (a)), in a rear perspective view (detail (b)), in a rear view (detail (c)), in top plan view (detail (d)), in longitudinal section along the plane indicated by F"-F" in FIG. 20(*d*) (detail (e)), in cross-section in the plane indicated by $F^{IV}$-$F^{IV}$ in FIG. 20(*c*) (detail (f)), in cross-section in the plane indicated by $F^{V}$-$F^{V}$ in FIG. 20(*c*) (detail (g)).

By matching FIG. 17 with FIG. 19, on one hand, and FIG. 18 with FIG. 20 on the other, it is possible to detect a close analogy between the embodiments of the second arm 32' and the embodiments of the first connecting rod 33. If one ignores the fact that the curve that the shaped bottom 330 of the first connecting rod 33 defines in orthogonal projection on a plane perpendicular to the direction of the length Z1, Z2 of the connecting bodies 2*a*, 2*b* is, in the form illustrated in the figures, a segment of straight line (while for the second arm 32' it is a curve shaped in a different way), what distinguishes the first connecting rod 33 and second arm 32' is primarily (except other minor details) the fact that in orthogonal projection on the respective reference planes: the first connecting rod 33 has much shorter prongs of the second arm 32'; the bottom 330 of the first connecting rod 33 and its extension at the second longitudinal side 335 define an area proportionally larger than that of the prongs, with respect to what the bottom 320' of the second arm 32' and its extension in correspondence of the second longitudinal side 325' do. Similarly, by matching FIG. 15 with FIG. 21, on one hand, and FIG. 16 with FIG. 22 on the other hand, it is possible to detect a close analogy between the embodiments of the first arm 32 and the forms of realization of the the second connecting rod 33'. Apart from the fact that the curve that the shaped bottom 330' of the second connecting rod defines in orthogonal projection onto a plane perpendicular to the direction of the length Z1, Z2 of the connecting bodies 2*a*, 2*b* is, as shown in the figures, a line segment (while for the first 32 arm is a curve shaped differently), what distinguishes second connecting rod 33 and first arm 32 is mainly (apart from other minor details) that in orthogonal projection on the respective reference planes: the second connecting rod 33' has prong much shorter than the first arm 32; the part of the bottom 330' of the second connecting rod 33' which extends, in correspondence of the first longitudinal side 334', beyond the first 322' and/or second 333' transverse side, defines a surface proportionally wider than that of prong, in comparison with what the corresponding portion of the bottom 320 of the first 32 arm which extends beyond the first 322 and/or the second 323 transversal side in correspondence of the first longitudinal 324 does. Once noted these close similarities, it is also possible to apply directly to the first 33 and/or the second connecting rod 33' all what is specified in relation to the second 32' and, respectively, to the first arm 32 according to all their possible variations (with the only caveat that the first and the second connecting rod 33, 33' are generally not coupled to each other on a single axis of rotation, as it is the case in the first and second arms 32, 32'). In particular, it can be seen that, on the first 33 and/or on the second connecting rod 33', substantially cylindrical seats 309, 309' can be realized which have characteristics similar to those 327*a*, 327*b*, 327'*a*, 327'*b* made on the first 32 and/or on the second 32' arm, in particular with a similar relationship between seats 309, 309' and the respective walls 331, 331' of the bottom side 330, 330'. Equally similarly, the side walls 331, 331' of the bottom 330, 331' of the first 33 and/or the second 33' connecting rod may present (in particular in correspondence of the locations 309, 309' as in FIGS. 19 and 21) through holes 308, 308' for purposes similar to those described in relation to the first 32 and second 32' arm.

Similarly, all the features of the first 32 and/or of the second arm 32' can be extended to the second 33' and/or to the first connecting rod 33, respectively.

In an embodiment not illustrated, the bottom 320, 320' of at least one arm 32, 32' of the articulation device 3 comprises a central band corresponding to the position of the common rotation axis R which extends beyond the first 322, 322' and beyond the second 323, 323' transverse side of the bottom 320, 320' toward the outside of the latter. The section of the peripheral edge created by the side walls 321, 321' of the arm 32, 32' that corresponds to the first 322, 322' and/or the second 323, 323' transverse side of the bottom 320, 320' follows the edge of this central band and stops at the most at one end of said central band distal from the first end 322, 322' and/or from the second 323, 323' transverse side of the bottom 320, 320'.

Figure 24:
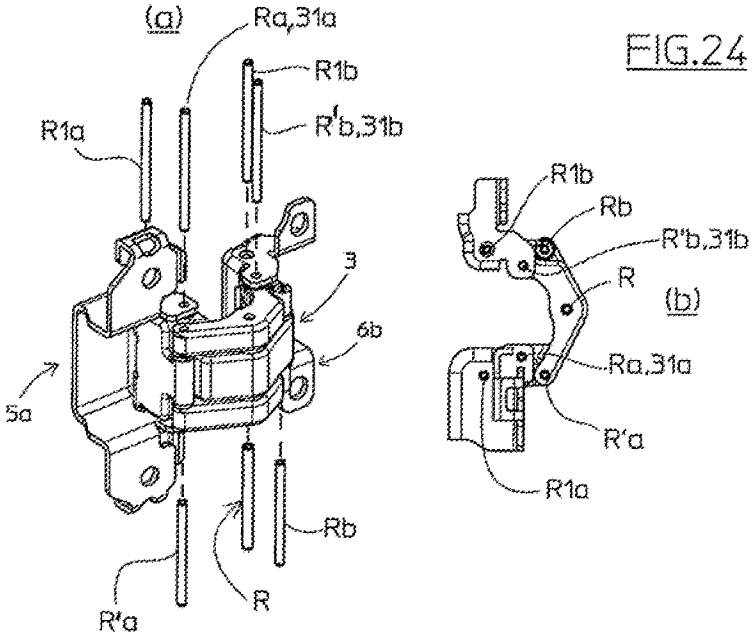
in FIG. 24(*a*) the assembling of the device and its mounting, using the relevant pins, on the first movable body of the first connecting body and the second movable body of the second connecting body and in FIG. 24(*b*) the relevant final result in top plan view.
Figure 26:
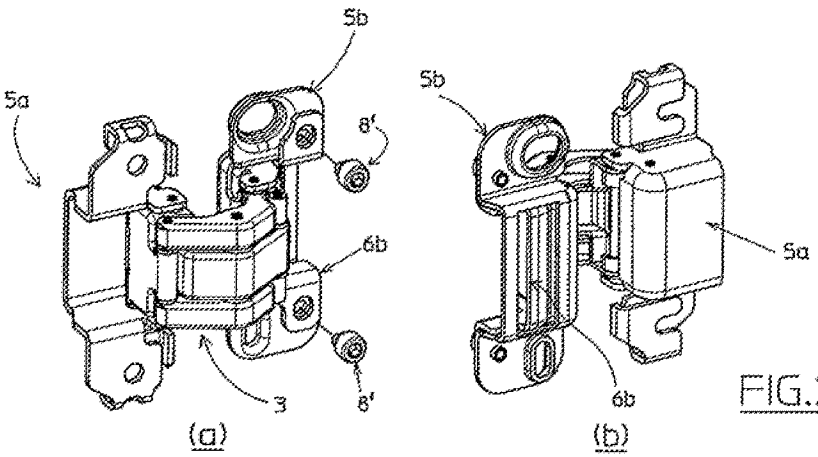
in FIGS. 26(*a*) and 26(*b*) the assembling the of the eccentrics devoted to the adjustment of the position of the second connecting body with respect to the first movable body of the second connecting body.
Figure 25:
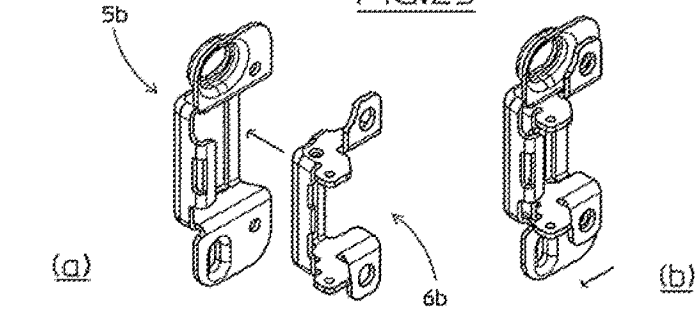
in FIGS. 25(*a*), 25(*b*) the insertion of the second movable body of the second connecting body inside the first movable body of the second connecting body.
Figure 29:
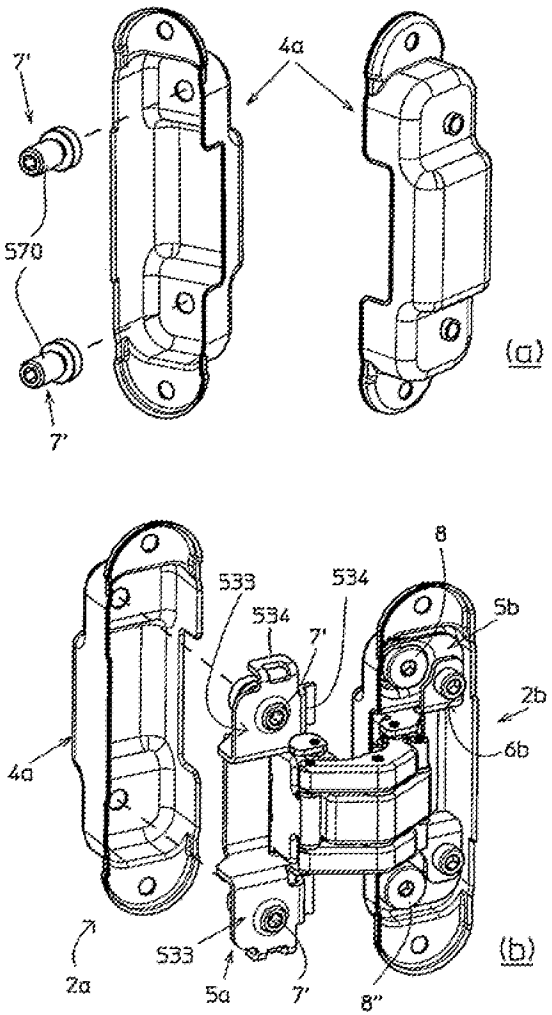
FIG. 29 illustrates, with reference to the variation of the hinge of FIG. 2, assembling steps which are analogous to those of FIG. 28 specifically.

In FIGS. 23 to 29, a non-limiting example of the succession of the stages of assembly of the hinge 1 is schematically illustrated. In FIG. 23, the insertion into the through holes of the arms 32, 32' (FIG. 23(*b*)) and any connecting rods 33, 33' (FIG. 23(*a*)) of the corresponding bushes (preferably made of plastic material) is illustrated, to decrease the friction between the parts and, preferably, at the same time also reduce the clearances between the various components of the articulation device 3. The components of the articulation device 3, in particular the arms 32, 32' (and, if present, the connecting rods 33, 33') are coupled between them and on the connecting bodies 2*a*, 2*b* (in particular to the support structure 4*a*, 4*b* and/or to movable inserts 5*a*, 5*b* and/or to the movable bodies 5*a*, 5*b*, 6*b* most distal from the support structure 4*a*, 4*b*. Specifically, as shown in FIG. 24, on the first movable body 5*a* of the first connecting body 2*a* and the second movable body 6*b* of the second connecting body 2*b*) with corresponding pivot pins (FIG. 24). In the presence of more or less nested structures, one assembles the movable inserts 5*a*, 5*b* and/or movable bodies 5*a*, 5*b*, 6*b* with the respective housing structures (FIGS. 25-29). In particular, in the embodiment illustrated in the figures, the second movable body 6*b* of the second connecting body 2*b* (possibly already provided with its own connection to the articulation device) is inserted into the corresponding first movable body 5*b* of the connecting body 2*a* with its own flat flange portions 633 in contact of respective portions of the flat flange 533' of the first movable body 5*b* of the first connecting body 2*b* (FIG. 25). The second movable body 6*b* of the second connecting body 2*b* is then fixed on the respective first movable body 5*b* by inserting, in corresponding holes and/or through housings of the flat flange portions 533', 633, fixing means and/or adjustment actuators 8' (FIG. 26, where, in particular, two eccentrics 8' are used for the adjustment along the direction of the width Y2 of the second connecting body 2*b*). The first movable body 5*b* of the second connecting body is then inserted in the respective housing structure, i.e. in the support structure 4*b* of the second connecting body 2*b* (in particular with its flat flange portions 533' in correspondence of the end parts 41*b* of the support structure 4*b*), and locked therein in position (FIG. 27, wherein in particular one uses an adjustment actuator 8, for example an eccentric, and a locking screw 8"). One then inserts the first movable body 5*a* of the first connecting body 2*a* in the corresponding housing structure, namely the support structure 4*a* of the first connecting body 2*a* (FIG. 28 or 29). In one case (FIG. 28), the adjustment actuators 7 of the position of the first movable body 5*a* are inserted in the respective grooves 72 of the housing and then one inserts the first movable body 5*a* in the support structure 4*a*, engaging the thread of the stem 71 of the actuators 7 with corresponding female threads on the bottom 42*a* of the support structure 4*a* (carried out in particular on the proximal portions 411*a* of the end parts 41*a* of the support structure 4*a*). In an alternative case (FIG. 29) the actuators 7 (made as threaded pins) are locked for translation on the bottom 42*a* of the support structure 4*a*, in particular on the proximal portions 411*a* of the end parts 41*a* of the supporting structure 4*a*, and then the thread of the actuator 7 is engaged on the corresponding nuts produced in the flat flange portions 533 of the first movable body 5*a*.

In general, also as regards the characteristics of an arm 32, 32' and/or of a connecting rod 33, 33', the continuity between the side and bottom walls does not imply the complete absence of apertures. Without substantially adversely affecting the mechanical seal of said arm 32, 32' and/or connecting rod 33, 33', openings may be provided locally in the junction between the bottom and the peripheral edge and/or on the bottom and/or on the side walls.

The invention realizes important advantages.

Each of the main components of the hinge (support structures of connecting bodies; movable inserts and/or movable bodies; articulation device, particularly each of its components in the form of arms and/or connecting rods) separately has a structure that optimizes the mechanical characteristics and allows the use of a good mechanical strength material of thickness less than those of the known art, with consequent saving of material and costs. Each of these components of the hinge, separately, as shaped from a single metal sheet into a corresponding concave three-dimensional structure and/or specific box-shaped, can be made by the deep drawing technique, possibly assisted by limited bending operations and/or cutting and/or perforation. With these components, hinges can be realized that are obtained (at least in their main parts) in whole or in part by drawing. The use of steel with high mechanical performance in sheets of limited thickness is made possible, with equal weight of the final hinge, allowing to make available a product that combines high performance at a limited cost.

The invention thus conceived is susceptible to numerous modifications and variations, all falling within the inventive concept that characterizes it.

Moreover all details are replaceable with other technically equivalent elements.

In practice, all materials employed, as well as the dimensions, may be any according to the requirements.

The invention claimed is:

1. Invisible hidden hinge for doors of the type comprising:

a first connecting body intended to be inserted within a respective housing cavity formed in the jamb or in the leaf of the door, the first connecting body extending:

in depth along a first direction in the space which coincides with the direction of insertion in the respective housing cavity in the jamb or in the door leaf;

in width along a second direction in the space perpendicular to the first direction;

in length along a third direction in the space perpendicular to both the first and the second direction;

a second connecting body intended to be inserted inside a respective housing cavity formed in the jamb or in the leaf of the door, the second connecting body extending:

in depth along a fourth direction in the space which coincides with the direction of insertion in the respective housing cavity in the door jamb or leaf;

in width along a fifth direction in the space perpendicular to the fourth direction;

in length along a sixth direction in the space perpendicular to both the fourth and the fifth direction;

an articulation device that interconnects the first and the second connecting bodies allowing their relative movement between a closed condition, corresponding to the closure of the door, and a condition of complete opening, corresponding to the complete opening of the door;

in the closed condition the first and the second connecting bodies defining, in combination between them, a seat in which the articulation device is enclosed, the first and/or the second connecting body comprising a supporting structure, which in turn comprises:

a central part intended to accommodate part of the articulation device;

two end portions, placed on opposite sides of the central part along the length direction of the respective connecting body and intended to interact with and/or accommodate fixing means of the connecting body to the jamb or the leaf;

the first and the second connecting bodies having two sides opposite with respect to a plane defined by the depth direction and by the length direction, of said two sides the inner one being the side that in the opening-closing movement of the hinge runs the shorter trajectory path, the outer one being the other; the first and/or the second connecting body further comprising a first movable body accommodated in the supporting structure movable relative to the latter for a regulation of the position of the hinge and intended to engage part of the articulation device, the supporting structure thus realizing an housing structure for the first movable body, characterized in that said first movable body is shaped from a respective single metallic sheet in a single concave piece having concavity defined by a bottom of the first movable body and by side walls of the first movable body that rise from the bottom in the direction opposite to the depth one of the connecting body and develop mainly parallel to said depth direction creating a continuous perimeter edge of the bottom, joined to the bottom without interruption in the material which said respective single metallic sheet consists of and surrounding the bottom on at least three consecutive sides according to a curve that develop around the depth direction of the connecting body, among said at least consecutive three sides, the first and the third being parallel to the width direction of the connecting body, the second being parallel to the length direction of the connecting body.

2. Hinge according to claim 1, characterized in that the first and/or the second connecting body further comprises a second movable body accommodated in the first movable body, movable relative to the latter for a further adjustment of the position of the hinge and intended to accommodate part of the articulation device, the first movable body thus realizing a supporting structure for the second movable body, said second movable body being made from a respective single metallic sheet in one single concave piece having concavity defined by a bottom of the second movable body and by the side walls of the second movable body that rise from the bottom in the direction opposite to the depth one of the connecting body and develop mainly parallel to said depth direction, creating an perimeter continuous edge of the bottom, joined to the bottom without interruption in the material which said respective single metallic sheet consists of and surrounding the bottom on at least three consecutive sides according to a curve that develops around the depth direction of the connecting body, among said at least three consecutive sides, the first and the third being parallel to the width direction of the connecting body, the second being parallel to the length direction of the connecting body.

3. Hinge according to claim 2, characterized in that the first and/or the second connecting body comprises a plurality of second movable bodies accommodated in one another, each movable relative to each other and relative to the first movable body for a respective further adjustment position of the hinge, the first movable body thus providing a housing structure for the first of the second movable bodies of said plurality, and each second movable body, in turn, so realizing a respective accommodating structure for the second movable body accommodated therein, each of said second movable bodies being shaped from a respective single metallic sheet in one single concave piece having concavity defined by a respective bottom and by respective side walls that rise from the bottom in the direction opposite to the depth direction of the connecting body and develop mainly parallel to said depth direction creating a continuous perimeter edge of the bottom, joined to the bottom without interruption of the material of which consists said respective single metallic sheet and surrounding the bottom on at least three consecutive sides according to a curve that develops around the depth direction of the connecting body, among said at least three consecutive sides, the first and the third being parallel to the width direction of the connecting body, the second being parallel to the length direction of the connecting body.

4. Hinge according to claim 1, characterized in that the first and/or the second connecting body further comprises one or more movable inserts accommodated in the movable body distal from a bottom of the central part of the supporting structure in the direction opposite to the depth direction of the connecting body, said one or more movable inserts being movable relative to said distal movable body for a regulation of the position of the hinge and intended to engage, directly or indirectly, part of the articulation device, each of said one or more movable inserts being shaped from a respective single metallic sheet.

5. Hinge according claim 1, characterized in that said second side of at least one of movable bodies of the connecting body, preferably of all movable bodies of the connecting body, is placed in correspondence of the inner side of the connecting body.

6. Hinge according to claim 1, characterized in that the perimeter edge of at least one of the movable bodies of the connecting body is closed around the bottom of the movable body itself, surrounding it also on its fourth parallel side and opposite to the second one.

7. Hinge according to claim 1, characterized in that in the connection area between its bottom and its side walls and/or on its bottom and/or on its side walls at least one of the movable bodies of the connecting body has one or more localized through openings formed in order to lightening the structure and/or functional service.

8. Hinge according to claim 1, characterized in that at least one of the movable bodies of the connecting body, comprises:

a respective central part intended to accommodate part of the articulation device and inserted into a central part of the respective housing structure;

two respective end portions located on opposite sides of the central part along the length direction of the respective connecting body and coupled with a, preferably the respective, housing structure on two end portions thereof positioned on opposite sides of the central part along the length direction of the respective connecting body, in particular on portions of said two end portions of the housing structure proximal to its central part.

9. Hinge according to claim 1, characterized in that the movable body most distal in the direction opposite to the depth direction of the connecting body from a bottom of the central part of the supporting structure, supports at least one fixed rotational axis of the articulation device parallel to the length direction of the connecting body.

10. Hinge according to claim 9, characterized in that said at least one fixed rotational axis is preferably placed in correspondence of the inner side of the connecting body.

11. Hinge according to claim 10, characterized in that on said movable body most distal, in correspondence of the inner side of the connecting body, the side walls corresponding to the first and the third side of the perimeter edge has each a respective mechanical appendage which protrudes toward the outside of the movable body in the opposite direction to the depth direction of the connecting body, said respective mechanical appendages being aligned with one another along an axis parallel to the length direction of the connecting body and supporting said at least one fixed rotational axis of the articulation device.

12. Hinge according to claim 10, characterized in that on said most distal movable body the side wall corresponding to the second side of the perimeter edge one or more shaped mechanical appendages which protrudes toward the outside of the movable body in the direction opposite to the depth direction of the connecting body, said respective mechanical appendages being aligned with each other along an axis parallel to the length direction of the connecting body to support and/or to keep in guide said at least one fixed rotational axis of the articulation device.

13. Hinge according to claim 1, characterized in that at least one movable body is movable by guide along the width direction or along the length direction of the respective connecting body relative to the corresponding housing structure for an adjustment of the position of the hinge along said direction.

14. Hinge according to claim 13, characterized in that in correspondence of the bottom of said corresponding housing structure a seat is formed for the insertion of a shaped portion of the bottom of said at least one movable body which is accommodated in said corresponding housing structure, in said seat a stroke being provided for the regulation of the position of said at least one movable body in its housing structure along the width direction or along the length direction of the respective connecting body, preferably along the width direction, with respect to the corresponding housing structure for a regulation of the position of the hinge along said direction.

15. Hinge according to claim 14, characterized in that said corresponding housing structure has on its own bottom a through opening which carries out said seat, enclosed on its own four sides by a continuous frame, belonging to said own bottom, in which the shaped portion of the bottom of said at least one movable body is inserted, which is accommodated in said respective housing structure, between said shaped portion and said frame being defined the stroke for the regulation of the position of said at least one movable body in its respective housing structure along the width direction or along the length direction of the respective connecting body, preferably along the width direction, respect to the corresponding housing structure for a regulation of the position of the hinge along said direction.

16. Hinge according to claim 14, characterized in that the shaped portion of the bottom of said at least one movable body inserted in the seat completes, less then the regulation stroke, the bottom of said housing structure.

17. Hinge according to claim 13, characterized in that it comprises:

coupling means of said at least one movable body with said respective housing structure placed between the outer side of the respective connecting body and a mid-plane of the same connecting body defined by a direction parallel to the depth direction and by a direction parallel to the length direction of the connecting body;

elements of interference against the rotation of said at least one movable body around an axis parallel to the length direction of the connecting body and passing through said coupling means, said elements of interference being preferably placed in an opposite part of said coupling means with respect to said mid-plane of the connecting body, most preferably placed at the inner side of the connecting body.

18. Hinge according to claim 13, characterized in that said housing structure corresponding to said at least one movable body is an additional movable body, comprised between the supporting structure and said at least one movable body and movable in its own housing structure along the other direction, between the width and the length directions of the connecting body, with respect to that along which said at least one movable body is movable.

19. Hinge according to claim 17, characterized in that said corresponding housing structure of said at least one movable body is an additional movable body comprised between the supporting structure and said at least one movable body and movable in the other direction between the width and the length directions of the connecting body, with respect to that along which said at least one movable body is movable, the elements of interference against the rotation of said movable body comprising:

a tab protruding from the side wall of the bottom of the additional movable body corresponding to the inner side of the connecting body, bent transversely to said side wall around an axis parallel to the length direction of the connecting body within the latter and formed from said side wall without interruption in the material the single metallic sheet is made, from which the additional movable body is shaped;

a portion, preferably a free edge, of the side wall of the bottom of said at least one movable body corresponding to the inner side of the connecting body in abutment on and/or engaged with said tab.

20. Hinge according to claim 13, characterized in that said respective housing structure corresponding of said at least one movable body is an additional movable body, comprised between the supporting structure and said at least one movable body and movable in its own housing structure along the other direction, between the width and the length directions of the connecting body, with respect to that along which said at least one movable body is movable, and in that both in said at least movable body, and in the additional movable body, the side walls corresponding to the first and to the third side of the perimeter edge of the corresponding bottom each extend, without interruption in the material constituting the single metallic sheet from which said at least one movable body is shaped and without interruption in the material constituting the single metallic sheet from which the additional body is shaped, folding back about an axis parallel to the width direction of the connecting body, in flat flange portions lying on a plane defined by a direction parallel to the width direction of the connecting body and by a direction parallel to the length direction of the connecting body, the flat flange portions of said at least one movable body being resting on the flat flange portions of the additional movable body.

21. Hinge according to claim 20, characterized in that on the portions of the flat flange corresponding openings and/or through seats are provided for accommodating an/or for blocking:

fixing screws of said at least one movable body with respect to to said additional movable body and/or of the additional movable body with respect to the relative supporting structure, and/or;

parts of actuators for the position adjustment of said at least one movable body with respect to said additional movable body and/or of the additional movable body with respect to the relative supporting structure.

22. Hinge according to claim 1, characterized in that at least one of the movable bodies is movable by guide along the depth direction of the respective connecting body with respect to the corresponding housing structure for an adjustment of the position of the hinge along said direction.

23. Hinge according to claim 22, characterized in that in at least one of the movable bodies, the side walls corresponding to the first and third side of the perimeter edge of the corresponding bottom, each extend without interruption in the material constituting the single metallic sheet from which said at least one of the movable bodies is shaped and folding back about an axis parallel to the width direction of the connecting body in the flat flange portions lying on a plane defined by a direction parallel to the width direction of the connecting body and by a direction parallel to the length direction of the connecting body, in each of said flat flange portions a corresponding through opening being made for engaging an adjustment actuator for the adjustment of the position of said at least one of the movable bodies with respect to the relevant housing structure.

24. Hinge according to claim 23, characterized in that in correspondence of the through opening the flat flange portion is bent to form a corresponding threaded sleeve that surrounds said through opening and extends away from the flat flange portion by a predetermined distance toward the inside of the connecting body along the depth direction, in each threaded sleeve being engaged a corresponding threaded pin rotatably constrained to the respective supporting structure and/or to the supporting structure with its own longitudinal axis parallel to the direction of the width and without the freedom to rotate along its own longitudinal axis.

25. Hinge according to claim 24, characterized in that each of said flat flange portions extends, on an own side edge and without interruption in the material constituting the single metallic sheet from which said at least one movable body is shaped, in one or more portions folded back around an axis parallel to the length direction and/or to the width direction of the connecting body and having at least a part lying on a plane parallel to the depth direction of the connecting body, to form one or more corresponding abutment tabs on walls of the respective housing structure and/or the supporting structure and at least aiding the guided movement of said at least one movable bodies along the depth direction of the connecting body.

26. Hinge according to claim 1, characterized in that in at least one of the movable bodies the side wall corresponding to the first side and the side wall corresponding to the third side each realize a respective portion of said at least one of the movable bodies transverse to the length direction of the connecting body which, from its own side facing in the direction opposite to the depth direction of the connecting body, extends, without interruption in the material constituting the single metallic sheet from which said at least one of the movable bodies is shaped and folding back consecutively around respective axes parallel to the width direction of the connecting body, in:

a first section parallel to both the width direction and the length direction of the connecting body which develops along the length direction of the connecting body extending away from the central part of the supporting structure;

a second section, consecutive and transverse to the first one, preferably parallel at least to the width direction, most preferably parallel also to the depth direction, of the connecting body;

a third section, consecutive to the second one, parallel to both the width direction and the length direction of the connecting body, faced to the first section at a predetermined distance from this latter in the depth direction of the connecting body and which develops along the length direction of the connecting body approaching the central part of the supporting structure;

the hinge further comprising, for each transverse portion of said at least one of the movable bodies, an adjustment actuator comprising along its own development direction a head and a stem and providing a diameter reduction on the stem compared to the head along its own developing direction and consecutively to the head for a predetermined length along the stem, said adjustment actuator being inserted, with its own developing structure parallel to the depth direction of the connecting body, in a housing groove which: develops perpendicular to the depth direction of the connecting body, has an open end for engaging the adjustment actuator and a transverse section which, along the depth direction of the connecting body, is locally complementary to said diameter reduction on the stem compared to the head so that the adjustment actuator is free to rotate around an axis parallel to the depth direction of the connecting body but not to translate along said axis, the stem being engaged on portions of the connecting body so that the rotations in opposite directions of the actuator around said axis parallel to the depth direction of the connecting body correspond to opposed movements of said at least one of the movable bodies with respect to the supporting structure along an adjustment direction; the distance between the first and the third section corresponding to the height of the head in the development direction of the actuator, the housing groove being defined by the space between the first and the third section in combination with a slot made in the third section and developing inside it till an own open end positioned in correspondence of a perimeter wall of the third section and in which the steam of the actuator is insertable at least in correspondence of said diameter reduction.

27. Hinge according to claim 26, characterized in that the slot has its own open end in correspondence of a perimeter side of the third section which is parallel to the length direction of the connecting body, said perimeter side of the third section being preferably the one corresponding to the outer side of the connecting body.

28. Hinge according to claim 26, characterized in that the slot has its own end open in correspondence of the perimeter side of the third section which is parallel to the width direction of the connecting body and which is shared with the second section, on the second section a through opening being made, which communicates with the open end of the slot and defines, in combination with said open end, the open end of the housing groove.

29. Hinge according to claim 26, characterized in that on the first section of the extension of the transverse portion a through opening is made to allow an user to access with a tool the head of the adjustment actuator of the front part of the connecting body.

30. Hinge according to claim 29, characterized in that said through opening is in correspondence of a closed end of the slot opposite to the open end.

31. Hinge according to claim 26, characterized in that the extension of the transverse portion made by respective first, second and third section is inserted in a respective cavity and guide housing in the connecting body.

32. Hinge according to claim 26, characterized in that:

in correspondence of one of the sides of the connecting body, preferably in correspondence of the inner side, the transverse portions have each a respective mechanical appendage which, without interruption in the material constituting the single metallic sheet from which is shaped said at least one of the movable bodies, protrudes toward the outside in the direction opposite to the depth direction of the connecting body to support said at least one fixed rotational axis of the articulation device;

the first section of the extension of the transverse portion being on the side of said appendage, toward the opposite side of the connecting body, preferably the outer side.

33. Hinge according to claim 32, characterized in that the third section of the extension of the transverse portion, without interruption in the material constituting the single metallic sheet from which said at least one of the movable bodies is shaped, extends laterally toward the side of the connecting body in correspondence of which the appendage is made, here having a folding around an axis parallel to the length direction of the connecting body to form an extension of abutment and guide on walls of the connecting body, preferably on walls of the supporting structure.

34. Hinge according to claim 31, characterized in that the extension of abutment and guide is dimensioned, shaped and placed in such a way as not to obstruct the access to the fixed rotational axis of the articulation device supported by the mechanical appendage.

35. Hinge according to claim 26, characterized in that the actuator inserted in the housing groove is rotating around the longitudinal axis of the stem.

36. Hinge according to claim 35, characterized in that the stem is threaded and engaged in a respective nut screw made on the connecting body, preferably on a bottom of the supporting structure, most preferably of the end side corresponding to the position of the adjustment actuator, the position of said at least one of the movable bodies being adjusted in opposite ways along the depth direction of the connecting body by unscrewing and screwing the adjustment actuator, realizing in this way the corresponding adjustment of the position of the hinge.

37. Hinge according to claim 1, characterized in that:

the first connecting body comprises a respective supporting structure and a respective first movable body movable with respect to the supporting structure, which is the housing structure, along the depth direction of the first connecting body, said respective first movable body being movable by guide along the depth direction of the respective connecting body with respect to the corresponding housing structure for an adjustment of the position of the hinge along said direction;

the second connecting body comprises a respective supporting structure, a respective first movable body having the respective supporting structure as own housing structure, and a respective second movable body having the respective first movable body as own housing structure, said respective first movable body being movable with respect to the supporting structure along the length direction of the second connecting body, said respective second movable body being movable with respect to the respective first movable body along the width direction of the second connecting body, the nested structure of the second connecting body being defined so that in the second connecting body:

said housing structure corresponding to said at least one movable body is an additional movable body, comprised between the supporting structure and said at least one movable body and movable in its own housing structure along the other direction, between the width and the length directions of the connecting body, with respect to that along which said at least one movable body is movable;

wherein said at least one movable body is said respective movable body, while said further movable body is the respective first movable body.

* * * * *